US010207161B2

(12) United States Patent
Stokke et al.

(10) Patent No.: US 10,207,161 B2
(45) Date of Patent: Feb. 19, 2019

(54) CLUB HEAD HAVING BALANCED IMPACT AND SWING PERFORMANCE CHARACTERISTICS

(71) Applicant: Karsten Manufacturing Corporation, Phoenix, AZ (US)

(72) Inventors: Ryan M. Stokke, Anthem, AZ (US); Sina Ghods, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/815,589

(22) Filed: Nov. 16, 2017

(65) Prior Publication Data

US 2018/0140906 A1 May 24, 2018

Related U.S. Application Data

(60) Provisional application No. 62/469,911, filed on Mar. 10, 2017, provisional application No. 62/449,403, filed on Jan. 23, 2017, provisional application No. 62/423,878, filed on Nov. 18, 2016.

(51) Int. Cl.
*A63B 53/04* (2015.01)
*A63B 53/06* (2015.01)

(52) U.S. Cl.
CPC .. *A63B 53/0466* (2013.01); *A63B 2053/0408* (2013.01); *A63B 2053/0437* (2013.01); *A63B 2053/0445* (2013.01)

(58) Field of Classification Search
USPC ..... 473/324–350
See application file for complete search history.

(56) References Cited

U.S. PATENT DOCUMENTS

| | | | | |
|---|---|---|---|---|
| 6,607,452 | B2 | 8/2003 | Helmstetter et al. | |
| 6,789,304 | B2 * | 9/2004 | Kouno | A63B 53/02 29/527.5 |
| 6,939,247 | B1 | 9/2005 | Schweigert et al. | |
| 6,991,558 | B2 | 1/2006 | Beach et al. | |
| 7,137,905 | B2 | 11/2006 | Kohno | |
| 7,163,468 | B2 | 1/2007 | Gibbs et al. | |
| 7,232,380 | B2 * | 6/2007 | Nakahara | A63B 53/047 473/324 |
| 7,500,926 | B2 | 3/2009 | Rae et al. | |
| 7,563,178 | B2 * | 7/2009 | Rae | A63B 53/0466 473/345 |

(Continued)

FOREIGN PATENT DOCUMENTS

| | | |
|---|---|---|
| EP | 2340875 | 7/2011 |
| JP | 2008154999 | 2/2008 |
| JP | 2009061264 | 3/2009 |

OTHER PUBLICATIONS

US 8,277,335, 10/2012, Beach et al. (withdrawn)
International Search Report/Written Opinion, PCT Application No. PCT/US2014/028134, dated Jul. 1, 2014.

*Primary Examiner* — Alvin Hunter

(57) ABSTRACT

Described herein are embodiments of golf club heads having a balance of the following parameters: a low and back club head center of gravity position, a high moment of inertia, and low aerodynamic drag. Methods of manufacturing the embodiments of golf club heads having a balance of club head center of gravity position, moment of inertia, and aerodynamic drag are also described herein.

14 Claims, 31 Drawing Sheets

(56) References Cited

U.S. PATENT DOCUMENTS

| | | | | |
|---|---|---|---|---|
| 7,575,524 | B2 | 8/2009 | Willett et al. | |
| 7,674,189 | B2 * | 3/2010 | Beach | A63B 53/0466 473/345 |
| 7,731,603 | B2 | 6/2010 | Beach et al. | |
| 7,850,544 | B2 | 12/2010 | Meyer et al. | |
| 8,025,591 | B2 | 9/2011 | De La Cruz et al. | |
| 8,083,609 | B2 | 12/2011 | Burnett et al. | |
| 8,100,781 | B2 | 1/2012 | Burnett et al. | |
| 8,192,304 | B2 | 6/2012 | Rae et al. | |
| 8,206,244 | B2 | 6/2012 | Honea et al. | |
| 8,241,143 | B2 | 8/2012 | Albertsen et al. | |
| 8,267,808 | B2 | 9/2012 | De La Cruz et al. | |
| 8,333,668 | B2 | 12/2012 | De La Cruz et al. | |
| 8,435,137 | B2 | 5/2013 | Hirano | |
| 8,496,544 | B2 | 7/2013 | Curtis et al. | |
| 8,506,419 | B2 | 8/2013 | Hirano | |
| 8,647,216 | B2 | 2/2014 | Beach et al. | |
| 8,663,029 | B2 | 3/2014 | Beach et al. | |
| 8,758,153 | B2 | 6/2014 | Sargent et al. | |
| 8,808,108 | B2 | 8/2014 | Schweigert | |
| 8,834,294 | B1 * | 9/2014 | Seluga | A63B 53/04 473/338 |
| 8,900,069 | B2 | 12/2014 | Beach et al. | |
| 9,144,722 | B2 * | 9/2015 | Schweigert | A63B 53/0466 |
| 9,168,429 | B2 * | 10/2015 | Schweigert | A63B 53/0466 |
| 9,186,561 | B2 * | 11/2015 | Schweigert | A63B 53/08 |
| 9,199,138 | B2 | 12/2015 | Willett et al. | |
| 9,220,953 | B2 * | 12/2015 | Beach | A63B 53/06 |
| 9,839,818 | B2 * | 12/2017 | Jertson | A63B 53/0466 |
| 9,925,430 | B2 * | 3/2018 | Stokke | A63B 53/0466 |
| 9,925,432 | B2 * | 3/2018 | Morales | A63B 53/0475 |
| 2003/0032500 | A1 | 2/2003 | Nakahara et al. | |
| 2009/0029795 | A1 | 1/2009 | Schweigert et al. | |
| 2009/0137338 | A1 | 5/2009 | Kajita | |
| 2010/0234125 | A1 | 9/2010 | Aoyama et al. | |
| 2010/0234126 | A1 | 9/2010 | Cackett et al. | |
| 2012/0071267 | A1 | 3/2012 | Burnett et al. | |
| 2012/0071268 | A1 | 3/2012 | Albertsen et al. | |
| 2012/0083361 | A1 | 4/2012 | Beach et al. | |
| 2012/0142452 | A1 | 6/2012 | Burnett et al. | |
| 2012/0172146 | A1 | 7/2012 | Greaney et al. | |

* cited by examiner

CLUB HEAD HAVING BALANCED IMPACT AND SWING PERFORMANCE CHARACTERISTICS

CROSS-REFERENCE TO RELATED APPLICATIONS

This claims the benefit of U.S. Provisional Patent Appl. No. 62/469,911, filed on Mar. 10, 2017, U.S. Provisional Patent Appl. No. 62/449,403, filed on Jan. 23, 2017, and U.S. Provisional Patent Appl. No. 62/423,878, filed on Nov. 18, 2016, the contents of all of which are incorporated fully herein by reference.

FIELD OF INVENTION

The present disclosure relates to golf club heads. In particular, the present disclosure is related to golf club heads having balanced impact and swing performance characteristics.

BACKGROUND

Various golf club head design parameters, such as volume, center of gravity position and moment of inertia, affect impact performance characteristics (e.g. spin, launch angle, speed, forgiveness) and swing performance characteristics (e.g. aerodynamic drag, ability to square the club head at impact). Often, club head designs that improve impact performance characteristics can adversely affect swing performance characteristics (e.g. aerodynamic drag), or club head designs that improve swing performance characteristics can adversely affect impact performance characteristics. Accordingly, there is a need in the art for a club head having enhanced impact performance characteristics balanced with enhanced swing characteristics.

Figure 1:
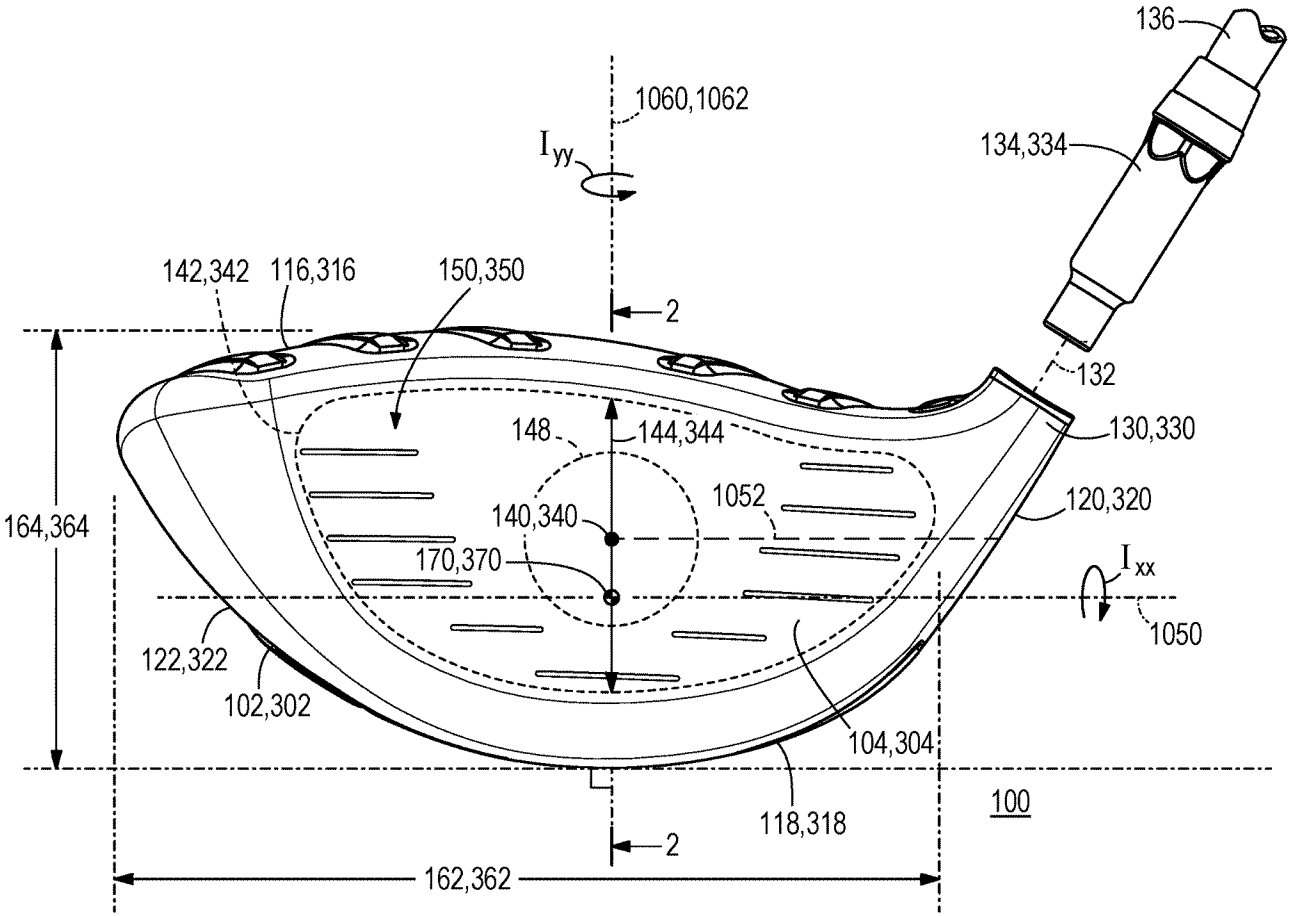
FIG. 1 is a front view of a golf club head according to one embodiment.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

The golf club described below uses several relations that increases or maximizes the club head moment of inertia with a down and back CG position while simultaneously maintaining or reducing aerodynamic drag. Specifically, the golf club described herein has a low and back CG as specified. The golf club further has a high crown-to-sole moment of inertia (Ixx) and heel-to-toe moment of inertia (Iyy). A low and back CG, and increased moment of inertia are achieved by increasing discretionary weight or repositioning discretionary weight regions of the golf club head having maximum distances from the head CG. Thinning the crown and/or using optimized materials increases discretionary weighting. Using removable weights, a steep crown angle, or embedded weight allow for discretionary weight to be removed and placed at a maximum distance from the CG.

The golf club head described herein also has a reduced aerodynamic drag over golf club heads with a similar CG position and moment of inertia. Aerodynamic drag is reduced by maximizing the crown height while maintaining a low and back CG position. Transition profiles between the strikeface to crown, strikeface to sole, and/or crown to sole along the back end of the golf club head provides a means to reduce aerodynamic drag. The using of turbulators and strategic placement of hosel weight further reduce aerodynamic drag.

The golf club described below uses several relations that increases or maximizes the club head moment of inertia with a down and back CG position while simultaneously maintaining or reducing aerodynamic drag. Balancing these relationships of CG, moment of inertia and drag improve impact performance characteristics (e.g. spin, launch angle, ball speed, and forgiveness) and swing performance characteristics (e.g. aerodynamic drag, ability to square the club head at impact, swing speed). This balance is applicable to a driver-type club head, a fairway wood type club head and a hybrid-type club head.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 2:
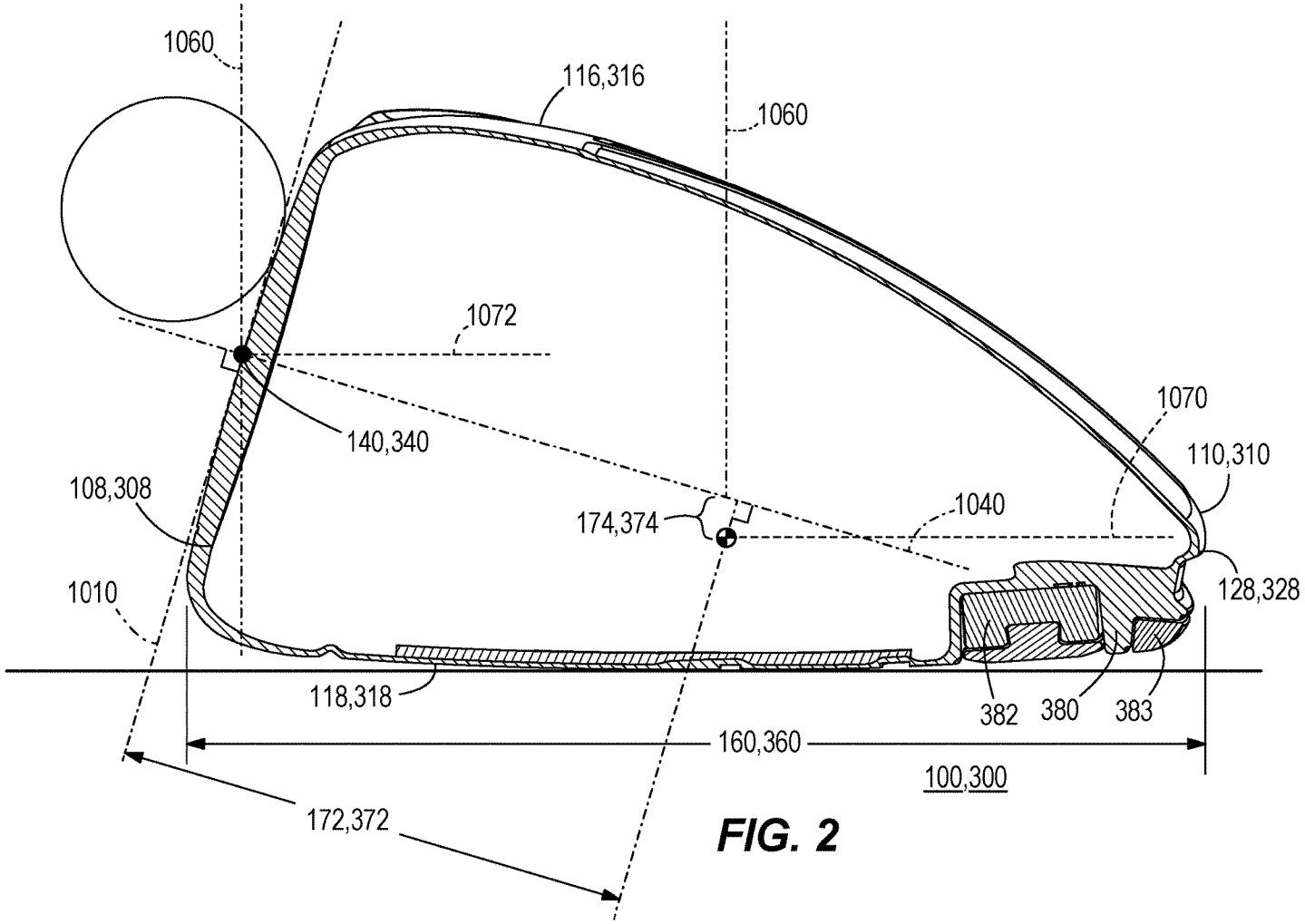
FIG. 2 is a side cross sectional view along line II-II of the golf club head in FIG. 1.
Figure 3:
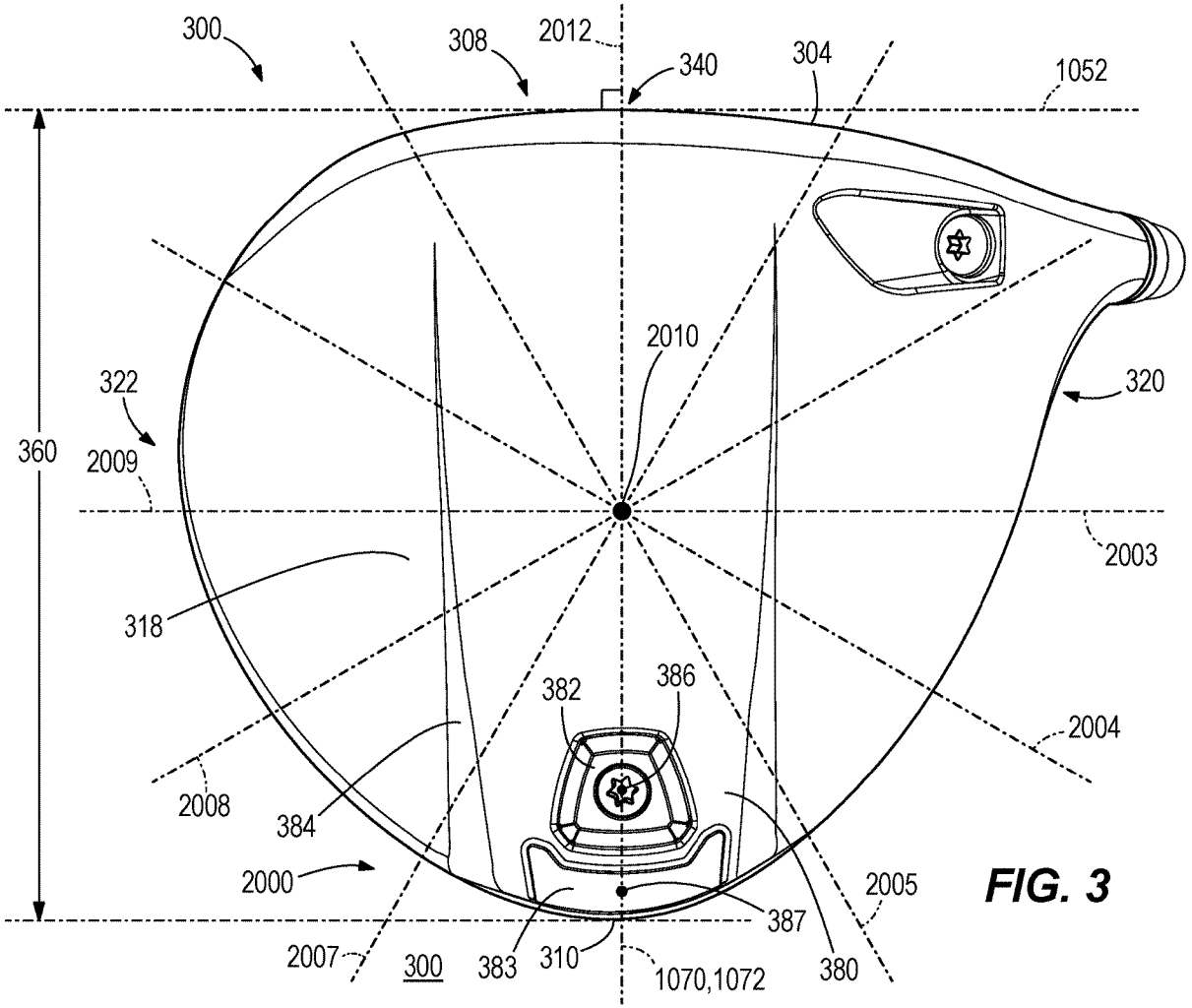
FIG. 3 is a bottom view of the golf club head in FIG. 1.

FIGS. 1-3 illustrate a golf club head 100 having a body 102 and a strikeface 104. The body 102 of the club head 100 includes a front end 108, a back end 110 opposite the front end 108, a crown 116, a sole 118 opposite the crown 116, a heel 120 and a toe 122 opposite the heel 120. The body 102 further includes a skirt or trailing edge 128 located between and adjoining the crown 116 and the sole 118, the skirt extending from near the heel 120 to near the toe 122 of the club head 100.

In many embodiments, the club head 100 is a hollow body club head. In these embodiments, the body and strikeface can define an internal cavity of the golf club head 100. In some embodiments, the body 102 can extend over the crown 116, the sole 118, the heel 120, the toe 122, the back end 110, and the perimeter of the front end 108 of the club head 100. In these embodiments, the body 102 defines an opening on the front end 108 of the club head 100 and the strikeface 104 is positioned within the opening to form the club head 100. In other embodiments, the strikeface 104 can extend over the entire front end 108 of the club head and can include a return portion extending over at least one of the crown 116, the sole 118, the heel 120, and the toe 122. In these embodiments, the return portion of the strikeface 104 is coupled to the body 102 to form the club head 100.

The strikeface 104 of the club head 100 comprises a first material. In many embodiments, the first material is a metal alloy, such as a titanium alloy, a steel alloy, an aluminum alloy, or any other metal or metal alloy. In other embodiments, the first material can comprise any other material, such as a composite, plastic, or any other suitable material or combination of materials.

The body 102 of the club head 100 comprises a second material. In many embodiments, the second material is a metal alloy, such as a titanium alloy, a steel alloy, an aluminum alloy, or any other metal or metal alloy. In other embodiments, the second material can comprise any other material, such as a composite, plastic, or any other suitable material or combination of materials.

The first and second material comprise a strength-to-weight ratio or specific strength measured as the ratio of the yield stress ($\sigma_y$) to the density ($\rho$) of the material (see Relation 1 below), and a strength-to-modulus ratio or specific flexibility measured as the ratio of the yield stress ($\sigma_y$) to the elastic modulus (E) of the material (see Relation 2 below).

$$\text{Specific Strength} = \frac{\sigma_y}{\rho} \qquad \text{Relation 1}$$

$$\text{Specific Flexibility} = \frac{\sigma_y}{E} \qquad \text{Relation 2}$$

As shown in FIG. 1, the club head 100 further comprises a hosel structure 130 and a hosel axis 132 extending centrally along a bore of the hosel structure 130. In the present example, a hosel coupling mechanism of the club head 100 comprises the hosel structure 130 and a hosel sleeve 134, where the hosel sleeve 134 can be coupled to an end of a golf shaft 136. The hosel sleeve 134 can couple with the hosel structure 130 in a plurality of configurations, thereby permitting the golf shaft 136 to be secured to the hosel structure 130 at a plurality of angles relative to the hosel axis 132. There can be other examples, however, where the shaft 136 can be non-adjustably secured to the hosel structure 130.

The strikeface 104 of the club head 100 defines a geometric center 140. In some embodiments, the geometric center 140 can be located at the geometric centerpoint of a strikeface perimeter 142, and at a midpoint of face height 144. In the same or other examples, the geometric center 140 also can be centered with respect to engineered impact zone 148, which can be defined by a region of grooves 150 on the strikeface. As another approach, the geometric center of the strikeface can be located in accordance with the definition of a golf governing body such as the United States Golf Association (USGA). For example, the geometric center of the strikeface can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

The club head 100 further defines a loft plane 1010 tangent to the geometric center 140 of the strikeface 104. The face height 144 can be measured parallel to loft plane 2270 between a top end of the strikeface perimeter 142 near the crown 116 and a bottom end of the strikeface perimeter 142 near the sole 118. In these embodiments, the strikeface perimeter 142 can be located along the outer edge of the stikeface 104 where the curvature deviates from the bulge and/or roll of the strikeface 104.

The geometric center 140 of the strikeface 104 further defines a coordinate system having an origin located at the geometric center 140 of the strikeface 104, the coordinate system having an X' axis 1052, a Y' axis 1062, and a Z' axis 1072. The X' axis 1052 extends through the geometric center 140 of the strikeface 104 in a direction from the heel 120 to the toe 122 of the club head 100. The Y' axis 1062 extends through the geometric center 140 of the strikeface 104 in a direction from the crown 116 to the sole 118 of the club head 100 and perpendicular to the X' axis 1052, and the Z' axis 1072 extends through the geometric center 140 of the strikeface 104 in a direction from the front end 108 to the back end 110 of the club head 100 and perpendicular to the X' axis 1052 and the Y' axis 1062.

The coordinate system defines an X'Y' plane extending through the X' axis 1052 and the Y' axis 1062, an X'Z' plane extending through the X' axis 1052 and the Z' axis 1072, and a Y'Z' plane extending through the Y' axis 1062 and the Z' axis 1072, wherein the X'Y' plane, the X'Z' plane, and the Y'Z' plane are all perpendicular to one another and intersect at the origin of the coordinate system located at the geometric center 140 of the strikeface 104. The X'Y' plane extends parallel to the hosel axis 132 and is positioned at an angle corresponding to the loft angle of the club head 100 from the loft plane 1010. Further the X' axis 1052 is positioned at a 60 degree angle to the hosel axis 132 when viewed from a direction perpendicular to the X'Y' plane.

In these or other embodiments, the club head 100 can be viewed from a front view (FIG. 1) when the strikeface 104 is viewed from a direction perpendicular to the X'Y' plane. Further, in these or other embodiments, the club head 100 can be viewed from a side view or side cross-sectional view (FIG. 2) when the heel 120 is viewed from a direction perpendicular to the Y'Z' plane.

The club head 100, 300 defines a depth 160, 360, a length 162, 362, and a height 164,364. Referring to FIG. 3, the depth 160, 360 of the club head can be measured as the furthest extent of the club head 100, 300 from the front end 108, 308 to the back end 110, 310, in a direction parallel to the Z' axis 1072.

The length 162 of the club head 100 can be measured as the furthest extent of the club head 100 from the heel 120 to the toe 122, in a direction parallel to the X' axis 1052, when viewed from the front view (FIG. 1). In many embodiments, the length 162 of the club head 100 can be measured according to a golf governing body such as the United States Golf Association (USGA). For example, the length 162 of the club head 100 can be determined in accordance with the USGA's Procedure for Measuring the Club Head Size of Wood Clubs (USGA-TPX3003, Rev. 1.0.0, Nov. 21, 2003) (available at https://www.usga.org/content/dam/usga/pdf/Equipment/TPX3003-procedure-for-measuring-the-club-head-size-of-wood-clubs.pdf) (the "Procedure for Measuring the Club Head Size of Wood Clubs").

The height 164 of the club head 100 can be measured as the furthest extend of the club head 100 from the crown 116 to the sole 118, in a direction parallel to the Y' axis 1062, when viewed from the front view (FIG. 1). In many embodiments, the height 164 of the club head 100 can be measured according to a golf governing body such as the United States Golf Association (USGA). For example, the height 164 of the club head 100 can be determined in accordance with the USGA's Procedure for Measuring the Club Head Size of Wood Clubs (USGA-TPX3003, Rev. 1.0.0, Nov. 21, 2003) (available at https://www.usga.org/content/dam/usga/pdf/Equipment/TPX3003-procedure-for-measuring-the-club-head-size-of-wood-clubs.pdf) (the "Procedure for Measuring the Club Head Size of Wood Clubs").

As shown in FIGS. 1 and 2, the club head 100 further comprises a head center of gravity (CG) 170 and a head depth plane 1040 extending through the geometric center 140 of the strikeface 104, perpendicular to the loft plane 1010, in a direction from the heel 120 to the toe 122 of the club head 100. In many embodiments, the head CG 170 is located at a head CG depth from the X'Y' plane, measured in a direction perpendicular to the X'Y' plane. In some embodiments, the head CG 170 can be located at a head CG depth 172 from the loft plane 1010, measured in a direction perpendicular to the loft plane. The head CG 170 is further located at a head CG height 174 from the head depth plane 1040, measured in a direction perpendicular to the head depth plane 1040. Further, the head CG height 174 is measured as the offset distance from the head depth plane 1040 in a direction perpendicular to the head depth plane 1040 toward the crown 116 or toward the sole 118. In many embodiments, the head CG height 174 is positive when the head CG is located above the head depth plane 1040 (i.e. between the head depth plane 1040 and the crown 116), and the head CG height 174 is negative with the head CG is located below the head depth plane 1040 (i.e. between the head depth plane 1040 and the sole 118). In some embodiments, the absolute value of the head CG height 174 can describe a head CG positioned above or below the head depth plane 1040 (i.e. between the head depth plane 1040 and the crown 116 or between the head depth plane 1040 and the sole 118). In many embodiments, the head CG 170 is strategically positioned toward the sole 118 and back end 110 of the club head 100 based on various club head parameters, such as volume and loft angle, as described below. Further, in many embodiments, the head CG 170 is strategically positioned toward the sole 118 and back end 110 of the club head 100 in combination with reduced aerodynamic drag.

The head CG 170 defines an origin of a coordinate system having an x-axis 1050, a y-axis 1060, and a z-axis 1070. The y-axis 1060 extends through the head CG 170 from the crown 116 to the sole 118, parallel to the hosel axis 132 when viewed from the side view and at a 30 degree angle from the hosel axis 132 when viewed from the front view. The x-axis 1050 extends through the head CG 170 from the heel 120 to the toe 122 and perpendicular to the y-axis 1060 when viewed from a front view and parallel to the X'Y' plane. The z-axis 1070 extends through the head CG 170 from the front end 108 to the back end 110 and perpendicular to the x-axis 1050 and the y-axis. In many embodiments, the x-axis 1050 extends through the head CG 170 from the heel 120 to the toe 122 and parallel to the X' axis 1052, the y-axis 1060 through the head CG 170 from the crown 116 to the sole 118 parallel to the Y' axis 1062, and the z-axis 1070 extends through the head CG 170 from the front end 108 to the back end 110 and parallel to the Z' axis 1072.

The club head 100 further comprises a moment of inertia about the x-axis $I_{xx}$ (i.e. crown-to-sole moment of inertia), and a moment of inertia about the y-axis $I_{yy}$ (i.e. heel-to-toe moment of inertia). In many embodiments, the crown-to-sole moment of inertia $I_{xx}$ and the heel-to-toe moment of inertia $I_{yy}$ are increased or maximized based on various club head parameters, such as volume and loft angle, as described in further detail below. Further, in many embodiments, the crown-to-sole moment of inertia $I_{xx}$ and the heel-to-toe moment of inertia $I_{yy}$ are increased or maximized in combination with reduced aerodynamic drag.

Various embodiments of the club head having varied loft angles and volumes are described below. Other embodiments can include club heads having loft angles or volumes different than the loft angles and volumes described herein.

I. High Volume Driver-Type Club Head

According to one example, a golf club head 300 comprises a high volume and a low loft angle. In many embodiments, the golf club head 300 comprises a driver-type club head. In other embodiments, the golf club head 300 can comprise any type of golf club head having a loft angle and volume as described herein. In many embodiments, club head 300 comprises the same or similar parameters as club head 100, wherein the parameters are described with the club head 100 reference numbers plus 200.

In many embodiments, the loft angle of the club head 300 is less than approximately 16 degrees, less than approximately 15 degrees, less than approximately 14 degrees, less than approximately 13 degrees, less than approximately 12 degrees, less than approximately 11 degrees, or less than approximately 10 degrees. Further, in many embodiments, the volume of the club head 300 is greater than approximately 400 cc, greater than approximately 425 cc, greater than approximately 450 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the club head can be approximately 400 cc-600 cc, 445 cc-485 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

In many embodiments, the length 362 of the club head 300 is greater than 4.85 inches. In other embodiments, the length 362 of the club head 300 is greater than 4.5 inches, greater than 4.6 inches, greater than 4.7 inches, greater than 4.8, greater than 4.9 inches, or greater than 5.0 inches. For example, in some embodiments, the length 362 of the club head 300 can be between 4.6-5.0 inches, between 4.7-5.0 inches, between 4.8-5.0 inches, between 4.85-5.0 inches, or between 4.9-5.0 inches.

In many embodiments, the depth 360 of the club head 300 is at least 0.70 inches less than the length 362 of the club head 300. In many embodiments, the depth 360 of the club head 300 is greater than 4.75 inches. In other embodiments, the depth 360 of the club head 300 is greater than 4.5 inches, greater than 4.6 inches, greater than 4.7 inches, greater than 4.8, greater than 4.9 inches, or greater than 5.0 inches. For example, in some embodiments, the depth 360 of the club head 300 can be between 4.6-5.0 inches, between 4.7-5.0 inches, between 4.75-5.0 inches, between 4.8-5.0 inches, or between 4.9-5.0 inches.

In many embodiments, the height 364 of the club head 300 is less than approximately 2.8 inches. In other embodiments, the height 364 of the club head 300 is less than 3.0 inches, less than 2.9 inches, less than 2.8 inches, less than 2.7, or less than 2.6 inches. For example, in some embodiments, the height 364 of the club head 300 can be between 2.0-2.8 inches, between 2.2-2.8 inches, between 2.5-2.8 inches, or between 2.5-3.0 inches. Further, in many embodiments, the face height 344 of the club head 300 can be approximately 1.3 inches (33 mm) to approximately 2.8 inches (71 mm). Further still, in many embodiments, the club head 300 can comprise a mass between 185 grams and 225 grams.

The club head 300 further comprises a balance of various additional parameters, such as head CG position, club head moment of inertia, and aerodynamic drag, to provide both improved impact performance characteristics (e.g. spin, launch angle, speed, forgiveness) and swing performance characteristics (e.g. aerodynamic drag, ability to square the club head at impact). In many embodiments, the balance of parameters described below provides improved impact performance while maintaining or improving swing performance characteristics. Further, in many embodiments, the balance of parameters described below provides improved swing performance characteristics while maintaining or improving impact performance characteristics.

A. Center of Gravity Position and Moment of Inertia

In many embodiments, a low and back club head CG and increased moment of inertia can be achieved by increasing discretionary weight and repositioning discretionary weight in regions of the club head having maximized distances from the head CG. Increasing discretionary weight can be achieved by thinning the crown and/or using optimized materials, as described above relative to the head CG position. Repositioning discretionary weight to maximize the distance from the head CG can be achieved using removable weights, embedded weights, or a steep crown angle, as described above relative to the head CG position.

In many embodiments, the club head 300 comprises a crown-to-sole moment of inertia $I_{xx}$ greater than approximately 3000 g·cm$^2$, greater than approximately 3250 g·cm$^2$, greater than approximately 3500 g·cm$^2$, greater than approximately 3750 g·cm$^2$, greater than approximately 4000 g·cm$^2$, greater than approximately 4250 g·cm$^2$, greater than approximately 4500 g·cm$^2$, greater than approximately 4750 g·cm$^2$, greater than approximately 5000 g·cm$^2$, greater than approximately 5250 g·cm$^2$, greater than approximately 5500 g·cm$^2$, greater than approximately 5750 g·cm$^2$, greater than approximately 6000 g·cm$^2$, greater than approximately 6250 g·cm$^2$, greater than approximately 6500 g·cm$^2$, greater than approximately 6750 g·cm$^2$, or greater than approximately 7000 g·cm$^2$.

In many embodiments, the club head 300 comprises a heel-to-toe moment of inertia $I_{yy}$ greater than approximately 5000 g·cm$^2$, greater than approximately 5250 g·cm$^2$, greater than approximately 5500 g·cm$^2$, greater than approximately 5750 g·cm$^2$, greater than approximately 6000 g·cm$^2$, greater than approximately 6250 g·cm$^2$, greater than approximately 6500 g·cm$^2$, greater than approximately 6750 g·cm$^2$, or greater than approximately 7000 g·cm$^2$.

In many embodiments, the club head 300 comprises a combined moment of inertia (i.e. the sum of the crown-to-sole moment of inertia $I_{xx}$ and the heel-to-toe moment of inertia $I_{yy}$) greater than 8000 g·cm$^2$, greater than 8500 g·cm$^2$, greater than 8750 g·cm$^2$, greater than 9000 g·cm$^2$, greater than 9250 g·cm$^2$, greater than 9500 g·cm$^2$, greater than 9750 g·cm$^2$, greater than 10000 g·cm$^2$, greater than 10250 g·cm$^2$, greater than 10500 g·cm$^2$, greater than 10750 g·cm$^2$, greater than 11000 g·cm$^2$, greater than 11250 g·cm$^2$, greater than 11500 g·cm$^2$, greater than 11750 g·cm$^2$, or greater than 12000 g·cm$^2$, greater than 12500 g·cm$^2$, greater than 1300 g·cm$^2$, greater than 13500 g·cm$^2$, or greater than 1400 g·cm$^2$.

In many embodiments, the club head 300 comprises a head CG height 374 less than approximately 0.20 inches, less than approximately 0.15 inches, less than approximately 0.10 inches, less than approximately 0.09 inches, less than approximately 0.08 inches, less than approximately 0.07 inches, less than approximately 0.06 inches, or less than approximately 0.05 inches. Further, in many embodiments, the club head 300 comprises a head CG height 374 having an absolute value less than approximately 0.20 inches, less than approximately 0.15 inches, less than approximately 0.10 inches, less than approximately 0.09 inches, less than approximately 0.08 inches, less than approximately 0.07 inches, less than approximately 0.06 inches, or less than approximately 0.05 inches.

In many embodiments, the club head 300 comprises a head CG depth 372 greater than approximately 1.2 inches, greater than approximately 1.3 inches, greater than approximately 1.4 inches, greater than approximately 1.5 inches, greater than approximately 1.6 inches, greater than approximately 1.7 inches, greater than approximately 1.8 inches, greater than approximately 1.9 inches, or greater than approximately 2.0 inches.

In some embodiments, the club head 300 can comprise a first performance characteristic less than or equal to 0.56, wherein the first performance characteristic is defined as a ratio between (a) the difference between 72 mm and the face height 344, and (b) the head CG depth 372. In these or other embodiments, the club head 300 can comprise a second performance characteristic greater than or equal to 425 cc, wherein the second performance characteristic is defined as the sum of (a) the volume of the club head 300, and (b) a ratio between the head CG depth 372 and the absolute value of the head CG height 374. In some embodiments, the second performance characteristic can be greater than or equal to 450 cc, greater than or equal to 475 cc, greater than or equal to 490 cc, greater than or equal to 495 cc, greater than or equal to 500 cc, greater than or equal to 505 cc, or greater than or equal to 510 cc.

The club head 300 having the reduced head CG height 374 can reduce the backspin of a golf ball on impact compared to a similar club head having a higher head CG height. In many embodiments, reduced backspin can increase both ball speed and travel distance for improve club head performance. Further, the club head 300 having the increased head CG depth 372 can increase the heel-to-toe moment of inertia compared to a similar club head having a head CG depth closer to the strikeface. Increasing the heel-to-toe moment of inertia can increase club head forgiveness on impact to improve club head performance. Further still, the club head 300 having the increased head CG depth 172 can increase launch angle of a golf ball on impact by increasing the dynamic loft of the club head at delivery, compared to a similar club head having a head CG depth closer to the strikeface.

The head CG height 374 and/or head CG depth 372 can be achieved by reducing weight of the club head in various regions, thereby increasing discretionary weight, and repositioning discretionary weight in strategic regions of the club head to shift the head CG lower and farther back. Various means to reduce and reposition club head weight are described below.

i. Thin Regions

In some embodiments, the head CG height 374 and/or head CG depth 372 can be achieved by thinning various regions of the club head 300 to remove excess weight. Removing excess weight results in increased discretionary weight that can be strategically repositioned to regions of the club head 300 to achieve the desired low and back club head CG position.

In many embodiments, the club head 300 can have one or more thin regions 376. The one or more thin regions 376 can be positioned on the strikeface 304, the body 302, or a combination of the strikeface 304 and the body 302 (see FIG. 7). Further, the one or more thin regions 376 can be positioned on any region of the body 302, including the crown 316, the sole 318, the heel 320, the toe 322, the front end 308, the back end 310, the skirt 328, or any combination of the described positions. For example, in some embodiments, the one or more thin regions 376 can be positioned on the crown 316. For further example, the one or more thin regions 376 can be positioned on a combination of the strikeface 304 and the crown 306. For further example, the one or more thin regions 376 can be positioned on a combination of the strikeface 304, the crown 316, and the sole 318. For further example, the entire body 302 and/or the entire strikeface 304 can comprise a thin region 376.

In embodiments where one or more thin regions 376 are positioned on the strikeface 304, the thickness of the strikeface 304 can vary defining a maximum strikeface thickness and a minimum strikeface thickness. In these embodiments, the minimum strikeface thickness can be less than 0.10 inches, less than 0.09 inches, less than 0.08 inches, less than 0.07 inches, less than 0.06 inches, less than 0.05 inches, less than 0.04 inches, or less than 0.03 inches. In these or other embodiments, the maximum strikeface thickness can be less than 0.20 inches, less than 0.19 inches, less than 0.18 inches, less than 0.17 inches, less than 0.16 inches, less than 0.15 inches, less than 0.14 inches, less than 0.13 inches, less than 0.12 inches, less than 0.11 inches, or less than 0.10 inches.

In embodiments where one or more thin regions 376 are positioned on the body 302, the thin regions can comprise a thickness less than approximately 0.020 inches. In other embodiments, the thin regions comprise a thickness less than 0.025 inches, less than 0.020 inches, less than 0.019 inches, less than 0.018 inches, less than 0.017 inches, less than 0.016 inches, less than 0.015 inches, less than 0.014 inches, less than 0.013 inches, less than 0.012 inches, or less than 0.010 inches. For example, the thin regions can comprise a thickness between approximately 0.010-0.025 inches, between approximately 0.013-0.020 inches, between approximately 0.014-0.020 inches, between approximately 0.015-0.020 inches, between approximately 0.016-0.020 inches, between approximately 0.017-0.020 inches, or between approximately 0.018-0.020 inches.

In the illustrated embodiment, the thin regions 376 vary in shape and position and cover approximately 25% of the surface area of club head 300. In other embodiments, the thin regions can cover approximately 20-30%, approximately 15-35%, approximately 15-25%, approximately 10-25%, approximately 15-30%, or approximately 20-50% of the surface area of club head 900. Further, in other embodiments, the thin regions can cover up to 5%, up to 10%, up to 15%, up to 20%, up to 25%, up to 30%, up to 35%, up to 40%, up to 45%, or up to 50% of the surface area of club head 300.

In many embodiments, the crown 316 can comprise one or more thin regions 376, such that approximately 51% of the surface area of the crown 316 comprises thin regions 376. In other embodiments, the crown 316 can comprise one or more thin regions 376, such that up to 20%, up to 25%, up to 30%, up to 35%, up to 40%, up to 45%, up to 50%, up to 55%, up to 60%, up to 65%, up to 70%, up to 75%, up to 80%, up to 85%, or up to 90% of the crown 316 comprises thin regions 376. For example, in some embodiments, approximately 40-60% of the crown 316 can comprise thin regions 376. For further example, in other embodiments, approximately 50-100%, approximately 40-80%, approximately 35-65%, approximately 30-70%, or approximately 25-75% of the crown 316 can comprise thin regions 376. In some embodiments, the crown 316 can comprise one or more thin regions 376, wherein each of the one or more thin regions 376 become thinner in a gradient fashion. In this exemplary embodiment, the one or more thin regions 376 of the crown 316 extend in a heel-to-toe direction, and each of the one or more thin regions 376 decrease in thickness in a direction from the strikeface 304 toward the back end 310.

In many embodiments, the sole 318 can comprise one or more thin regions 376, such that approximately 64% of the surface area of the sole 318 comprises thin regions 376. In other embodiments, the sole 318 can comprise one or more thin regions 376, such that up to 20%, up to 25%, up to 30%, up to 35%, up to 40%, up to 45%, up to 50%, up to 55%, up to 60%, up to 65%, up to 70%, up to 75%, up to 80%, up to 85%, or up to 90% of the sole 318 comprises thin regions 376. For example, in some embodiments, approximately 40-60% of the sole 318 can comprise thin regions 376. For further example, in other embodiments, approximately 50-100%, approximately 40-80%, approximately 35-65%, approximately 30-70%, or approximately 25-75% of the sole 318 can comprise thin regions 376.

The thinned regions 376 can comprise any shape, such as circular, triangular, square, rectangular, ovular, or any other polygon or shape with at least one curved surface. Further, one or more thinned regions 376 can comprise the same shape as, or a different shape than the remaining thinned regions.

In many embodiments, club head 100 having thin regions can be manufacturing using centrifugal casting. In these embodiments, centrifugal casting allows the club head 300 to have thinner walls than a club head manufactured using conventional casting. In other embodiments, portions of the club head 300 having thin regions can be manufactured using other suitable methods, such as stamping, forging, or machining. In embodiments where portions of the club head 300 having thin regions are manufactured using stamping, forging, or machining, the portions of the club head 300 can be coupled using epoxy, tape, welding, mechanical fasteners, or other suitable methods.

ii. Optimized Materials

In some embodiments, the strikeface 304 and/or the body 302 can comprise an optimized material having increased specific strength and/or increased specific flexibility. The specific flexibility is measured as a ratio of the yield strength to the elastic modulus of the optimized material. Increasing specific strength and/or specific flexibility can allow portions of the club head to be thinned, while maintaining durability.

In some embodiments, the first material of the strikeface 304 can be an optimized material, as described in U.S. Provisional Patent Appl. No. 62/399,929, entitled "Golf Club Heads with Optimized Material Properties." In these or other embodiments, the first material comprising an optimized titanium alloy can have a specific strength greater than or equal to approximately 900,000 PSI/lb/in$^3$ (224 MPa/g/cm$^3$), greater than or equal to approximately 910,000 PSI/lb/in$^3$ (227 MPa/g/cm$^3$), greater than or equal to approximately 920,000 PSI/lb/in$^3$ (229 MPa/g/cm$^3$), greater than or equal to approximately 930,000 PSI/lb/in$^3$ (232 MPa/g/cm$^3$), greater than or equal to approximately 940,000 PSI/lb/in$^3$ (234 MPa/g/cm$^3$), greater than or equal to approximately 950,000 PSI/lb/in$^3$ (237 MPa/g/cm$^3$), greater than or equal to approximately 960,000 PSI/lb/in$^3$ (239 MPa/g/cm$^3$), greater than or equal to approximately 970,000 PSI/lb/in$^3$ (242 MPa/g/cm$^3$), greater than or equal to approximately 980,000 PSI/lb/in$^3$ (244 MPa/g/cm$^3$), greater than or equal to approximately 990,000 PSI/lb/in$^3$ (247 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), greater than or equal to approximately 1,100,000 PSI/lb/in$^3$ (274 MPa/g/cm$^3$), or greater than or equal to approximately 1,150,000 PSI/lb/in$^3$ (286 MPa/g/cm$^3$).

Further, in these or other embodiments, the first material comprising an optimized titanium alloy can have a specific flexibility greater than or equal to approximately 0.0075, greater than or equal to approximately 0.0080, greater than or equal to approximately 0.0085, greater than or equal to approximately 0.0090, greater than or equal to approximately 0.0091, greater than or equal to approximately 0.0092, greater than or equal to approximately 0.0093, greater than or equal to approximately 0.0094, greater than or equal to approximately 0.0095, greater than or equal to approximately 0.0096, greater than or equal to approximately 0.0097, greater than or equal to approximately 0.0098, greater than or equal to approximately 0.0099, greater than or equal to approximately 0.0100, greater than or equal to approximately 0.0105, greater than or equal to approximately 0.0110, greater than or equal to approximately 0.0115, or greater than or equal to approximately 0.0120.

In these or other embodiments, the first material comprising an optimized steel alloy can have a specific strength greater than or equal to approximately 650,000 PSI/lb/in$^3$ (162 MPa/g/cm$^3$), greater than or equal to approximately 700,000 PSI/lb/in$^3$ (174 MPa/g/cm$^3$), greater than or equal to approximately 750,000 PSI/lb/in$^3$ (187 MPa/g/cm$^3$), greater than or equal to approximately 800,000 PSI/lb/in$^3$ (199 MPa/g/cm$^3$), greater than or equal to approximately 810,000 PSI/lb/in$^3$ (202 MPa/g/cm$^3$), greater than or equal to approximately 820,000 PSI/lb/in$^3$ (204 MPa/g/cm$^3$), greater than or equal to approximately 830,000 PSI/lb/in$^3$ (207

MPa/g/cm$^3$), greater than or equal to approximately 840,000 PSI/lb/in$^3$ (209 MPa/g/cm$^3$), greater than or equal to approximately 850,000 PSI/lb/in$^3$ (212 MPa/g/cm$^3$), greater than or equal to approximately 900,000 PSI/lb/in$^3$ (224 MPa/g/cm$^3$), greater than or equal to approximately 950,000 PSI/lb/in$^3$ (237 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), greater than or equal to approximately 1,100,000 PSI/lb/in$^3$ (274 MPa/g/cm$^3$), greater than or equal to approximately 1,115,000 PSI/lb/in$^3$ (278 MPa/g/cm$^3$), or greater than or equal to approximately 1,120,000 PSI/lb/in$^3$ (279 MPa/g/cm$^3$).

Further, in these or other embodiments, the first material comprising an optimized steel alloy can have a specific flexibility greater than or equal to approximately 0.0060, greater than or equal to approximately 0.0065, greater than or equal to approximately 0.0070, greater than or equal to approximately 0.0075, greater than or equal to approximately 0.0080, greater than or equal to approximately 0.0085, greater than or equal to approximately 0.0090, greater than or equal to approximately 0.0095, greater than or equal to approximately 0.0100, greater than or equal to approximately 0.0105, greater than or equal to approximately 0.0110, greater than or equal to approximately 0.0115, greater than or equal to approximately 0.0120, greater than or equal to approximately 0.0125, greater than or equal to approximately 0.0130, greater than or equal to approximately 0.0135, greater than or equal to approximately 0.0140, greater than or equal to approximately 0.0145, or greater than or equal to approximately 0.0150.

In these embodiments, the increased specific strength and/or increased specific flexibility of the optimized first material allow the strikeface 304, or portions thereof, to be thinned, as described above, while maintaining durability. Thinning of the strikeface 304 can reduce the weight of the strikeface, thereby increasing discretionary weight to be strategically positioned in other areas of the club head 300 to position the head CG low and back and/or increase the club head moment of inertia.

In some embodiments, the second material of the body 302 can be an optimized material, as described in U.S. Provisional Patent Appl. No. 62/399,929, entitled "Golf Club Heads with Optimized Material Properties." In these or other embodiments, the second material comprising an optimized titanium alloy can have a specific strength greater than or equal to approximately 730,500 PSI/lb/in$^3$ (182 MPa/g/cm$^3$). For example, the specific strength of the optimized titanium alloy can be greater than or equal to approximately 650,000 PSI/lb/in$^3$ (162 MPa/g/cm$^3$), greater than or equal to approximately 700,000 PSI/lb/in$^3$ (174 MPa/g/cm$^3$), greater than or equal to approximately 750,000 PSI/lb/in$^3$ (187 MPa/g/cm$^3$), greater than or equal to approximately 800,000 PSI/lb/in$^3$ (199 MPa/g/cm$^3$), greater than or equal to approximately 850,000 PSI/lb/in$^3$ (212 MPa/g/cm$^3$), greater than or equal to approximately 900,000 PSI/lb/in$^3$ (224 MPa/g/cm$^3$), greater than or equal to approximately 950,000 PSI/lb/in$^3$ (237 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), or greater than or equal to approximately 1,100,000 PSI/lb/in$^3$ (272 MPa/g/cm$^3$).

Further, in these or other embodiments, the second material comprising an optimized titanium alloy can have a specific flexibility greater than or equal to approximately 0.0060, greater than or equal to approximately 0.0065, greater than or equal to approximately 0.0070, greater than or equal to approximately 0.0075, greater than or equal to approximately 0.0080, greater than or equal to approximately 0.0085, greater than or equal to approximately 0.0090, greater than or equal to approximately 0.0095, greater than or equal to approximately 0.0100, greater than or equal to approximately 0.0105, greater than or equal to approximately 0.0110, greater than or equal to approximately 0.0115, or greater than or equal to approximately 0.0120.

In these or other embodiments, the second material comprising an optimized steel can have a specific strength greater than or equal to approximately 500,000 PSI/lb/in$^3$ (125 MPa/g/cm$^3$), greater than or equal to approximately 510,000 PSI/lb/in$^3$ (127 MPa/g/cm$^3$), greater than or equal to approximately 520,000 PSI/lb/in$^3$ (130 MPa/g/cm$^3$), greater than or equal to approximately 530,000 PSI/lb/in$^3$ (132 MPa/g/cm$^3$), greater than or equal to approximately 540,000 PSI/lb/in$^3$ (135 MPa/g/cm$^3$), greater than or equal to approximately 550,000 PSI/lb/in$^3$ (137 MPa/g/cm$^3$), greater than or equal to approximately 560,000 PSI/lb/in$^3$ (139 MPa/g/cm$^3$), greater than or equal to approximately 570,000 PSI/lb/in$^3$ (142 MPa/g/cm$^3$), greater than or equal to approximately 580,000 PSI/lb/in$^3$ (144 MPa/g/cm$^3$), greater than or equal to approximately 590,000 PSI/lb/in$^3$ (147 MPa/g/cm$^3$), greater than or equal to approximately 600,000 PSI/lb/in$^3$ (149 MPa/g/cm$^3$), greater than or equal to approximately 625,000 PSI/lb/in$^3$ (156 MPa/g/cm$^3$), greater than or equal to approximately 675,000 PSI/lb/in$^3$ (168 MPa/g/cm$^3$), greater than or equal to approximately 725,000 PSI/lb/in$^3$ (181 MPa/g/cm$^3$), greater than or equal to approximately 775,000 PSI/lb/in$^3$ (193 MPa/g/cm$^3$), greater than or equal to approximately 825,000 PSI/lb/in$^3$ (205 MPa/g/cm$^3$), greater than or equal to approximately 875,000 PSI/lb/in$^3$ (218 MPa/g/cm$^3$), greater than or equal to approximately 925,000 PSI/lb/in$^3$ (230 MPa/g/cm$^3$), greater than or equal to approximately 975,000 PSI/lb/in$^3$ (243 MPa/g/cm$^3$), greater than or equal to approximately 1,025,000 PSI/lb/in$^3$ (255 MPa/g/cm$^3$), greater than or equal to approximately 1,075,000 PSI/lb/in$^3$ (268 MPa/g/cm$^3$), or greater than or equal to approximately 1,125,000 PSI/lb/in$^3$ (280 MPa/g/cm$^3$).

Further, in these or other embodiments, the second material comprising an optimized steel can have a specific flexibility greater than or equal to approximately 0.0060, greater than or equal to approximately 0.0062, greater than or equal to approximately 0.0064, greater than or equal to approximately 0.0066, greater than or equal to approximately 0.0068, greater than or equal to approximately 0.0070, greater than or equal to approximately 0.0072, greater than or equal to approximately 0.0076, greater than or equal to approximately 0.0080, greater than or equal to approximately 0.0084, greater than or equal to approximately 0.0088, greater than or equal to approximately 0.0092, greater than or equal to approximately 0.0096, greater than or equal to approximately 0.0100, greater than or equal to approximately 0.0105, greater than or equal to approximately 0.0110, greater than or equal to approximately 0.0115, greater than or equal to approximately 0.0120, greater than or equal to approximately 0.0125, greater than or equal to approximately 0.0130, greater than or equal to approximately 0.0135, greater than or equal to approximately 0.0140, greater than or equal to approximately 0.0145, or greater than or equal to approximately 0.0150.

In these embodiments, the increased specific strength and/or increased specific flexibility of the optimized second material allow the body 302, or portions thereof, to be thinned, while maintaining durability. Thinning of the body can reduce club head weight, thereby increasing discretionary weight to be strategically positioned in other areas of the club head 300 to position the head CG low and back and/or increase the club head moment of inertia.

iii. Removable Weights

In some embodiments, the club head 300 can include one or more weight structures 380 comprising one or more removable weights 382. The one or more weight structures 380 and/or the one or more removable weights 382 can be located towards the sole 318 and towards the back end 310, thereby positioning the discretionary weight on the sole 318 and near the back end 310 of the club head 300 to achieve a low and back head CG position. In many embodiments, the one or more weight structures 380 removably receive the one or more removable weights 382. In these embodiments, the one or more removable weights 382 can be coupled to the one or more weight structures 380 using any suitable method, such as a threaded fastener, an adhesive, a magnet, a snap fit, or any other mechanism capable of securing the one or more removable weights to the one or more weight structures.

The weight structure 380 and/or removable weight 382 can be located relative to a clock grid 2000, which can be aligned with respect to the strikeface 304 when viewed from a top or bottom view (FIG. 3). The clock grid comprises at least a 12 o'clock ray, a 3 o'clock ray, a 4 o'clock ray, a 5 o'clock ray, a 6 o'clock ray, a 7 o'clock ray, a 8 o'clock ray, and a 9 o'clock ray. For example, the clock grid 2000 comprises a 12 o'clock ray 2012, which is aligned with the geometric center 340 of the strikeface 304. The 12 o'clock ray 2012 is orthogonal to the X'Y' plane. Clock grid 2000 can be centered along 12 o'clock ray 2012, at a midpoint between the front end 308 and back end 310 of the club head 300. In the same or other examples, a clock grid centerpoint 2010 can be centered proximate to a geometric centerpoint of golf club head 300 when viewed from a bottom view (FIG. 3). The clock grid 2000 also comprises a 3 o'clock ray 2003 extending towards the heel 320, and a 9 o'clock ray 2009 extending towards the toe 322 of the club head 300.

A weight perimeter 384 of the weight structure 380 is located in the present embodiment towards the back end 310, at least partially bounded between a 4 o'clock ray 2004 and 8 o'clock ray 2008 of clock grid 2000, while a weight center 386 of a removable weight 382 positioned within the weight structure 380 is located between a 5 o'clock ray 2005 and a 7 o'clock ray 2007. In examples such as the present one, the weight perimeter 384 is fully bounded between the 4 o'clock ray 2004 and the 8 o'clock ray 2008. Although the weight perimeter 384 is defined external to the club head 300 in the present example, there can be other examples where the weight perimeter 384 may extend into an interior of, or be defined within, the club head 300. In some examples, the location of the weight structure 380 can be established with respect to a broader area. For instance, in such examples, the weight perimeter 384 of the weight structure 380 can be located towards the back end 310, at least partially bounded between the 4 o'clock ray 2004 and 9 o'clock ray 2009 of the clock grid 2000, while the weight center 386 can be located between the 5 o'clock ray 2005 and 8 o'clock ray 2008.

In the present example, the weight structure 380 protrudes from the external contour of the sole 318, and is thus at least partially external to allow for greater adjustment of the head CG 370. In some examples, the weight structure 380 can comprise a mass of approximately 2 grams to approximately 50 grams, and/or a volume of approximately 1 cc to approximately 30 cc. In other examples, the weight structure 380 can remain flush with the external contour of the body 302.

In many embodiments, the removable weight 382 can comprise a mass of approximately 0.5 grams to approximately 30 grams, and can be replaced with one or more other similar removable weights to adjust the location of the head CG 370. In the same or other examples, the weight center 386 can comprise at least one of a center of gravity of the removable weight 382, and/or a geometric center of removable weight 382.

iv. Embedded Weights

In some embodiments, the club head 300 can include one or more embedded weights 383 to position the discretionary weight on the sole 318, in the skirt 328, and/or near the back end 310 of the club head 300 to achieve a low and back head CG position. In many embodiments, the one or more embedded weights 383 are permanently fixed to or within the club head 300. In these embodiments, the embedded weight 383 can be similar to the high density metal piece (HDMP) described in U.S. Provisional Patent Appl. No. 62/372,870, entitled "Embedded High Density Casting."

In many embodiments, the one or more embedded weights 383 are positioned near the back end 310 of the club head 300. For example, a weight center 387 of the embedded weight 383 can be located between the 5 o'clock ray 2005 and 7 o'clock ray 2007, or between the 5 o'clock ray 2005 and 8 o'clock ray 2008 of the clock grid 2000. In many embodiments, the one or more embedded weights 383 can be positioned on the skirt 328 and near the back end 310 of the club head 300, on the sole 318 and near the back end 310 of the club head 300, or on the skirt 328 and the sole 318 near the back end 310 of the club head 300.

In many embodiments, the weight center 387 of the one or more embedded weights 383 is positioned within 0.10 inches, within 0.20 inches, within 0.30 inches, within 0.40 inches, within 0.50 inches, within 0.60 inches, within 0.70 inches, within 0.80 inches, within 0.90 inches, within 1.0 inches, within 1.1 inches, within 1.2 inches, within 1.3 inches, within 1.4 inches, or within 1.5 inches of a perimeter of the club head 300 when viewed from a top or bottom view (FIG. 3). In these embodiments, the proximity of the embedded weight 383 to the perimeter of the club head 300 can maximize the low and back head CG position, the crown-to-sole moment of inertia $I_{xx}$, and/or the heel-to-toe moment of inertia $I_{yy}$.

In many embodiments, the weight center 387 of the one or more embedded weights 383 is positioned at a distance from the head CG 370 greater than 1.6 inches, greater than 1.7 inches, greater than 1.8 inches, greater than 1.9 inches, greater than 2.0 inches, greater than 2.1 inches, greater than 2.2 inches, greater than 2.3 inches, greater than 2.4 inches, greater than 2.5 inches, greater than 2.6 inches, greater than 2.7 inches, greater than 2.8 inches, greater than 2.9 inches, or greater than 3.0 inches.

In many embodiments, the weight center 387 of the one or more embedded weights 383 is positioned at a distance from the geometric center 340 of the strikeface 304 greater than 4.0 inches, greater than 4.1 inches, greater than 4.2 inches, greater than 4.3 inches, greater than 4.4 inches, greater than 4.5 inches, greater than 4.6 inches, greater than 4.7 inches, greater than 4.8 inches, greater than 4.9 inches, or greater than 5.0 inches.

In many embodiments, the one or more embedded weights 383 can comprise a mass between 3.0-50 grams. For example, in some embodiments, the one or more embedded weights 383 can comprise a mass between 3.0-25 grams, between 10-30 grams, between 20-40 grams, or between 30-50 grams. In embodiments where the one or more embedded weights 383 include more than one weight, each of the embedded weights can comprise the same or a different mass.

In many embodiments, the one or more embedded weights 383 can comprise a material having a specific gravity between 10.0-22.0. For example, in many embodiments, the one or more embedded weights 383 can comprise a material having a specific gravity greater than 10.0, greater than 11.0, greater than 12.0, greater than 13.0, greater than 14.0, greater than 15.0, greater than 16.0, greater than 17.0, greater than 18.0, or greater than 19.0. In embodiments where the one or more embedded weights 383 include more than one weight, each of the embedded weights can comprise the same or a different material.

v. Steep Crown Angle

Figure 4:
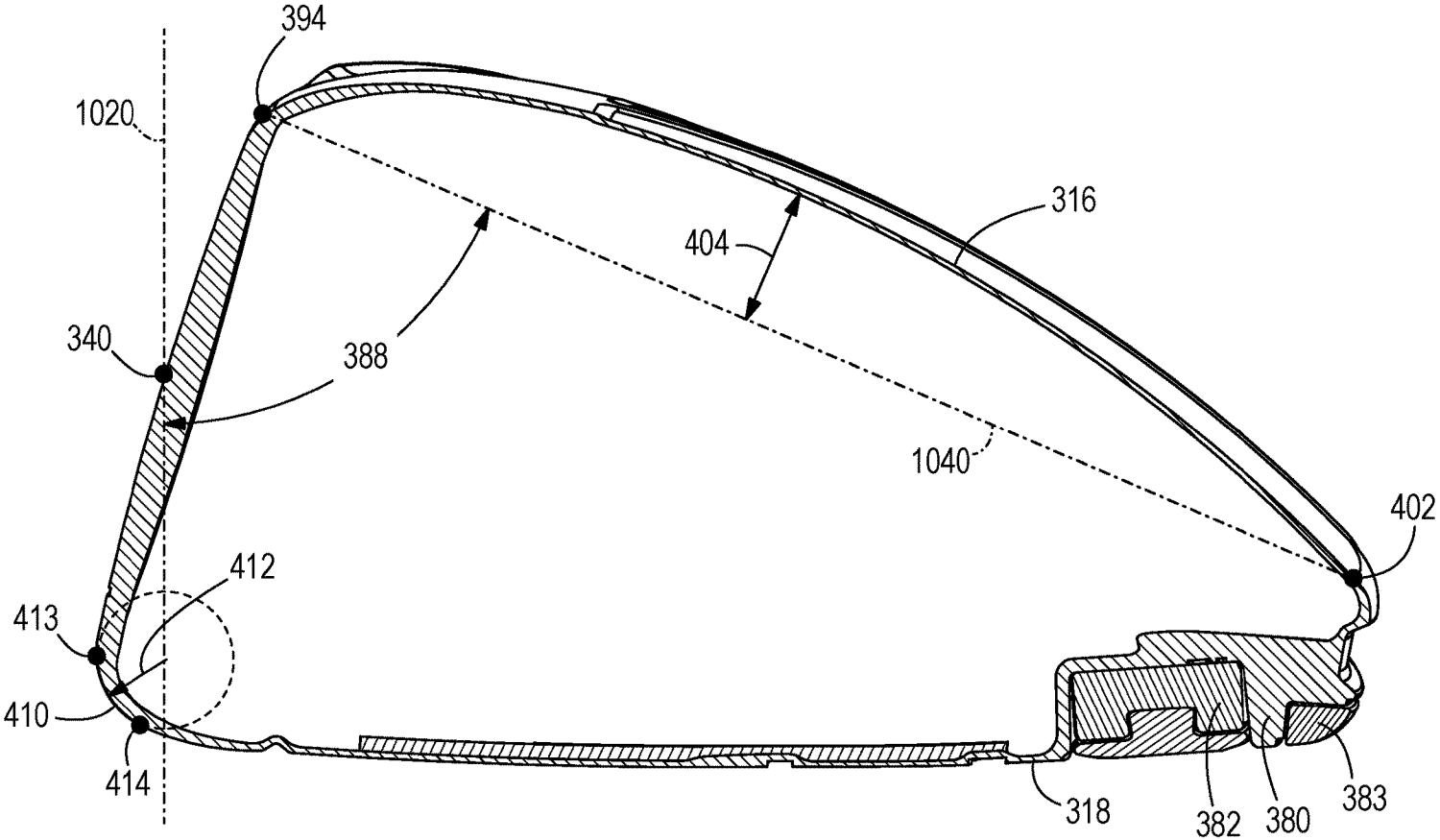
FIG. 4 is a side cross sectional view of the golf club head in FIG. 1.
Figure 5:
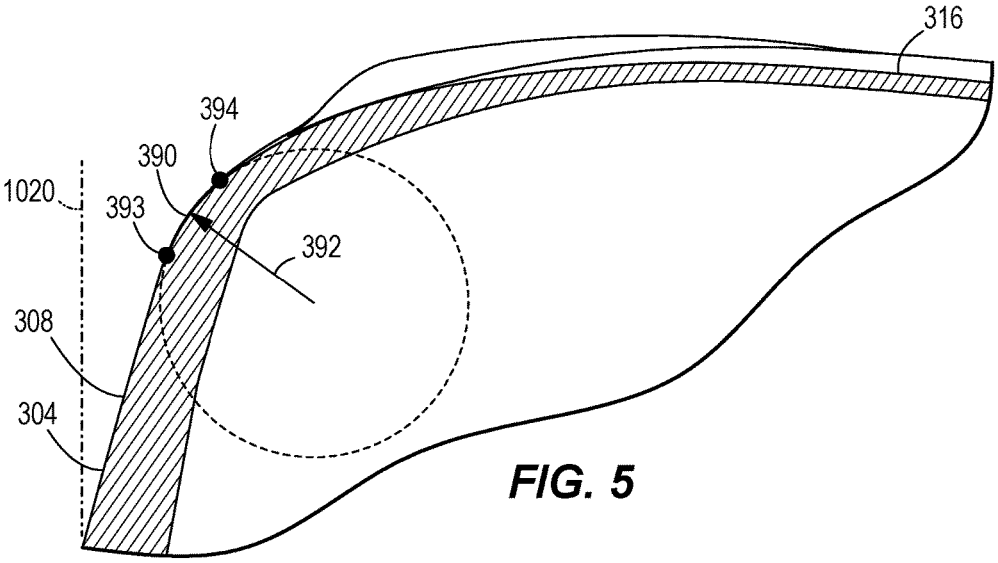
FIG. 5 is an enlarged side cross sectional view of the golf club head in FIG. 1.
Figure 6:
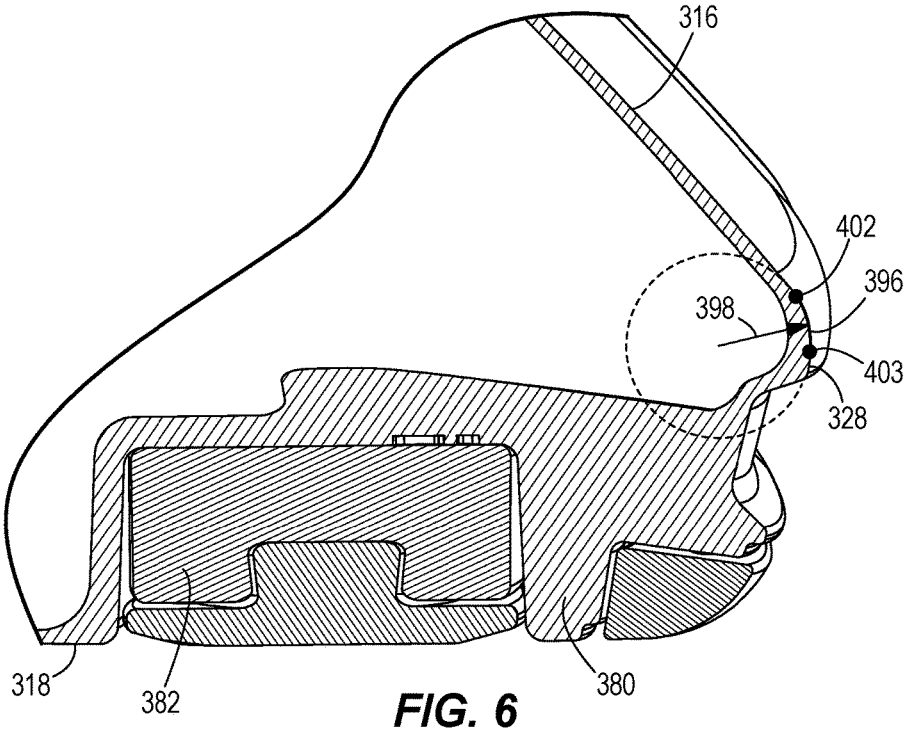
FIG. 6 is an enlarged side cross sectional view of the golf club head in FIG. 1.

Referring to FIGS. 4-6, in some embodiments, the golf club head 300 can further include a steep crown angle 388 to achieve the low and back head CG position. The steep crown angle 388 positions the back end of the crown 316 toward the sole 318 or ground, thereby lowering the club head CG position.

The crown angle 388 is measured as the acute angle between a crown axis 1090 and the front plane 1020. In these embodiments, the crown axis 1090 is located in a cross-section of the club head taken along a plane positioned perpendicular to the ground plane 1030 and the front plane 1020. The crown axis 1090 can be further described with reference to a top transition boundary and a rear transition boundary.

The club head 300 includes a top transition boundary extending between the front end 308 and the crown 316 from near the heel 320 to near the toe 322. The top transition boundary includes a crown transition profile 390 when viewed from a side cross sectional view taken along a plane perpendicular to the front plane 1020 and perpendicular to the ground plane 1030 when the club head 300 is at an address position. The side cross sectional view can be taken along any point of the club head 300 from near the heel 320 to near the toe 322. The crown transition profile 390 defines a front radius of curvature 392 extending from the front end 308 of the club head 300 where the contour departs from the roll radius and/or the bulge radius of the strikeface 304 to a crown transition point 394 indicating a change in curvature from the front radius of curvature 392 to the curvature of the crown 316. In some embodiments, the front radius of curvature 392 comprises a single radius of curvature extending from the top end 393 of the strikeface perimeter 342 near the crown 316 where the contour departs from the roll radius and/or the bulge radius of the strikeface 304 to a crown transition point 394 indicating a change in curvature from the front radius of curvature 392 to one or more different curvatures of the crown 316.

The club head 300 further includes a rear transition boundary extending between the crown 316 and the skirt 328 from near the heel 320 to near the toe 322. The rear transition boundary includes a rear transition profile 396 when viewed from a side cross sectional view taken along a plane perpendicular to the front plane 1020 and perpendicular to the ground plane 1030 when the club head 300 is at an address position. The cross sectional view can be taken along any point of the club head 300 from near the heel 320 to near the toe 322. The rear transition profile 396 defines a rear radius of curvature 398 extending from the crown 316 to the skirt 328 of the club head 300. In many embodiments, the rear radius of curvature 398 comprises a single radius of curvature that transitions the crown 316 to the skirt 328 of the club head 300 along the rear transition boundary. A first rear transition point 402 is located at the junction between the crown 316 and the rear transition boundary. A second rear transition point 403 is located at the junction between the rear transition boundary and the skirt 328 of the club head 300.

The front radius of curvature 392 of the top transition boundary can remain constant, or can vary from near the heel 320 to near the toe 322 of the club head 300. Similarly, the rear radius of curvature 398 of the rear transition boundary can remain constant, or can vary from near the heel 320 to near the toe 322 of the club head 300.

The crown axis 1090 extends between the crown transition point 394 near the front end 308 of the club head 300 and the rear transition point 402 near the back end 310 of the club head 300. The crown angle 388 can remain constant, or can vary from near the heel 320 to near the toe 322 of the club head 300. For example, the crown angle 388 can vary when the side cross sectional view is taken at different locations relative to the heel 320 and the toe 322.

In the illustrated embodiment, the crown angle 388 near the toe 322 is approximately 72.25 degrees, the crown angle 388 near the heel 320 is approximately 64.5 degrees, and the crown angle 388 near the center of the golf club head is approximately 64.2 degrees. In many embodiments, the maximum crown angle 388 taken at any location from near the toe 322 to near the heel 320 is less than 79 degrees, less than approximately 78 degrees, less than approximately 77 degrees, less than approximately 76 degrees, less than approximately 75 degrees, less than approximately 74 degrees, less than approximately 73 degrees, less than approximately 72 degrees, less than approximately 71 degrees, less than approximately 70 degrees, less than approximately 69 degrees, or less than approximately 68 degrees. For example, in some embodiments, the maximum crown angle is between 50 degrees and 79 degrees, between 60 degrees and 79 degrees, or between 70 degrees and 79 degrees.

In other embodiments, the crown 388 angle near the toe 322 of the club head 300 can be less than approximately 79 degrees, less than approximately 78 degrees, less than approximately 77 degrees, less than approximately 76 degrees, less than approximately 75 degrees, less than approximately 74 degrees, less than approximately 73 degrees, less than approximately 72 degrees, less than approximately 71 degrees, less than approximately 70 degrees, less than approximately 69 degrees, or less than approximately 68 degrees. For example, the crown angle 388 taken along a side cross sectional view positioned approximately 1.0 inch toward the toe 322 from the geometric center 340 of the strikeface 304 can be less than 79 degrees, less than 78 degrees, less than 77 degrees, less than 76 degrees, less than 75 degrees, less than 74 degrees, less than 73 degrees, less than 72 degrees, less than 71 degrees, less than 70 degrees, less than 69 degrees, or less than 68 degrees.

Further, in other embodiments, the crown angle 388 near the heel 320 can be less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees. For example, the crown angle 388 taken along a side cross sectional view positioned approximately 1.0 inch toward the heel 320 from the geometric center 340 of the strikeface 304 can be less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees.

Further still, in other embodiments, the crown angle 388 near the center of the club head 300 can be less than 75 degrees, less than 74 degrees, less than 73 degrees, less than 72 degrees, less than 71 degrees, less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees. For example, the crown angle 388 taken along a side cross sectional view positioned approximately at the geometric center 340 of the strikeface 304 can be less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees.

In many embodiments, reducing the crown angle 388 compared to current club heads generates a steeper crown or a crown positioned closer to the ground plane 1030 when the club head 300 is at an address position. Accordingly, the reduced crown angle 388 can result in a lower head CG position compared to a club head with a higher crown angle.

vi. Hosel Sleeve Weight

In some embodiments, the head CG height 174 and/or head CG depth 172 can be achieved by reducing the mass of the hosel sleeve 334. Removing excess weight from the hosel sleeve 334 results in increased discretionary weight that can be strategically repositioned to regions of the club head 300 to achieve the desired low and back club head CG position.

Reducing the mass of the hosel sleeve 334 can be achieved by thinning the sleeve walls, reducing the height of the hosel sleeve 334, reducing the diameter of the hosel sleeve 334, and/or by introducing voids in the walls of the hosel sleeve 334. In many embodiments, the mass of the hosel sleeve 334 can be less than 6 grams, less than 5.5 grams, less than 5.0 grams, less than 4.5 grams, or less than 4.0 grams. In many embodiments, the club head 300 having the reduced mass hosel sleeve can result in a lower (close to the sole) and farther back (closer to the back end) club head CG position than a similar club head with a heavier hosel sleeve.

B. Aerodynamic Drag

In many embodiments, the club head 300 comprises a low and back club head CG position and an increased club head moment of inertia, in combination with reduced aerodynamic drag.

In many embodiments, the club head 300 experiences an aerodynamic drag force less than approximately 1.5 lbf, less than 1.4 lbf, less than 1.3 lbf, or less than 1.2 lbf when tested in a wind tunnel with a squared face and an air speed of 102 miles per hour (mph). In these or other embodiments, the club head 300 experiences an aerodynamic drag force less than approximately 1.5 lbf, less than 1.4 lbf, less than 1.3 lbf, or less than 1.2 lbf when simulated using computational fluid dynamics with a squared face and an air speed of 102 miles per hour (mph). In these embodiments, the airflow experienced by the club head 300 having the squared face is directed at the strikeface 304 in a direction perpendicular to the X'Y' plane. The club head 300 having reduced aerodynamic drag can be achieved using various means, as described below.

i. Crown Angle Height

In some embodiments, reducing the crown angle 388 to form a steeper crown and lower head CG position may result in an undesired increase in aerodynamic drag due to increased air flow separation over the crown during a swing. To prevent increased drag associated with a reduced crown angle 388, a maximum crown height 404 can be increased. Referring to FIG. 4, the maximum crown height 404 is the greatest distance between the surface of the crown 316 and the crown axis 1090 taken at any side cross sectional view of the club head 300 along a plane positioned parallel to the Y'Z' plane. In many embodiments, a greater maximum crown height 404 results in the crown 316 having a greater curvature. A greater curvature in the crown 316 moves the location of the air flow separation during a swing further back on the club head 300. In other words, a greater curvature allows the airflow to stay attached to club head 300 for a longer distance along the crown 316 during a swing. Moving the airflow separation point back on the crown 316 can result in reduced aerodynamic drag and increased club head swing speeds, thereby resulting in increased ball speed and distance.

In many embodiments, the maximum crown height 404 can be greater than approximately 0.20 inch (5 mm), greater than approximately 0.30 inch (7.5 mm), greater than approximately 0.40 inch (10 mm), greater than approximately 0.50 inch (12.5 mm), greater than approximately 0.60 inch (15 mm), greater than approximately 0.70 inch (17.5 mm), greater than approximately 0.80 inch (20 mm), greater than approximately 0.90 inch (22.5 mm), or greater than approximately 1.0 inch (25 mm). Further, in other embodiments, the maximum crown height can be within the range of 0.20 inch (5 mm) to 0.60 inch (15 mm), or 0.40 inch (10 mm) to 0.80 inch (20 mm), or 0.60 inch (15 mm) to 1.0 inch (25 mm). For example, in some embodiments, the maximum crown height 404 can be approximately 0.52 inch (13.3 mm), approximately 0.54 inch (13.8 mm), approximately 0.59 inch (15 mm), approximately 0.65 inch (16.5 mm), or approximately 0.79 inch (20 mm).

ii. Transition Profiles

In many embodiments, the transition profiles of the club head 300 from the strikeface 304 to the crown 316, the strikeface 304 to the sole 318, and/or the crown 316 to the sole 318 along the back end 310 of the club head 300 can affect the aerodynamic drag on the club head 300 during a swing.

In some embodiments, the club head 300 having the top transition boundary defining the crown transition profile 390, and the rear transition boundary defining the rear transition profile 396 further includes a sole transition boundary defining a sole transition profile 410. The sole transition boundary extends between the front end 308 and the sole 318 from near the heel 320 to near the toe 322. The sole transition boundary includes a sole transition profile 410 when viewed from a side cross sectional view taken along a plane parallel to the Y'Z' plane. The side cross sectional view can be taken along any point of the club head 300 from near the heel 320 to near the toe 322. The sole transition profile 410 defines a sole radius of curvature 412 extending from the front end 308 of the club head 300 where the contour departs from the roll radius and/or the bulge radius of the strikeface 304 to a sole transition point 414 indicating a change in curvature from sole radius of curvature 412 to the curvature of the sole 318. In some embodiments, the sole radius of curvature 412 comprises a single radius of curvature extending from the bottom end 413 of the strikeface perimeter 342 near the sole 318 where the contour departs from the roll radius and/or the bulge radius of the strikeface 304 to a sole transition point 414 indicating a change in curvature from the sole radius of curvature 412 to a curvature of the sole 414.

In many embodiments, the crown transition profile 390, the sole transition profile 410, and the rear transition profile 396 can be similar to the crown transition, sole transition, and rear transition profiles described in U.S. patent Ser. No. 15/233,486, entitled "Golf Club Head with Transition Profiles to Reduce Aerodynamic Drag." Further, the front radius of curvature 392 can be similar to the first crown radius of curvature, the sole radius of curvature 412 can be similar to the first sole radius of curvature, and the rear radius of curvature 398 can be similar to the rear radius of curvature described U.S. patent Ser. No. 15/233,486, entitled "Golf Club Head with Transition Profiles to Reduce Aerodynamic Drag."

In some embodiments, front radius of curvature 392 can range from approximately 0.18 to 0.30 inches (0.46 to 0.76 cm). Further, in other embodiments, the front radius of curvature 392 can be less than 0.40 inches (1.02 cm), less than 0.375 inches (0.95 cm), less than 0.35 inches (0.89 cm), less than 0.325 inches (0.83 cm), or less than 0.30 inches 0.76 cm). For example, the front radius of curvature 392 may be approximately 0.18 inches (0.46 cm), 0.20 inches (0.51 cm), 0.22 inches (0.66 cm), 0.24 inches (0.61 cm), 0.26 inches (0.66 cm), 0.28 inches (0.71 cm), or 0.30 inches (0.76 cm).

In some embodiments, the sole radius of curvature 412 can range from approximately 0.25 to 0.50 inches (0.76 to 1.27 cm). For example, the sole radius of curvature 412 can be less than approximately 0.5 inches (1.27 cm), less than approximately 0.475 inches (1.21 cm), less than approximately 0.45 inches (1.14 cm), less than approximately 0.425 inches (1.08 cm), or less than approximately 0.40 inches (1.02 cm). For further example, the sole radius of curvature 412 can be approximately 0.30 inches (0.76 cm), 0.35 inches (0.89 cm), 0.40 inches (1.02 cm), 0.45 inches (1.14 cm), or 0.50 inches (1.27 cm).

In some embodiments, the rear radius of curvature 398 can range from approximately 0.10 to 0.25 inches (0.25 to 0.64 cm). For example, the rear radius of curvature 398 can be less than approximately 0.3 inches (0.76 cm), less than approximately 0.275 inches (0.70 cm), less than approximately 0.25 inches (0.64 cm), less than approximately 0.225 inches (0.57 cm), or less than approximately 0.20 inches (0.51 cm). For further example, the rear radius of curvature 398 can be approximately 0.10 inches (0.25 cm), 0.15 inches (0.38 cm), 0.20 inches (0.51 cm), or 0.25 inches (0.64 cm).

iii. Turbulators

Figure 7:
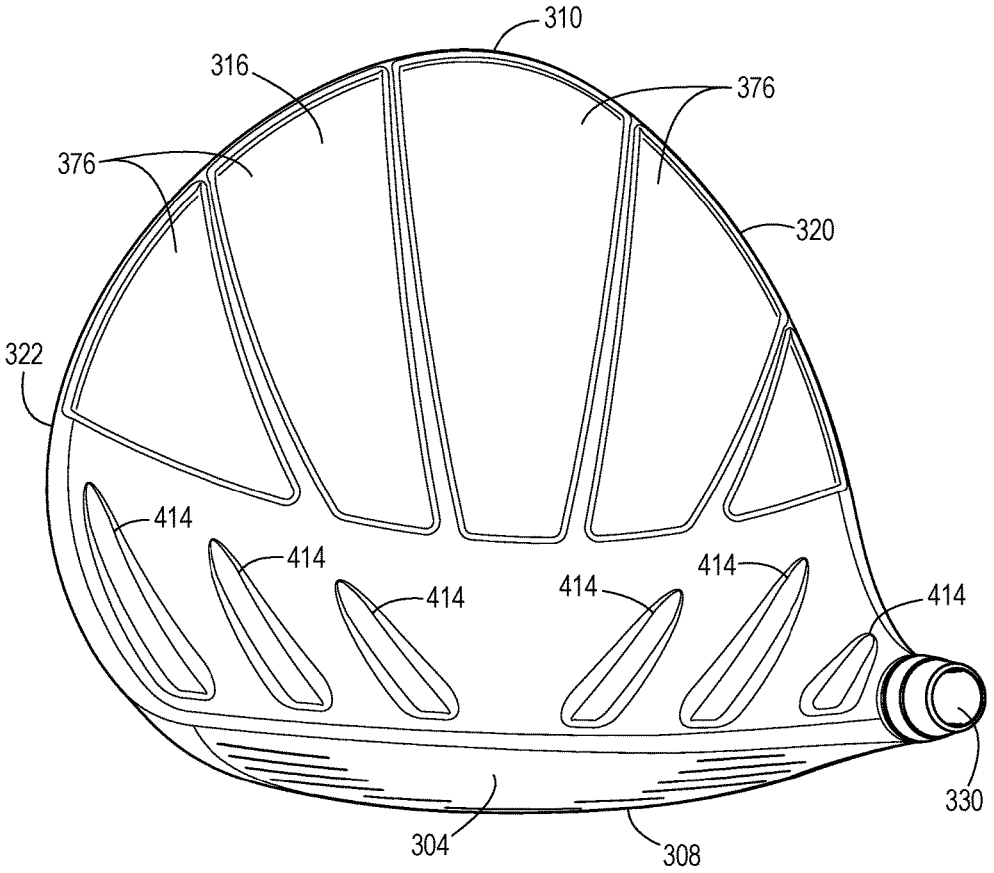
FIG. 7 is a top view of the golf club head in FIG. 1.

Referring to FIG. 7, in some embodiments, the club head 300 can further include a plurality of turbulators 414, as described in U.S. patent application Ser. No. 13/536,753, now U.S. Pat. No. 8,608,587, granted on Dec. 17, 2013, entitled "Golf Club Heads with Turbulators and Methods to Manufacture Golf Club Heads with Turbulators," Which is incorporated fully herein by reference. In many embodiments, the plurality of turbulators 414 disrupt the airflow thereby creating small vortices or turbulence inside the boundary layer to energize the boundary layer and delay separation of the airflow on the crown 316 during a swing.

In some embodiments, the plurality of turbulators 414 can be adjacent to the crown transition point 594 of the club head 300. The plurality of turbulators 414 project from an outer surface of the crown 316 and include a length extending between the front end 308 and the back end 310 of the club head 300, and a width extending from the heel 320 to the toe 322 of the club head 300. In many embodiments, the length of the plurality of turbulators 414 is greater than the width. In some embodiments, the plurality of turbulators 414 can comprise the same width. In some embodiments, the plurality of turbulators 414 can vary in height profile. In some embodiments, the plurality of turbulators 414 can be higher toward the apex of the crown 316 than in comparison to the front of the crown 316. In other embodiments, the plurality of turbulators 414 can be higher toward the front of the crown 316, and lower in height toward the apex of the crown 316. In other embodiments, the plurality of turbulators 414 can comprise a constant height profile. Further, in many embodiments, at least a portion of at least one turbulator is located between the strikeface 304 and an apex of the crown 316, and the spacing between adjacent turbulators is greater than the width of each of the adjacent turbulators.

iv. Back Cavity

Figure 8:
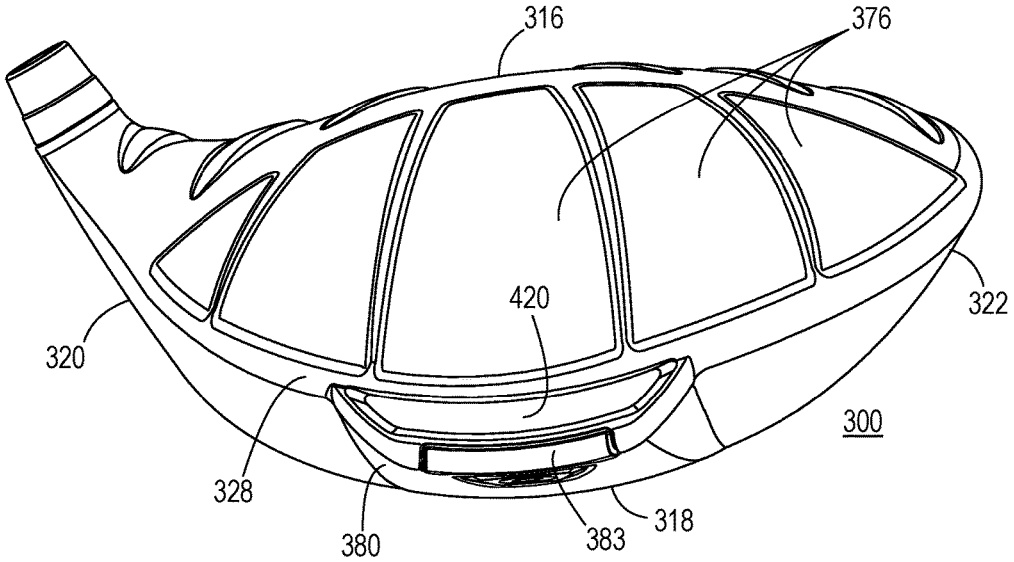
FIG. 8 is a rear view of the golf club head in FIG. 1.
Figure 9:
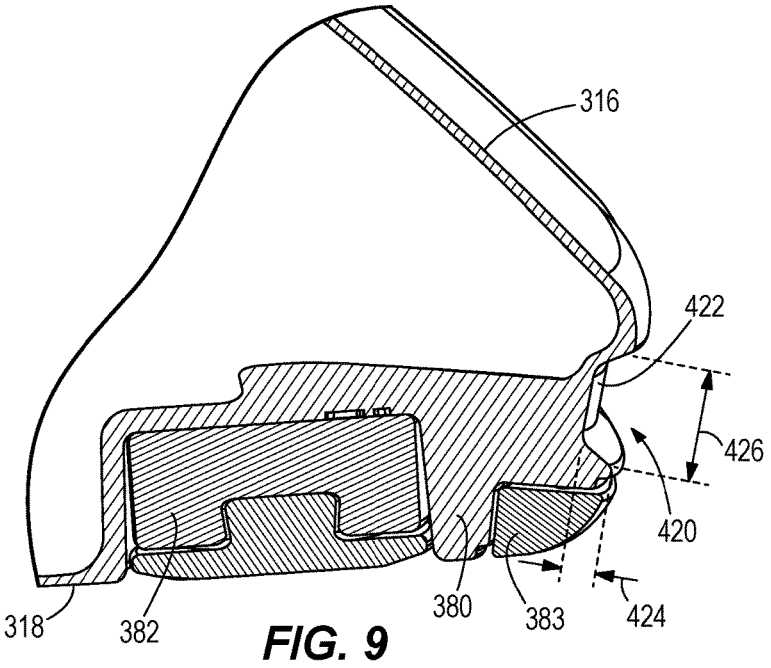
FIG. 9 is a side cross sectional view of the golf club head in FIG. 1.

Referring to FIGS. 8-9, in some embodiments, the club head 300 can further include a cavity 420 located at the back end 310 and in the trailing edge 328 of the club head 300, similar to the cavity described in U.S. patent application Ser. No. 14/882,092, now U.S. Pat. No. 9,492,721 granted on Nov. 15, 2016, entitled "Golf Club Heads with Aerodynamic Features and Related Methods," Which is incorporated fully herein by reference. In many embodiments, the cavity 420 can break the vortices generated behind golf club head 300 into smaller vortices to reduce the size of the wake and/or reduce drag. In some embodiments, breaking the vortices into smaller vortices can generate a region of high pressure behind golf club head 300. In some embodiments, this region of high pressure can push golf club head 300 forward, reduce drag, and/or enhance the aerodynamic design of golf club head 300. In many embodiments, the net effect of smaller vortices and reduced drag is an increase in the speed of golf club head 300. This effect can lead to higher speeds at which a golf ball leaves strikeface 304 after impact to increase ball travel distance.

In many embodiments, the cavity 420 includes a back wall 422 that is oriented in a direction perpendicular to the X'Z' plane and includes a width measured in a direction from the heel 320 to the toe 322, a depth 424, and a height 426. The width of the cavity 420 can be approximately 1.0 inches (approximately 2.54 centimeters (cm)) to approximately 8 inch (approximately 20.32 cm), approximately 1.0 inches (approximately 2.54 cm) to approximately 2.25 inches (approximately 5.72 cm), or approximately 1.75 inches (approximately 4.5 cm) to approximately 2.25 inches (approximately 5.72 cm). For example, the width of the cavity 420 can be approximately 2.0 inches (5.08 cm), 3.0 inches (7.62 cm), 4.0 inches (10.16 cm), 5.0 inches (12.7 cm), 6.0 inches (15.24 cm), or 7.0 inches (17.78 cm). In some embodiments, the width of the cavity 420 can remain constant from near the top of the cavity 420 (toward the crown 316 of the club head 300) to near the bottom of the cavity 420 (toward the sole 318 of the club head 300). In other embodiments, the width of the cavity 420 can vary from near the top to near the bottom. In the illustrated embodiment of FIG. 8, the width of the cavity 420 is largest near the top and smallest near the bottom. In other embodiments, the width of the cavity 420 can vary according to any profile. For example, in other embodiments, the width of the cavity 420 can be longest at the top, at the bottom, at the center, or at any other location extending from the top to the bottom of the cavity 420.

The depth 424 of the cavity 420 can be approximately 0.025 inch (approximately 0.127 cm) to approximately 0.250 inch (approximately 0.635 cm), or approximately 0.025 inch (approximately 0.127 cm) to approximately 0.150 inch (approximately 0.381 cm). For example, the depth 424 of the cavity 420 can be approximately 0.1 inch (approximately 0.254 cm), or approximately 0.05 inch (approximately 0.127 cm). In some embodiments, the depth 424 of the cavity 420 can remain constant between the heel and the toe and/or between the top and the bottom of the cavity 420. In other embodiments, the depth 424 of the cavity 420 can vary between the heel and the toe and/or between the top and the bottom of the cavity 420. For example, the depth 424 of the cavity 420 can be the largest near the heel, near the toe, near the crown, near the sole, near the center, or at any combination of the described locations.

The height 426 of the cavity 420 can be measured in a direction from the crown 316 to the sole 318. The height 426 of the cavity 420 can be approximately 0.19 inch (approximately 0.48 cm) to approximately 0.21 inch (approximately 0.53 cm). In some embodiments, the height 426 of the cavity 420 can be approximately 0.10 inch (approximately 0.25 cm) to approximately 0.50 inch (approximately 1.27 cm). In some embodiments, the height 426 of the cavity 420 can be approximately 0.10 inch (approximately 0.25 cm) to approximately 0.40 inch (approximately 1.02 cm). In some embodiments, the height 426 of the cavity 420 can be approximately 0.10 inch (approximately 0.25 cm) to approximately 0.30 inch (approximately 0.76 cm). In some embodiments, the height 426 of the cavity 420 can be approximately 0.10 inch (approximately 0.25 cm) to approximately 0.20 inch (approximately 0.51 cm). In some embodiments, the height 426 of the cavity 420 can remain constant between the heel and the toe of the cavity 420. In other embodiments, the height 426 of the cavity 420 can vary between the heel and the toe of the cavity 420. For example, the height 426 of the cavity 420 can be the largest near the heel, near the toe, near the center, or at any combination of the described locations.

v. Hosel Structure

In some embodiments, the hosel structure 330 can have a smaller outer diameter to reduce the aerodynamic drag on the club head 300 during a swing, compared to a similar club head having a larger diameter hosel structure. In many embodiments, the hosel structure 330 has an outer diameter less than 0.545 inches. For example, the hosel structure 330 can have an outer diameter less than 0.60 inches, less than 0.59 inches, less than 0.58 inches, less than 0.57 inches, less than 0.56 inches, less than 0.55 inches, less than 0.54 inches, less than 0.53 inches, less than 0.52, less than 0.51 inches, or less than 0.50 inches. In many embodiments, the outer diameter of the hosel structure 330 is reduced while maintaining adjustability of the loft angle and/or lie angle of the club head 300.

vi. Projected Area

In many embodiments, the club head 300 further comprises a front projected area and a side projected area. The front projected area is the area of the club head 300 visible from the front view, as illustrated in FIG. 1, and projected on the X'Y' plane. The side projected area is the area of the club head 300 visible from the side view and projected on the Y'Z' plane.

In many embodiments, the front projected area of the club head 300 can be between 0.00400 $m^2$ and 0.00700 $m^2$. For example, in the illustrated embodiment, the front projected area of the club head is 0.00655 $m^2$. In other embodiments, the front projected area can be between 0.00400 $m^2$ and 0.00665 $m^2$, between 0.00400 $m^2$ and 0.00675 $m^2$, between 0.00400 $m^2$ and 0.00685 $m^2$, or between 0.00400 $m^2$ and 0.00695 $m^2$.

In many embodiments, the side projected area of the club head 300 can be between 0.00500 $m^2$ and 0.00650 $m^2$. For example, in the illustrated embodiment, the front projected area of the club head is 0.00579 $m^2$. In other embodiments, the front projected area can be between 0.00545 $m^2$ and 0.00565 $m^2$, between 0.00535 $m^2$ and 0.00575 $m^2$, between 0.00525 $m^2$ and 0.00585 $m^2$, or between 0.00515 $m^2$ and 0.00595 $m^2$.

C. Balance of CG Position, Moment of Inertia, and Aerodynamic Drag

In current golf club head design, increasing or maximizing the moment of inertia of the club head and/or the head CG position can adversely affect other performance characteristics of the club head, such as aerodynamic drag. The club head 300 described herein increases or maximizes the club head moment of inertia, while simultaneously maintaining or reducing aerodynamic drag, as described in further detail below. Accordingly, the club head 300 having improved impact performance characteristics (e.g. spin, launch angle, ball speed, and forgiveness) also balances or improves swing performance characteristics (e.g. aerodynamic drag, ability to square the club head at impact, and swing speed).

II. Low Volume Driver-Type Club Head

According to another embodiment, a golf club head 500 can comprise a low volume and a low loft angle. In many embodiments, the golf club head 500 comprises a driver-type club head. In other embodiments, the golf club head 500 can comprise any type of golf club head having a loft angle and volume as described herein. In many embodiments, club head 500 comprises the same or similar parameters as club head 100, wherein the parameters are described with the club head 100 reference numbers plus 400.

In many embodiments, the loft angle of the club head 500 is less than approximately 16 degrees, less than approximately 15 degrees, less than approximately 14 degrees, less than approximately 13 degrees, less than approximately 12 degrees, less than approximately 11 degrees, or less than approximately 10 degrees. Further, in many embodiments, the volume of the club head 500 is less than approximately 450 cc, less than approximately 440 cc, less than approximately 430 cc, less than approximately 425 cc, less than approximately 400 cc, less than approximately 375 cc, or less than approximately 350 cc. In some embodiments, the volume of the club head can be approximately 300 cc-450 cc, approximately 300 cc-400 cc, approximately 325 cc-425 cc, approximately 350 cc-450 cc, approximately 400 cc-450 cc, approximately 420 cc-450 cc, or approximately 440 cc-450 cc.

In many embodiments, the length 562 of the club head 500 is greater than 4.85 inches. In other embodiments, the length 562 of the club head 500 is greater than 4.5 inches, greater than 4.6 inches, greater than 4.7 inches, greater than 4.8, greater than 4.9 inches, or greater than 5.0 inches. For example, in some embodiments, the length 562 of the club head 500 can be between 4.6-5.0 inches, between 4.7-5.0 inches, between 4.8-5.0 inches, between 4.85-5.0 inches, or between 4.9-5.0 inches.

In many embodiments, the depth 560 of the club head 500 is at least 0.70 inches less than the length 562 of the club head 500. In many embodiments, the depth 560 of the club head 500 is greater than 4.75 inches. In other embodiments, the depth 360 of the club head 500 is greater than 4.5 inches, greater than 4.6 inches, greater than 4.7 inches, greater than 4.8, greater than 4.9 inches, or greater than 5.0 inches. For example, in some embodiments, the depth 560 of the club head 500 can be between 4.6-5.0 inches, between 4.7-5.0 inches, between 4.75-5.0 inches, between 4.8-5.0 inches, or between 4.9-5.0 inches.

In many embodiments, the height 564 of the club head is less than approximately 2.8 inches. In other embodiments, the height 564 of the club head 500 is less than 3.0 inches, less than 2.9 inches, less than 2.8 inches, less than 2.7, or less than 2.6 inches. For example, in some embodiments, the height 564 of the club head 500 can be between 2.0-2.8 inches, between 2.2-2.8 inches, between 2.5-2.8 inches, or between 2.5-3.0 inches. Further, in many embodiments, the face height 544 of the club head 500 can be approximately 1.3 inches (33 mm) to approximately 2.8 inches (71 mm). Further still, in many embodiments, the club head 500 can comprise a mass between 185 grams and 225 grams.

The club head 500 further comprises a balance of various additional parameters, such as head CG position, club head moment of inertia, and aerodynamic drag, to provide both improved impact performance characteristics (e.g. spin, launch angle, speed, forgiveness) and swing performance characteristics (e.g. aerodynamic drag, ability to square the club head at impact). In many embodiments, the balance of parameters described below provides improved impact performance while maintaining or improving swing performance characteristics. Further, in many embodiments, the balance of parameters described below provides improved swing performance characteristics while maintaining or improving impact performance characteristics.

A. Center of Gravity Position and Moment of Inertia

In many embodiments, a low and back club head CG and increased moment of inertia can be achieved by increasing discretionary weight and repositioning discretionary weight in regions of the club head having maximized distances from the head CG. Increasing discretionary weight can be achieved by thinning the crown and/or using optimized materials, as described above relative to the head CG position. Repositioning discretionary weight to maximize the distance from the head CG can be achieved using removable weights, embedded weights, or a steep crown angle, as described above relative to the head CG position.

In many embodiments, the club head 500 comprises a crown-to-sole moment of inertia $I_x$ greater than approximately 3000 g·cm$^2$, greater than approximately 3250 g·cm$^2$, greater than approximately 3500 g·cm$^2$, greater than approximately 3750 g·cm$^2$, greater than approximately 4000 g·cm$^2$, greater than approximately 4250 g·cm$^2$, greater than approximately 4500 g·cm$^2$, greater than approximately 4750 g·cm$^2$, greater than approximately 5000 g·cm$^2$, greater than approximately 5250 g·cm$^2$, greater than approximately 5500 g·cm$^2$, greater than approximately 5750 g·cm$^2$, greater than approximately 6000 g·cm$^2$, greater than approximately 6250 g·cm$^2$, greater than approximately 6500 g·cm$^2$, greater than approximately 6750 g·cm$^2$, or greater than approximately 7000 g·cm$^2$.

In many embodiments, the club head 500 comprises a heel-to-toe moment of inertia $I_{yy}$ greater than approximately 5000 g·cm$^2$, greater than approximately 5250 g·cm$^2$, greater than approximately 5500 g·cm$^2$, greater than approximately 5750 g·cm$^2$, greater than approximately 6000 g·cm$^2$, greater than approximately 6250 g·cm$^2$, greater than approximately 6500 g·cm$^2$, greater than approximately 6750 g·cm$^2$, or greater than approximately 7000 g·cm$^2$.

In many embodiments, the club head 500 comprises a combined moment of inertia (i.e. the sum of the crown-to-sole moment of inertia $I_{xx}$ and the heel-to-toe moment of inertia $I_{yy}$) greater than 8000 g·cm$^2$, greater than 8500 g·cm$^2$, greater than 8750 g·cm$^2$, greater than 9000 g·cm$^2$, greater than 9250 g·cm$^2$, greater than 9500 g·cm$^2$, greater than 9750 g·cm$^2$, greater than 10000 g·cm$^2$, greater than 10250 g·cm$^2$, greater than 10500 g·cm$^2$, greater than 10750 g·cm$^2$, greater than 11000 g·cm$^2$, greater than 11250 g·cm$^2$, greater than 11500 g·cm$^2$, greater than 11750 g·cm$^2$, or greater than 12000 g·cm$^2$.

In many embodiments, the club head 500 comprises a head CG height 574 less than approximately 0.20 inches, less than approximately 0.15 inches, less than approximately 0.10 inches, less than approximately 0.09 inches, less than approximately 0.08 inches, less than approximately 0.07 inches, less than approximately 0.06 inches, or less than approximately 0.05 inches. Further, in many embodiments, the club head 500 comprises a head CG height 574 having an absolute value less than approximately 0.20 inches, less than approximately 0.15 inches, less than approximately 0.10 inches, less than approximately 0.09 inches, less than approximately 0.08 inches, less than approximately 0.07 inches, less than approximately 0.06 inches, or less than approximately 0.05 inches.

In many embodiments, the club head 500 comprises a head CG depth 572 greater than approximately 1.2 inches, greater than approximately 1.3 inches, greater than approximately 1.4 inches, greater than approximately 1.5 inches, greater than approximately 1.6 inches, greater than approximately 1.7 inches, greater than approximately 1.8 inches, greater than approximately 1.9 inches, or greater than approximately 2.0 inches.

In some embodiments, the club head 500 can comprise a first performance characteristic less than or equal to 0.56, wherein the first performance characteristic is defined as a ratio between (a) the difference between 72 mm and the face height 544, and (b) the head CG depth 572. In these or other embodiments, the club head 500 can comprise a second performance characteristic greater than or equal to 425 cc, wherein the second performance characteristic is defined as the sum of (a) the volume of the club head 500, and (b) a ratio between the head CG depth 572 and the absolute value of the head CG height 574. In some embodiments, the second performance characteristic can be greater than or equal to 450 cc, greater than or equal to 475 cc, greater than or equal to 490 cc, greater than or equal to 495 cc, greater than or equal to 500 cc, greater than or equal to 505 cc, or greater than or equal to 510 cc.

The club head 500 having the reduced head CG height 574 can reduce the backspin of a golf ball on impact compared to a similar club head having a higher head CG height. In many embodiments, reduced backspin can increase both ball speed and travel distance for improve club head performance. Further, the club head 500 having the increased head CG depth 572 can increase the heel-to-toe moment of inertia compared to a similar club head having a head CG depth closer to the strikeface. Increasing the heel-to-toe moment of inertia can increase club head forgiveness on impact to improve club head performance. Further still, the club head 500 having the increased head CG depth 572 can increase launch angle of a golf ball on impact by increasing the dynamic loft of the club head at delivery, compared to a similar club head having a head CG depth closer to the strikeface.

The head CG height 574 and/or head CG depth 572 can be achieved by reducing weight of the club head 500 in various regions, thereby increasing discretionary weight, and repositioning discretionary weight in strategic regions of the club head to shift the head CG lower and farther back. Various means to reduce and reposition club head weight are described below.

i. Thin Regions

In some embodiments, the head CG height 574 and/or head CG depth 572 can be achieved by thinning various regions of the club head 500 to remove excess weight. Removing excess weight results in increased discretionary weight that can be strategically repositioned to regions of the club head 500 to achieve the desired low and back club head CG position.

In many embodiments, the club head 500 can have one or more thin regions. The thinned regions can be similar or identical to the one or more thin regions 376 of club head 300. The one or more thin regions can be positioned on the strikeface 504, the body 502, or a combination of the strikeface 504 and the body 502. Further, the one or more thin regions can be positioned on any region of the body 502, including the crown 516, the sole 518, the heel 520, the toe 522, the front end 508, the back end 510, the skirt 528, or any combination of the described positions. For example, in some embodiments, the one or more thin regions can be positioned on the crown 516. For further example, the one or more thin regions can be positioned on a combination of the strikeface 504 and the crown 516. For further example, the one or more thin regions can be positioned on a combination of the strikeface 504, the crown 516, and the sole 518. For further example, the entire body 502 and/or the entire strikeface 504 can comprise a thin region.

In embodiments where one or more thin regions are positioned on the strikeface 504, the thickness of the strikeface 504 can vary defining a maximum strikeface thickness and a minimum strikeface thickness. In these embodiments, the minimum strikeface thickness can be less than 0.10 inches, less than 0.09 inches, less than 0.08 inches, less than 0.07 inches, less than 0.06 inches, less than 0.05 inches, less than 0.04 inches, or less than 0.03 inches. In these or other embodiments, the maximum strikeface thickness can be less than 0.20 inches, less than 0.19 inches, less than 0.18 inches, less than 0.17 inches, less than 0.16 inches, less than 0.15 inches, less than 0.14 inches, less than 0.13 inches, less than 0.12 inches, less than 0.11 inches, or less than 0.10 inches.

In embodiments where one or more thin regions are positioned on the body 502, the thin regions can comprise a thickness less than approximately 0.020 inches. In other embodiments, the thin regions comprise a thickness less than 0.025 inches, less than 0.020 inches, less than 0.019 inches, less than 0.018 inches, less than 0.017 inches, less than 0.016 inches, less than 0.015 inches, less than 0.014 inches, less than 0.013 inches, less than 0.012 inches, or less than 0.010 inches. For example, the thin regions can comprise a thickness between approximately 0.010-0.025 inches, between approximately 0.013-0.020 inches, between approximately 0.014-0.020 inches, between approximately 0.015-0.020 inches, between approximately 0.016-0.020 inches, between approximately 0.017-0.020 inches, or between approximately 0.018-0.020 inches.

In the illustrated embodiment, the thin regions vary in shape and position and cover approximately 25% of the surface area of club head 500. In other embodiments, the thin regions can cover approximately 20-30%, approximately 15-35%, approximately 15-25%, approximately 10-25%, approximately 15-30%, or approximately 20-50% of the surface area of club head 500. Further, in other embodiments, the thin regions can cover up to 5%, up to 10%, up to 15%, up to 20%, up to 25%, up to 30%, up to 35%, up to 40%, up to 45%, or up to 50% of the surface area of club head 500.

In many embodiments, the crown 518 can comprise one or more thin regions, such that approximately 51% of the surface area of the crown comprises thin regions. In other embodiments, the crown 516 can comprise one or more thin regions, such that up to 20%, up to 25%, up to 30%, up to 35%, up to 40%, up to 45%, up to 50%, up to 55%, up to 60%, up to 65%, up to 70%, or up to 75% of the crown comprises thin regions. For example, in some embodiments, approximately 40-60% of the crown can comprise thin regions. For further example, in other embodiments, approximately 50-100%, approximately 40-80%, approximately 35-65%, approximately 30-70%, or approximately 25-75% of the crown 516 can comprise thin regions. In some embodiments, the crown 516 can comprise one or more thin regions, wherein each of the one or more thin regions become thinner in a gradient fashion. In this exemplary embodiment, the one or more thin regions of the crown 516 extend in a heel-to-toe direction, and each of the one or more thin regions decrease in thickness in a direction from the strikeface 504 toward the back end 510.

In many embodiments, the sole 518 can comprise one or more thin regions, such that approximately 64% of the surface area of the sole comprises thin regions. In other embodiments, the sole 518 can comprise one or more thin regions, such that up to 20%, up to 25%, up to 30%, up to 35%, up to 40%, up to 45%, up to 50%, up to 55%, up to 60%, up to 65%, up to 70%, up to 75%, up to 80%, up to 85%, or up to 90% of the sole comprises thin regions. For example, in some embodiments, approximately 40-60% of the sole can comprise thin regions. For further example, in other embodiments, approximately 50-100%, approximately 40-80%, approximately 35-65%, approximately 30-70%, or approximately 25-75% of the sole 518 can comprise thin regions.

The thinned regions can comprise any shape, such as circular, triangular, square, rectangular, ovular, or any other polygon or shape with at least one curved surface. Further, one or more thinned regions can comprise the same shape as or a different shape than the remaining thinned regions.

In many embodiments, club head 500 having thin regions can be manufacturing using centrifugal casting. In these embodiments, centrifugal casting allows the club head 500 to have thinner walls than a club head manufactured using conventional casting. In other embodiments, portions of the club head 500 having thin regions can be manufactured using other suitable methods, such as stamping, forging, or machining. In embodiments where portions of the club head 500 having thin regions are manufactured using stamping, forging, or machining, the portions of the club head 500 can be coupled using epoxy, tape, welding, mechanical fasteners, or other suitable methods.

ii. Optimized Materials

In some embodiments, the strikeface 504 and/or the body 502 can comprise an optimized material having increased specific strength and/or increased specific flexibility. The specific flexibility is measured as a ratio of the yield strength to the elastic modulus of the optimized material. Increasing specific strength and/or specific flexibility can allow portions of the club head to be thinned, while maintaining durability.

In some embodiments, the first material of the strikeface 504 can be an optimized material, as described in U.S. Provisional Patent Appl. No. 62/399,929, entitled "Golf Club Heads with Optimized Material Properties." In these or other embodiments, the first material comprising an optimized titanium alloy can have a specific strength greater than or equal to approximately 900,000 PSI/lb/in$^3$ (224 MPa/g/cm$^3$), greater than or equal to approximately 910,000 PSI/lb/in$^3$ (227 MPa/g/cm$^3$), greater than or equal to approximately 920,000 PSI/lb/in$^3$ (229 MPa/g/cm$^3$), greater than or equal to approximately 930,000 PSI/lb/in$^3$ (232 MPa/g/cm$^3$), greater than or equal to approximately 940,000 PSI/lb/in$^3$ (234 MPa/g/cm$^3$), greater than or equal to approximately 950,000 PSI/lb/in$^3$ (237 MPa/g/cm$^3$), greater than or equal to approximately 960,000 PSI/lb/in$^3$ (239 MPa/g/cm$^3$), greater than or equal to approximately 970,000 PSI/lb/in$^3$ (242 MPa/g/cm$^3$), greater than or equal to approximately 980,000 PSI/lb/in$^3$ (244 MPa/g/cm$^3$), greater than or equal to approximately 990,000 PSI/lb/in$^3$ (247 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), greater than or equal to approximately 1,100,000 PSI/lb/in$^3$ (274 MPa/g/cm$^3$), or greater than or equal to approximately 1,150,000 PSI/lb/in$^3$ (286 MPa/g/cm$^3$).

Further, in these or other embodiments, the first material comprising an optimized titanium alloy can have a specific flexibility greater than or equal to approximately 0.0075, greater than or equal to approximately 0.0080, greater than or equal to approximately 0.0085, greater than or equal to approximately 0.0090, greater than or equal to approximately 0.0091, greater than or equal to approximately 0.0092, greater than or equal to approximately 0.0093, greater than or equal to approximately 0.0094, greater than or equal to approximately 0.0095, greater than or equal to approximately 0.0096, greater than or equal to approximately 0.0097, greater than or equal to approximately 0.0098, greater than or equal to approximately 0.0099, greater than or equal to approximately 0.0100, greater than or equal to approximately 0.0105, greater than or equal to approximately 0.0110, greater than or equal to approximately 0.0115, or greater than or equal to approximately 0.0120.

In these or other embodiments, the first material comprising an optimized steel alloy can have a specific strength greater than or equal to approximately 650,000 PSI/lb/in$^3$ (162 MPa/g/cm$^3$), greater than or equal to approximately 700,000 PSI/lb/in$^3$ (174 MPa/g/cm$^3$), greater than or equal to approximately 750,000 PSI/lb/in$^3$ (187 MPa/g/cm$^3$), greater than or equal to approximately 800,000 PSI/lb/in$^3$ (199 MPa/g/cm$^3$), greater than or equal to approximately 810,000 PSI/lb/in$^3$ (202 MPa/g/cm$^3$), greater than or equal to approximately 820,000 PSI/lb/in$^3$ (204 MPa/g/cm$^3$), greater than or equal to approximately 830,000 PSI/lb/in$^3$ (207 MPa/g/cm$^3$), greater than or equal to approximately 840,000 PSI/lb/in$^3$ (209 MPa/g/cm$^3$), greater than or equal to approximately 850,000 PSI/lb/in$^3$ (212 MPa/g/cm$^3$), greater than or equal to approximately 900,000 PSI/lb/in$^3$ (224 MPa/g/cm$^3$), greater than or equal to approximately 950,000 PSI/lb/in$^3$ (237 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), greater than or equal to approximately 1,100,000 PSI/lb/in$^3$ (274 MPa/g/cm$^3$), greater than or equal to approximately 1,115,000 PSI/lb/in$^3$ (278 MPa/g/cm$^3$), or greater than or equal to approximately 1,120,000 PSI/lb/in$^3$ (279 MPa/g/cm$^3$).

Further, in these or other embodiments, the first material comprising an optimized steel alloy can have a specific flexibility greater than or equal to approximately 0.0060, greater than or equal to approximately 0.0065, greater than or equal to approximately 0.0070, greater than or equal to approximately 0.0075, greater than or equal to approximately 0.0080, greater than or equal to approximately 0.0085, greater than or equal to approximately 0.0090, greater than or equal to approximately 0.0095, greater than or equal to approximately 0.0100, greater than or equal to approximately 0.0105, greater than or equal to approximately 0.0110, greater than or equal to approximately 0.0115, greater than or equal to approximately 0.0120, greater than or equal to approximately 0.0125, greater than or equal to approximately 0.0130, greater than or equal to approximately 0.0135, greater than or equal to approximately 0.0140, greater than or equal to approximately 0.0145, or greater than or equal to approximately 0.0150.

In these embodiments, the increased specific strength and/or increased specific flexibility of the optimized first material allow the strikeface 504, or portions thereof, to be thinned, as described above, while maintaining durability. Thinning of the strikeface 504 can reduce the weight of the strikeface 504, thereby increasing discretionary weight to be strategically positioned in other areas of the club head 500 to position the head CG low and back and/or increase the club head moment of inertia.

In some embodiments, the second material of the body 502 can be an optimized material, as described in U.S. Provisional Patent Appl. No. 62/399,929, entitled "Golf Club Heads with Optimized Material Properties." In these or other embodiments, the second material comprising an optimized titanium alloy can have a specific strength greater than or equal to approximately 730,500 PSI/lb/in$^3$ (182 MPa/g/cm$^3$). For example, the specific strength of the optimized titanium alloy can be greater than or equal to approximately 650,000 PSI/lb/in$^3$ (162 MPa/g/cm$^3$), greater than or equal to approximately 700,000 PSI/lb/in$^3$ (174 MPa/g/cm$^3$), greater than or equal to approximately 750,000 PSI/lb/in$^3$ (187 MPa/g/cm$^3$), greater than or equal to approximately 800,000 PSI/lb/in$^3$ (199 MPa/g/cm$^3$), greater than or equal to approximately 850,000 PSI/lb/in$^3$ (212 MPa/g/cm$^3$), greater than or equal to approximately 900,000 PSI/lb/in$^3$ (224 MPa/g/cm$^3$), greater than or equal to approximately 950,000 PSI/lb/in$^3$ (237 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), or greater than or equal to approximately 1,100,000 PSI/lb/in$^3$ (272 MPa/g/cm$^3$).

Further, in these or other embodiments, the second material comprising an optimized titanium alloy can have a specific flexibility greater than or equal to approximately 0.0060, greater than or equal to approximately 0.0065, greater than or equal to approximately 0.0070, greater than or equal to approximately 0.0075, greater than or equal to approximately 0.0080, greater than or equal to approximately 0.0085, greater than or equal to approximately 0.0090, greater than or equal to approximately 0.0095, greater than or equal to approximately 0.0100, greater than or equal to approximately 0.0105, greater than or equal to approximately 0.0110, greater than or equal to approximately 0.0115, or greater than or equal to approximately 0.0120.

In these or other embodiments, the second material comprising an optimized steel can have a specific strength greater than or equal to approximately 500,000 PSI/lb/in$^3$ (125 MPa/g/cm$^3$), greater than or equal to approximately 510,000 PSI/lb/in$^3$ (127 MPa/g/cm$^3$), greater than or equal to approximately 520,000 PSI/lb/in$^3$ (130 MPa/g/cm$^3$), greater than or equal to approximately 530,000 PSI/lb/in$^3$ (132 MPa/g/cm$^3$), greater than or equal to approximately 540,000 PSI/lb/in$^3$ (135 MPa/g/cm$^3$), greater than or equal to approximately 550,000 PSI/lb/in$^3$ (137 MPa/g/cm$^3$), greater than or equal to approximately 560,000 PSI/lb/in$^3$ (139 MPa/g/cm$^3$), greater than or equal to approximately 570,000 PSI/lb/in$^3$ (142 MPa/g/cm$^3$), greater than or equal to approximately 580,000 PSI/lb/in$^3$ (144 MPa/g/cm$^3$), greater than or equal to approximately 590,000 PSI/lb/in$^3$ (147 MPa/g/cm$^3$), greater than or equal to approximately 600,000 PSI/lb/in$^3$ (149 MPa/g/cm$^3$), greater than or equal to approximately 625,000 PSI/lb/in$^3$ (156 MPa/g/cm$^3$), greater than or equal to approximately 675,000 PSI/lb/in$^3$ (168 MPa/g/cm$^3$), greater than or equal to approximately 725,000 PSI/lb/in$^3$ (181 MPa/g/cm$^3$), greater than or equal to approximately 775,000 PSI/lb/in$^3$ (193 MPa/g/cm$^3$), greater than or equal to approximately 825,000 PSI/lb/in$^3$ (205 MPa/g/cm$^3$), greater than or equal to approximately 875,000 PSI/lb/in$^3$ (218 MPa/g/cm$^3$), greater than or equal to approximately 925,000 PSI/lb/in$^3$ (230 MPa/g/cm$^3$), greater than or equal to approximately 975,000 PSI/lb/in$^3$ (243 MPa/g/cm$^3$), greater than or equal to approximately 1,025,000 PSI/lb/in$^3$ (255 MPa/g/cm$^3$), greater than or equal to approximately 1,075,000 PSI/lb/in$^3$ (268 MPa/g/cm$^3$), or greater than or equal to approximately 1,125,000 PSI/lb/in$^3$ (280 MPa/g/cm$^3$).

Further, in these or other embodiments, the second material comprising an optimized steel can have a specific flexibility greater than or equal to approximately 0.0060, greater than or equal to approximately 0.0062, greater than or equal to approximately 0.0064, greater than or equal to approximately 0.0066, greater than or equal to approximately 0.0068, greater than or equal to approximately 0.0070, greater than or equal to approximately 0.0072, greater than or equal to approximately 0.0076, greater than or equal to approximately 0.0080, greater than or equal to approximately 0.0084, greater than or equal to approximately 0.0088, greater than or equal to approximately 0.0092, greater than or equal to approximately 0.0096, greater than or equal to approximately 0.0100, greater than or equal to approximately 0.0105, greater than or equal to approximately 0.0110, greater than or equal to approximately 0.0115, greater than or equal to approximately 0.0120, greater than or equal to approximately 0.0125, greater than or equal to approximately 0.0130, greater than or equal to approximately 0.0135, greater than or equal to approximately 0.0140, greater than or equal to approximately 0.0145, or greater than or equal to approximately 0.0150.

In these embodiments, the increased specific strength and/or increased specific flexibility of the optimized second material allow the body 502, or portions thereof, to be thinned, while maintaining durability. Thinning of the body 502 can reduce club head weight, thereby increasing discretionary weight to be strategically positioned in other areas of the club head 500 to position the head CG low and back and/or increase the club head moment of inertia.

iii. Removable Weights

In some embodiments, the club head 500 can include one or more weight structures 580 comprising one or more removable weights 582. The one or more weight structures 580 and/or the one or more removable weights 582 can be located towards the sole 518 and towards the back end 510, thereby positioning the discretionary weight on the sole 518 and near the back end 510 of the club head 500 to achieve a low and back head CG position. In many embodiments, the one or more weight structures 580 removably receive the one or more removable weights 582. In these embodiments, the one or more removable weights 582 can be coupled to the one or more weight structures 580 using any suitable method, such as a threaded fastener, an adhesive, a magnet, a snap fit, or any other mechanism capable of securing the one or more removable weights to the one or more weight structures 580.

The weight structure 580 and/or removable weight 582 can be located relative to a clock grid 2000 (illustrated in FIG. 3), which can be aligned with respect to the strikeface 504 when viewed from a top view. The clock grid comprises at least a 12 o'clock ray, a 3 o'clock ray, a 4 o'clock ray, a 5 o'clock ray, a 6 o'clock ray, a 7 o'clock ray, a 8 o'clock ray, and a 9 o'clock ray. For example, the clock grid 2000 comprises a 12 o'clock ray 2012, which is aligned with the geometric center 540 of the strikeface 504. The 12 o'clock ray 2012 is orthogonal to the X'Y' plane. Clock grid 2000 can be centered along 12 o'clock ray 2012, at a midpoint between the front end 508 and back end 510 of the club head 500. In the same or other examples, clock grid centerpoint 2010 can be centered proximate to a geometric centerpoint of golf club head 500 when viewed from a bottom view. The clock grid 2000 also comprises a 3 o'clock ray 2003 extending towards the heel 520, and a 9 o'clock ray 2009 extending towards the toe 522 of the club head 500.

A weight perimeter 584 of the weight structure 580 is located in the present embodiment towards the back end 510, at least partially bounded between a 4 o'clock ray 2004 and 8 o'clock ray 2008 of clock grid 2000, while a weight center 586 of a removable weight 582 positioned within weight structure 580 is located between a 5 o'clock ray 2005 and a 7 o'clock ray 2007. In examples such as the present one, the weight perimeter 584 is fully bounded between the 4 o'clock ray 2004 and the 8 o'clock ray 2008. Although the weight perimeter 584 is defined external to the club head 500 in the present example, there can be other examples where the weight perimeter 584 may extend into an interior of, or be defined within, the club head 500. In some examples, the location of the weight structure 580 can be established with respect to a broader area. For instance, in such examples, the weight perimeter 584 of the weight structure 580 can be located towards the back end 510, at least partially bounded between the 4 o'clock ray 2004 and 9 o'clock ray 2009 of the clock grid 2000, while the weight center 586 can be located between the 5 o'clock ray 2005 and 8 o'clock ray 2008.

In the present example, the weight structure 580 protrudes from the external contour of the sole 518, and is thus at least partially external to allow for greater adjustment of the head CG 570. In some examples, the weight structure 580 can comprise a mass of approximately 2 grams to approximately 50 grams, and/or a volume of approximately 1 cc to approximately 30 cc. In other examples, the weight structure 580 can remain flush with the external contour of the body 502.

In many embodiments, the removable weight 582 can comprise a mass of approximately 0.5 grams to approximately 30 grams, and can be replaced with one or more other similar removable weights to adjust the location of the head CG 570. In the same or other examples, the weight center 586 can comprise at least one of a center of gravity of the removable weight 582, and/or a geometric center of removable weight 582.

iv. Embedded Weights

In some embodiments, the club head 500 can include one or more embedded weights to position the discretionary weight on the sole 518, in the skirt 528, and/or near the back end 510 of the club head 500 to achieve a low and back head CG position. The one or more embedded weights of club head 500 can be similar or identical to the one or more embedded weights 383 of club head 300. In many embodiments, the one or more embedded weights are permanently fixed to or within the club head 500. In these embodiments, the embedded weight can be similar to the high density metal piece (HDMP) described in U.S. Provisional Patent Appl. No. 62/372,870, entitled "Embedded High Density Casting."

In many embodiments, the one or more embedded weights are positioned near the back end 510 of the club head 500. For example, a weight center of the embedded weight can be located between the 5 o'clock ray 2005 and 7 o'clock ray 2007, or between the 5 o'clock ray 2005 and 8 o'clock ray 2008 of the clock grid 2000. In many embodiments, the one or more embedded weights can be positioned on the skirt and near the back end of the club head, on the sole and near the back end of the club head, or on the skirt and the sole near the back end of the club head.

In many embodiments, the weight center of the one or more embedded weights is positioned within 0.10 inches, within 0.20 inches, within 0.30 inches, within 0.40 inches, within 0.50 inches, within 0.60 inches, within 0.70 inches, within 0.80 inches, within 0.90 inches, within 1.0 inches, within 1.1 inches, within 1.2 inches, within 1.3 inches, within 1.4 inches, or within 1.5 inches of a perimeter of the club head 500 when viewed from a top view. In these embodiments, the proximity of the embedded weight to the perimeter of the club head 500 can maximize the low and back head CG position, the crown-to-sole moment of inertia $I_{xx}$, and/or the heel-to-toe moment of inertia $I_{yy}$.

In many embodiments, the weight center of the one or more embedded weights is positioned at a distance from the head CG 570 greater than 1.6 inches, greater than 1.7 inches, greater than 1.8 inches, greater than 1.9 inches, greater than 2.0 inches, greater than 2.1 inches, greater than 2.2 inches, greater than 2.3 inches, greater than 2.4 inches, greater than 2.5 inches, greater than 2.6 inches, greater than 2.7 inches, greater than 2.8 inches, greater than 2.9 inches, or greater than 3.0 inches.

In many embodiments, the weight center of the one or more embedded weights is positioned at a distance from the geometric center 540 of the strikeface 504 greater than 4.0 inches, greater than 4.1 inches, greater than 4.2 inches, greater than 4.3 inches, greater than 4.4 inches, greater than 4.5 inches, greater than 4.6 inches, greater than 4.7 inches, greater than 4.8 inches, greater than 4.9 inches, or greater than 5.0 inches.

In many embodiments, the one or more embedded weights can comprise a mass between 3.0-70 grams. For example, in some embodiments, the one or more embedded weights can comprise a mass between 3.0-25 grams, between 10-30 grams, between 20-40 grams, between 30-50 grams, between 40-60 grams, or between 50-70 grams. In embodiments where the one or more embedded weights include more than one weight, each of the embedded weights can comprise the same or a different mass.

In many embodiments, the one or more embedded weights can comprise a material having a specific gravity between 10.0-22.0. For example, in many embodiments, the one or more embedded weights can comprise a material having a specific gravity greater than 10.0, greater than 11.0, greater than 12.0, greater than 13.0, greater than 14.0, greater than 15.0, greater than 16.0, greater than 17.0, greater than 18.0, or greater than 19.0. In embodiments where the one or more embedded weights include more than one weight, each of the embedded weights can comprise the same or a different material.

v. Steep Crown Angle

In some embodiments, the golf club head 500 can further include a steep crown angle 588 to achieve the low and back head CG position. The steep crown angle 588 positions the back end of the crown 516 toward the sole or ground, thereby lowering the club head CG position.

The crown angle 588 is measured as the acute angle between a crown axis 1090 and the front plane 1020. In these embodiments, the crown axis 1090 is located in a cross-section of the club head taken along a plane positioned perpendicular to the ground plane 1030 and the front plane 1020. The crown axis 1090 can be further described with reference to a top transition boundary and a rear transition boundary.

The club head 500 includes a top transition boundary extending between the front end 508 and the crown 516 from near the heel 520 to near the toe 522. The top transition boundary includes a crown transition profile 590 when viewed from a side cross sectional view taken along a plane perpendicular to the front plane 1020 and perpendicular to the ground plane 1030 when the club head 500 is at an address position. The side cross sectional view can be taken along any point of the club head 500 from near the heel 520 to near the toe 522. The crown transition profile 590 defines a front radius of curvature 592 extending from the front end 508 of the club head 500 where the contour departs from the roll radius and/or the bulge radius of the strikeface 504 to a crown transition point 594 indicating a change in curvature from the front radius of curvature 592 to the curvature of the crown 516. In some embodiments, the front radius of curvature 592 comprises a single radius of curvature extending from the top end 593 of the strikeface perimeter 542 near the crown 516 where the contour departs from the roll radius and/or the bulge radius of the strikeface 504 to a crown transition point 594 indicating a change in curvature from the front radius of curvature 592 to one or more different curvatures of the crown 516.

The club head 500 further includes a rear transition boundary extending between the crown 516 and the skirt 528 from near the heel 520 to near the toe 522. The rear transition boundary includes a rear transition profile 596 when viewed from a side cross sectional view taken along a plane perpendicular to the front plane 1020 and perpendicular to the ground plane 1030 when the club head 500 is at an address position. The cross sectional view can be taken along any point of the club head 500 from near the heel 520 to near the toe 522. The rear transition profile 596 defines a rear radius of curvature 598 extending from the crown 516 to the skirt 528 of the club head 500. In many embodiments, the rear radius of curvature 598 comprises a single radius of curvature that transitions the crown 516 to the skirt 528 of the club head 500 along the rear transition boundary. A first rear transition point 602 is located at the junction between the crown 516 and the rear transition boundary. A second rear transition point 603 is located at the junction between the rear transition boundary and the skirt 528 of the club head 500.

The front radius of curvature 592 of the top transition boundary can remain constant, or can vary from near the heel 520 to near the toe 522 of the club head 500. Similarly, the rear radius of curvature 598 of the rear transition boundary can remain constant, or can vary from near the heel 520 to near the toe 522 of the club head 500.

The crown axis 1090 extends between the crown transition point 594 near the front end 508 of the club head 500 and the rear transition point 602 near the back end 510 of the club head 500. The crown angle 388 can remain constant, or can vary from near the heel 520 to near the toe 522 of the club head 500. For example, the crown angle 588 can vary when the side cross sectional view is taken at different locations relative to the heel 520 and the toe 522.

In the illustrated embodiment, the crown angle 588 near the toe 522 is approximately 72.25 degrees, the crown angle 588 near the heel 520 is approximately 64.5 degrees, and the crown angle 588 near the center of the golf club head 500 is approximately 64.2 degrees. In many embodiments, the maximum crown angle 588 taken at any location from near the toe 522 to near the heel 520 is less than 79 degrees, less than approximately 78 degrees, less than approximately 77 degrees, less than approximately 76 degrees, less than approximately 75 degrees, less than approximately 74 degrees, less than approximately 73 degrees, less than approximately 72 degrees, less than approximately 71 degrees, less than approximately 70 degrees, less than approximately 69 degrees, or less than approximately 68 degrees. For example, in some embodiments, the maximum crown angle is between 50 degrees and 79 degrees, between 60 degrees and 79 degrees, or between 70 degrees and 79 degrees.

In other embodiments, the crown angle 588 near the toe 522 of the club head 500 can be less than approximately 79 degrees, less than approximately 78 degrees, less than approximately 77 degrees, less than approximately 76 degrees, less than approximately 75 degrees, less than approximately 74 degrees, less than approximately 73 degrees, less than approximately 72 degrees, less than approximately 71 degrees, less than approximately 70 degrees, less than approximately 69 degrees, or less than approximately 68 degrees. For example, the crown angle 588 taken along a side cross sectional view positioned approximately 1.0 inch toward the toe 522 from the geometric center 540 of the strikeface 504 can be less than 79 degrees, less than 78 degrees, less than 77 degrees, less than 76 degrees, less than 75 degrees, less than 74 degrees, less than 73 degrees, less than 72 degrees, less than 71 degrees, less than 70 degrees, less than 69 degrees, or less than 68 degrees.

Further, in other embodiments, the crown angle 588 near the heel 522 can be less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees. For example, the crown angle 588 taken along a side cross sectional view positioned approximately 1.0 inch toward the heel 522 from the geometric center 540 of the strikeface 504 can be less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees.

Further still, in other embodiments, the crown angle 588 near the center of the club head 500 can be less than 75 degrees, less than 74 degrees, less than 73 degrees, less than 72 degrees, less than 71 degrees, less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees. For example, the crown angle 588 taken along a side cross sectional view positioned approximately at the geometric center 540 of the strikeface 504 can be less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees.

In many embodiments, reducing the crown angle 588 compared to current club heads generates a steeper crown or a crown positioned closer to the ground plane 1030 when the club head 500 is at an address position. Accordingly, the reduced crown angle 588 can result in a lower head CG position compared to a club head with a higher crown angle.

vi. Hosel Sleeve Weight

In some embodiments, the head CG height 174 and/or head CG depth 172 can be achieved by reducing the mass of the hosel sleeve 534. Removing excess weight from the hosel sleeve 534 results in increased discretionary weight that can be strategically repositioned to regions of the club head 500 to achieve the desired low and back club head CG position.

Reducing the mass of the hosel sleeve 534 can be achieved by thinning the sleeve walls, reducing the height of the hosel sleeve 534, reducing the diameter of the hosel sleeve 534, and/or by introducing voids in the walls of the hosel sleeve 534. In many embodiments, the mass of the hosel sleeve 534 can be less than 6 grams, less than 5.5 grams, less than 5.0 grams, less than 4.5 grams, or less than 4.0 grams. In many embodiments, the club head 500 having the reduced mass hosel sleeve 534 can result in a lower (close to the sole) and farther back (closer to the back end) club head CG position than a similar club head 500 with a heavier hosel sleeve.

B. Aerodynamic Drag

In many embodiments, the club head 500 comprises a low and back club head CG position and an increased club head moment of inertia, in combination with reduced aerodynamic drag.

In many embodiments, the club head 500 experiences an aerodynamic drag force less than approximately 1.3 lbf, less than 1.25 lbf, less than 1.2 lbf, less than 1.15 lbf, less than 1.1 lbf, less than 1.05 lbf, or less than 1.0 lbf when tested in a wind tunnel with a squared face and an air speed of 102 miles per hour (mph). In these or other embodiments, the club head 500 experiences an aerodynamic drag force less than approximately 1.3 lbf, less than 1.25 lbf, less than 1.2 lbf, less than 1.15 lbf, less than 1.1 lbf, less than 1.05 lbf, or less than 1.0 lbf when simulated using computational fluid dynamics with a squared face and an air speed of 102 miles per hour (mph). In these embodiments, the airflow experienced by the club head 500 having the squared face is directed at the strikeface 504 in a direction perpendicular to the X'Y' plane. The club head 500 having reduced aerodynamic drag can be achieved using various means, as described below.

i. Crown Angle Height

In some embodiments, reducing the crown angle 588 to form a steeper crown and lower head CG position may result in an undesired increase in aerodynamic drag due to increased air flow separation over the crown during a swing. To prevent increased drag associated with a reduced crown angle 588, a maximum crown height 604 can be increased. The maximum crown height 604 is the greatest distance between the surface of the crown 516 and the crown axis 1090 taken at any side cross sectional view of the club head 500 along a plane positioned parallel to the Y'Z' plane. In many embodiments, a greater maximum crown height 604 results in the crown having a greater curvature. A greater curvature in the crown 516 moves the location of the air flow separation during a swing further back on the club head 500. In other words, a greater curvature allows the airflow to stay attached to club head 500 for a longer distance along the crown 516 during a swing. Moving the airflow separation point back on the crown 516 can result in reduced aerodynamic drag and increased club head swing speeds, thereby resulting in increased ball speed and distance.

In many embodiments, the maximum crown height 404 can be greater than approximately 0.20 inch (5 mm), greater than approximately 0.30 inch (7.5 mm), greater than approximately 0.40 inch (10 mm), greater than approximately 0.50 inch (12.5 mm), greater than approximately 0.60 inch (15 mm), greater than approximately 0.70 inch (17.5 mm), greater than approximately 0.80 inch (20 mm), greater than approximately 0.90 inch (22.5 mm), or greater than approximately 1.0 inch (25 mm). Further, in other embodiments, the maximum crown height can be within the range of 0.20 inch (5 mm) to 0.60 inch (15 mm), or 0.40 inch (10 mm) to 0.80 inch (20 mm), or 0.60 inch (15 mm) to 1.0 inch (25 mm). For example, in some embodiments, the maximum crown height 404 can be approximately 0.52 inch (13.3 mm), approximately 0.54 inch (13.8 mm), approximately 0.59 inch (15 mm), approximately 0.65 inch (16.5 mm), or approximately 0.79 inch (20 mm).

ii. Transition Profiles

In many embodiments, the transition profiles of the club head 500 from the strikeface 504 to the crown 516, the strikeface 504 to the sole 518, and/or the crown 516 to the sole 518 along the back end 510 of the club head 500 can affect the aerodynamic drag on the club head 500 during a swing.

In some embodiments, the club head 500 having the top transition boundary defining the crown transition profile 590, and the rear transition boundary defining the rear transition profile 596 further includes a sole transition boundary defining a sole transition profile 610. The sole transition boundary extends between the front end 508 and the sole 518 from near the heel 520 to near the toe 522. The sole transition boundary includes a sole transition profile 610 when viewed from a side cross sectional view taken along a plane parallel to the Y'Z' plane. The side cross sectional view can be taken along any point of the club head 500 from near the heel 520 to near the toe 522. The sole transition profile 610 defines a sole radius of curvature 612 extending from the front end 508 of the club head 500 where the contour departs from the roll radius and/or the bulge radius of the strikeface 504 to a sole transition point 614 indicating a change in curvature from sole radius of curvature 612 to the curvature of the sole 518. In some embodiments, the sole radius of curvature 612 comprises a single radius of curvature extending from the bottom end 613 of the strikeface perimeter 542 near the sole 518 where the contour departs from the roll radius and/or the bulge radius of the strikeface 504 to a sole transition point 614 indicating a change in curvature from the sole radius of curvature 612 to a curvature of the sole 614.

In many embodiments, the crown transition profile 590, the sole transition profile 610, and the rear transition profile 596 can be similar to the crown transition, sole transition, and rear transition profiles described in U.S. patent Ser. No. 15/233,486, entitled "Golf Club Head with Transition Profiles to Reduce Aerodynamic Drag." Further, the front radius of curvature 592 can be similar to the first crown radius of curvature, the sole radius of curvature 612 can be similar to the first sole radius of curvature, and the rear radius of curvature 398 can be similar to the rear radius of curvature described U.S. patent Ser. No. 15/233,486, entitled "Golf Club Head with Transition Profiles to Reduce Aerodynamic Drag."

In some embodiments, front radius of curvature 592 can range from approximately 0.18 to 0.30 inches (0.46 to 0.76 cm). Further, in other embodiments, the front radius of curvature 592 can be less than 0.40 inches (1.02 cm), less than 0.375 inches (0.95 cm), less than 0.35 inches (0.89 cm), less than 0.325 inches (0.83 cm), or less than 0.30 inches 0.76 cm). For example, the front radius of curvature 592 may be approximately 0.18 inches (0.46 cm), 0.20 inches (0.51 cm), 0.22 inches (0.66 cm), 0.24 inches (0.61 cm), 0.26 inches (0.66 cm), 0.28 inches (0.71 cm), or 0.30 inches (0.76 cm).

In some embodiments, the sole radius of curvature 612 can range from approximately 0.25 to 0.50 inches (0.76 to 1.27 cm). For example, the sole radius of curvature 612 can be less than approximately 0.5 inches (1.27 cm), less than approximately 0.475 inches (1.21 cm), less than approximately 0.45 inches (1.14 cm), less than approximately 0.425 inches (1.08 cm), or less than approximately 0.40 inches (1.02 cm). For further example, the sole radius of curvature 612 can be approximately 0.30 inches (0.76 cm), 0.35 inches (0.89 cm), 0.40 inches (1.02 cm), 0.45 inches (1.14 cm), or 0.50 inches (1.27 cm).

In some embodiments, the rear radius of curvature 598 can range from approximately 0.10 to 0.25 inches (0.25 to 0.64 cm). For example, the rear radius of curvature 598 can be less than approximately 0.3 inches (0.76 cm), less than approximately 0.275 inches (0.70 cm), less than approximately 0.25 inches (0.64 cm), less than approximately 0.225 inches (0.57 cm), or less than approximately 0.20 inches (0.51 cm). For further example, the rear radius of curvature 598 can be approximately 0.10 inches (0.25 cm), 0.15 inches (0.38 cm), 0.20 inches (0.51 cm), or 0.25 inches (0.64 cm).

iii. Turbulators

In some embodiments, the club head 500 can further include a plurality of turbulators 614, as described in U.S. patent application Ser. No. 13/536,753, now U.S. Pat. No. 8,608,587, granted on Dec. 17, 2013, entitled "Golf Club Heads with Turbulators and Methods to Manufacture Golf Club Heads with Turbulators," which is incorporated fully herein by reference. In many embodiments, the plurality of turbulators 614 disrupt the airflow thereby creating small vortices or turbulence inside the boundary layer to energize the boundary layer and delay separation of the airflow on the crown during a swing.

In some embodiments, the plurality of turbulators 614 can be adjacent to the crown transition point 794 of the club head 500. The plurality of turbulators 614 project from an outer surface of the crown 508 and include a length extending between the front end 508 and the back end 510 of the club head 500, and a width extending from the heel 520 to the toe 522 of the club head 500. In many embodiments, the length of the plurality of turbulators is greater than the width. In some embodiments, the plurality of turbulators 614 can comprise the same width. In some embodiments, the plurality of turbulators 614 can vary in height profile. In some embodiments, the plurality of turbulators 614 can be higher toward the apex of the crown 516 than in comparison to the front of the crown 516. In other embodiments, the plurality of turbulators 614 can be higher toward the front of the crown 516, and lower in height toward the apex of the crown 516. In other embodiments, the plurality of turbulators 614 can comprise a constant height profile. Further, in many embodiments, at least a portion of at least one turbulator is located between the strikeface 504 and an apex of the crown 516, and the spacing between adjacent turbulators is greater than the width of each of the adjacent turbulators.

iv. Back Cavity

In some embodiments, the club head 500 can further include a cavity 620 located at the back end 510 and in the trailing edge 528 of the club head 500. In many embodiments, the cavity can be similar to cavity 420 on club head 300. Further, the cavity can be similar to the cavity described in U.S. patent application Ser. No. 14/882,092, entitled "Golf Club Heads with Aerodynamic Features and Related Methods." In many embodiments, the cavity 620 can break the vortices generated behind golf club head 500 into smaller vortices to reduce the size of the wake and/or reduce drag. In some embodiments, breaking the vortices into smaller vortices can generate a region of high pressure behind golf club head 500. In some embodiments, this region of high pressure can push golf club head 500 forward, reduce drag, and/or enhance the aerodynamic design of golf club head 500. In many embodiments, the net effect of smaller vortices and reduced drag is an increase in the speed of golf club head 500. This effect can lead to higher speeds at which a golf ball leaves strikeface after impact to increase ball travel distance.

In many embodiments, the cavity 620 can include a back wall 622, similar to back wall 422, that is oriented in a direction perpendicular to the X'Z' plane and can include a width measured in a direction from the heel 520 to the toe 522, a depth 624 (similar to depth 424 of cavity 420), and a height 626 (similar to height 426 of cavity 420). The width of the cavity 620 can be approximately 1.0 inches (approximately 2.54 centimeters (cm)) to approximately 8 inch (approximately 20.32 cm), approximately 1.0 inches (approximately 2.54 cm) to approximately 2.25 inches (approximately 5.72 cm), or approximately 1.75 inches (approximately 4.5 cm) to approximately 2.25 inches (approximately 5.72 cm). For example, the width of the cavity 620 can be approximately 2.0 inches (5.08 cm), 3.0 inches (7.62 cm), 4.0 inches (10.16 cm), 5.0 inches (12.7 cm), 6.0 inches (15.24 cm), or 7.0 inches (17.78 cm). In some embodiments, the width of the cavity 620 can remain constant from near the top of the cavity (toward the crown 516 of the club head 500) to near the bottom of the cavity (toward the sole 518 of the club head 500). In other embodiments, the width of the cavity can vary from near the top to near the bottom. In some embodiments, the width of the cavity can be largest near the top and smallest near the bottom. In other embodiments, the width of the cavity can vary according to any profile. For example, in other embodiments, the width of the cavity can be longest at the top, at the bottom, at the center, or at any other location extending from the top to the bottom of the cavity 620.

The depth 624 of the cavity 620 can be approximately 0.025 inch (approximately 0.127 cm) to approximately 0.250 inch (approximately 0.635 cm), or approximately 0.025 inch (approximately 0.127 cm) to approximately 0.150 inch (approximately 0.381 cm). For example, the depth 624 of the cavity 620 can be approximately 0.1 inch (approximately 0.254 cm), or approximately 0.05 inch (approximately 0.127 cm). In some embodiments, the depth of the cavity can remain constant between the heel and the toe and/or between the top and the bottom of the cavity. In other embodiments, the depth of the cavity can vary between the heel and the toe and/or between the top and the bottom of the cavity. For example, the depth of the cavity can be the largest near the heel, near the toe, near the crown, near the sole, near the center, or at any combination of the described locations.

The height 626 of the cavity 620 can be measured in a direction from the crown 516 to the sole 518. The height 626 of the cavity 620 can be approximately 0.19 inch (approximately 0.48 cm) to approximately 0.21 inch (approximately 0.53 cm). In some embodiments, the height 626 of the cavity 620 can be approximately 0.10 inch (approximately 0.25 cm) to approximately 0.50 inch (approximately 1.27 cm). In some embodiments, the height 626 of the cavity 620 can be approximately 0.10 inch (approximately 0.25 cm) to approximately 0.40 inch (approximately 1.02 cm). In some embodiments, the height 626 of the cavity 620 can be approximately 0.10 inch (approximately 0.25 cm) to approximately 0.30 inch (approximately 0.76 cm). In some embodiments, the height 626 of the cavity 620 can be approximately 0.10 inch (approximately 0.25 cm) to approximately 0.20 inch (approximately 0.51 cm). In some embodiments, the height of the cavity can remain constant between the heel and the toe of the cavity. In other embodiments, the height of the cavity can vary between the heel and the toe of the cavity. For example, the height of the cavity can be the largest near the heel, near the toe, near the center, or at any combination of the described locations.

v. Hosel Structure

In some embodiments, the hosel structure 530 can have a smaller outer diameter to reduce the aerodynamic drag on the club head 500 during a swing, compared to a similar club head having a larger diameter hosel structure. In many embodiments, the hosel structure 530 has an outer diameter less than 0.545 inches. For example, the hosel structure 530 can have an outer diameter less than 0.60 inches, less than 0.59 inches, less than 0.58 inches, less than 0.57 inches, less than 0.56 inches, less than 0.55 inches, less than 0.54 inches, less than 0.53 inches, less than 0.52, less than 0.51 inches, or less than 0.50 inches. In many embodiments, the outer diameter of the hosel structure 530 is reduced while maintaining adjustability of the loft angle and/or lie angle of the club head 500.

vi. Projected Area

In many embodiments, the club head 500 further comprises a front projected area and a side projected area. The front projected area is the area of the club head 500 visible from the front view, as illustrated in FIG. 1, and projected on the X'Y' plane. The side projected area is the area of the club head 500 visible from the side view and projected on the Y'Z' plane.

In many embodiments, the front projected area of the club head 500 can be between 0.00400 $m^2$ and 0.00700 $m^2$. For example, in the illustrated embodiment, the front projected area of the club head is 0.00655 $m^2$. In other embodiments, the front projected area can be between 0.00400 $m^2$ and 0.00665 $m^2$, between 0.00400 $m^2$ and 0.00675 $m^2$, between 0.00400 $m^2$ and 0.00685 $m^2$, or between 0.00400 $m^2$ and 0.00695 $m^2$.

In many embodiments, the side projected area of the club head 500 can be between 0.00500 $m^2$ and 0.00650 $m^2$. For example, in the illustrated embodiment, the front projected area of the club head is 0.00579 $m^2$. In other embodiments, the front projected area can be between 0.00545 $m^2$ and 0.00565 $m^2$, between 0.00535 $m^2$ and 0.00575 $m^2$, between 0.00525 $m^2$ and 0.00585 $m^2$, or between 0.00515 $m^2$ and 0.00595 $m^2$.

C. Balance of CG Position, Moment of Inertia, and Aerodynamic Drag

In current golf club head design, increasing or maximizing the moment of inertia of the club head and/or the head CG position can adversely affect other performance characteristics of the club head, such as aerodynamic drag. The club head 500 described herein increases or maximizes the club head moment of inertia, while simultaneously maintaining or reducing aerodynamic drag. Accordingly, the club head 500 having improved impact performance characteristics (e.g. spin, launch angle, ball speed, and forgiveness) also balances or improves swing performance characteristics (e.g. aerodynamic drag, ability to square the club head at impact, and swing speed).

In the examples of club head 300 and 500 described below, the aerodynamic drag of the club head is measured using computational fluid dynamic simulations with the front end of the club head oriented square into the airstream at an air speed of 102 miles per hour (mph). In other embodiments, the aerodynamic drag can be measured using other methods, such as using wind tunnel testing.

Figure 10A:
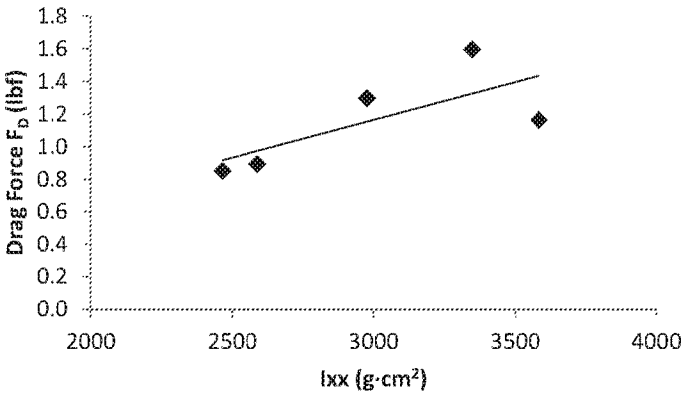
FIG. 10A illustrates a relationship between drag force and moment of inertia about the x-axis for various known golf club heads.
Figure 10B:
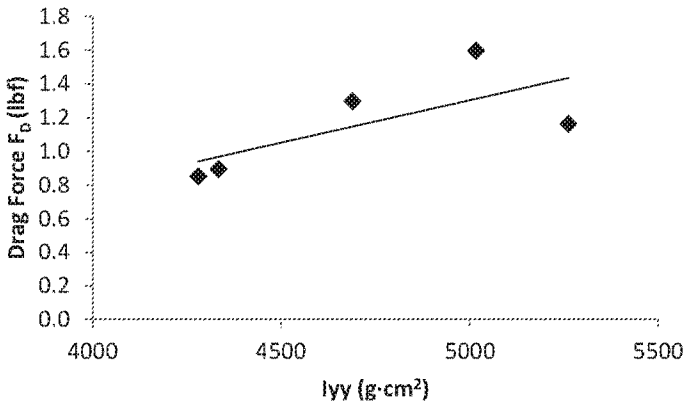
FIG. 10B illustrates a relationship between drag force and moment of inertia about the y-axis for various known golf club heads.
Figure 10C:
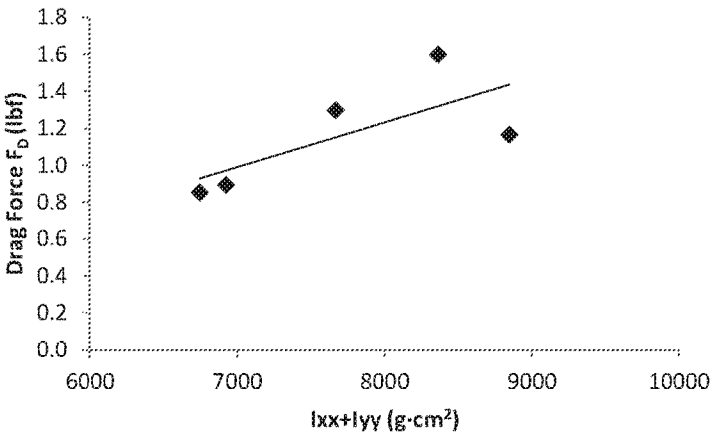
FIG. 10C illustrates a relationship between drag force and combined moment of inertia for various known golf club heads.

In many known golf club heads, increasing or maximizing the moment of inertia of the club head adversely affects aerodynamic drag. FIGS. 10A-C illustrate that for many known club heads having volume and/or loft angle similar to club head 300 or club head 500, as the club head moment of inertia increases (to increase club head forgiveness), the force of drag during a swing increases (thereby reducing swing speed and ball distance).

For example, referring to FIG. 10A, for many known club heads, as the moment of inertia about the x-axis increases, the force of drag increases. For further example, referring to FIG. 10B, for many known club heads, as the moment of inertia about the y-axis increases, the force of drag increases. For further example referring to FIG. 10C, for many known club heads, as the combined moment of inertia (i.e. the sum of the moment of inertia about the x-axis and the moment of inertia about the y-axis) increases, the force of drag increases.

The club head 300, 500 described herein increases or maximizes the club head moment of inertia compared to known club heads having similar volume and/or loft angle, while simultaneously maintaining or reducing aerodynamic drag. Accordingly, the club head 300, 500 having improved impact performance characteristics (e.g. spin, launch angle, ball speed, and forgiveness) also balances or improves swing performance characteristics (e.g. aerodynamic drag, ability to square the club head at impact, and swing speed).

Figure 11A:
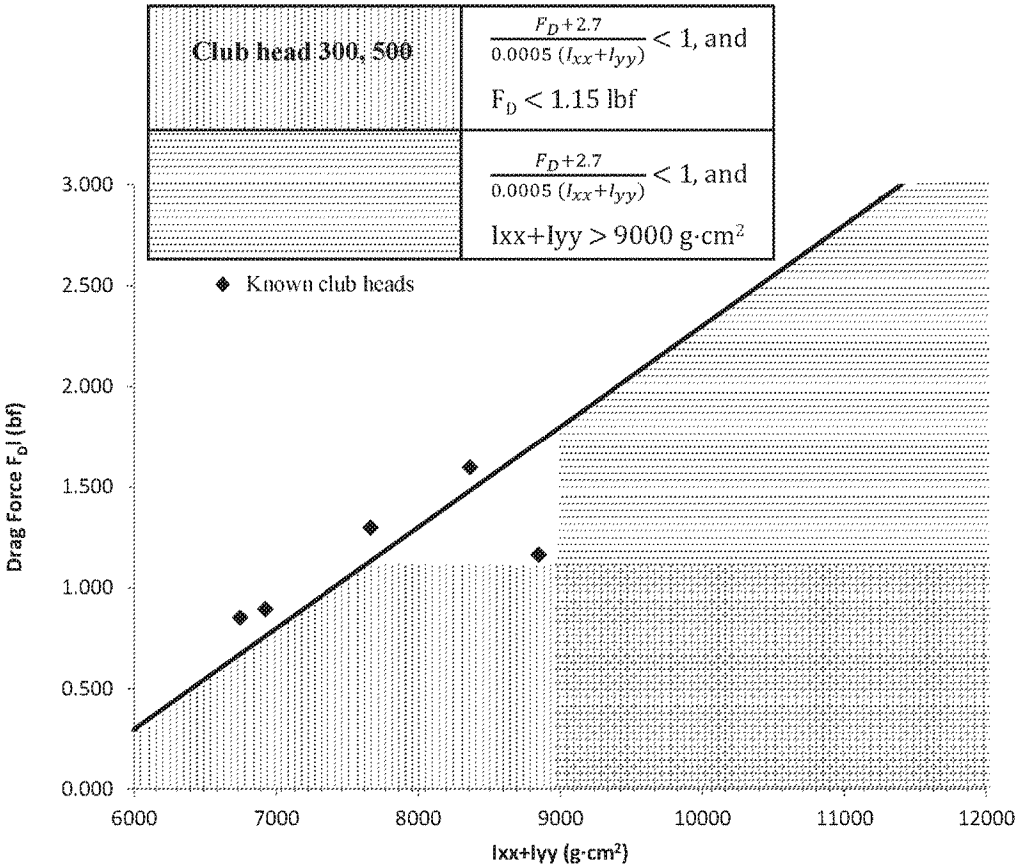
FIG. 11A illustrates a relationship between drag force and combined moment of inertia of golf club heads described herein compared to known golf club heads.
Figure 11B:
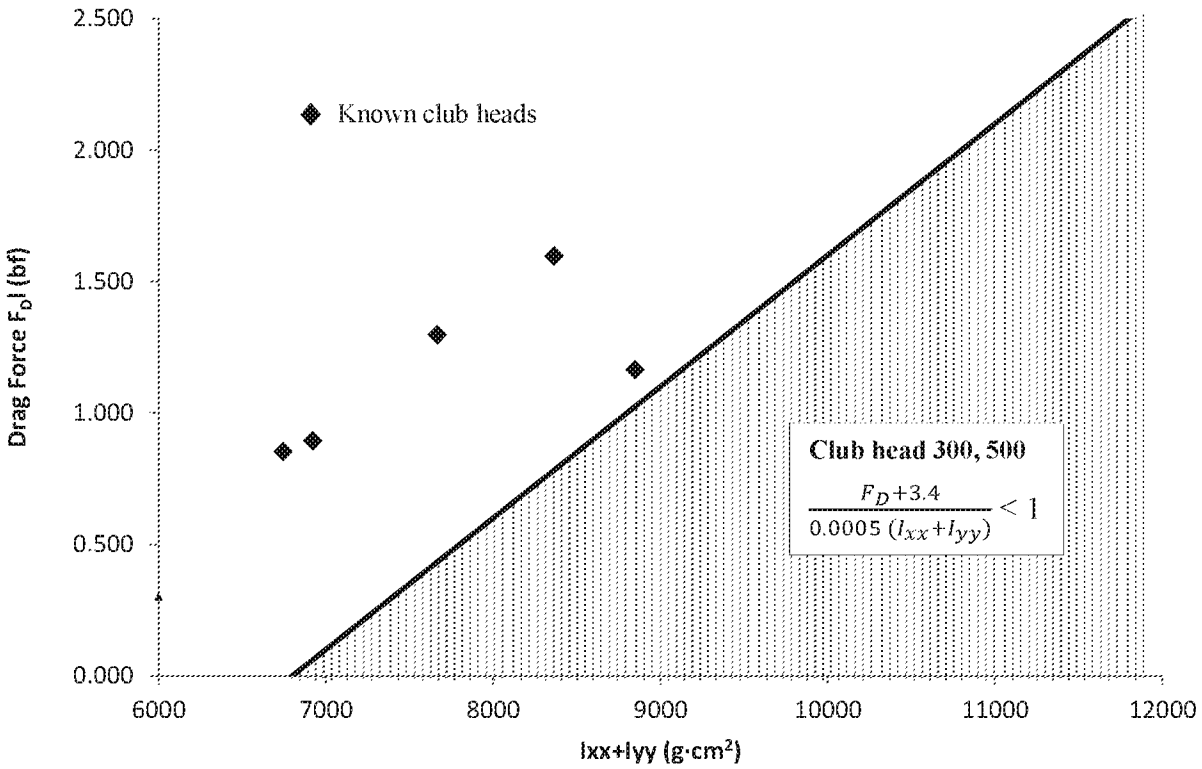
FIG. 11B illustrates a relationship between drag force and combined moment of inertia of golf club heads described herein compared to known golf club heads.
Figure 11C:
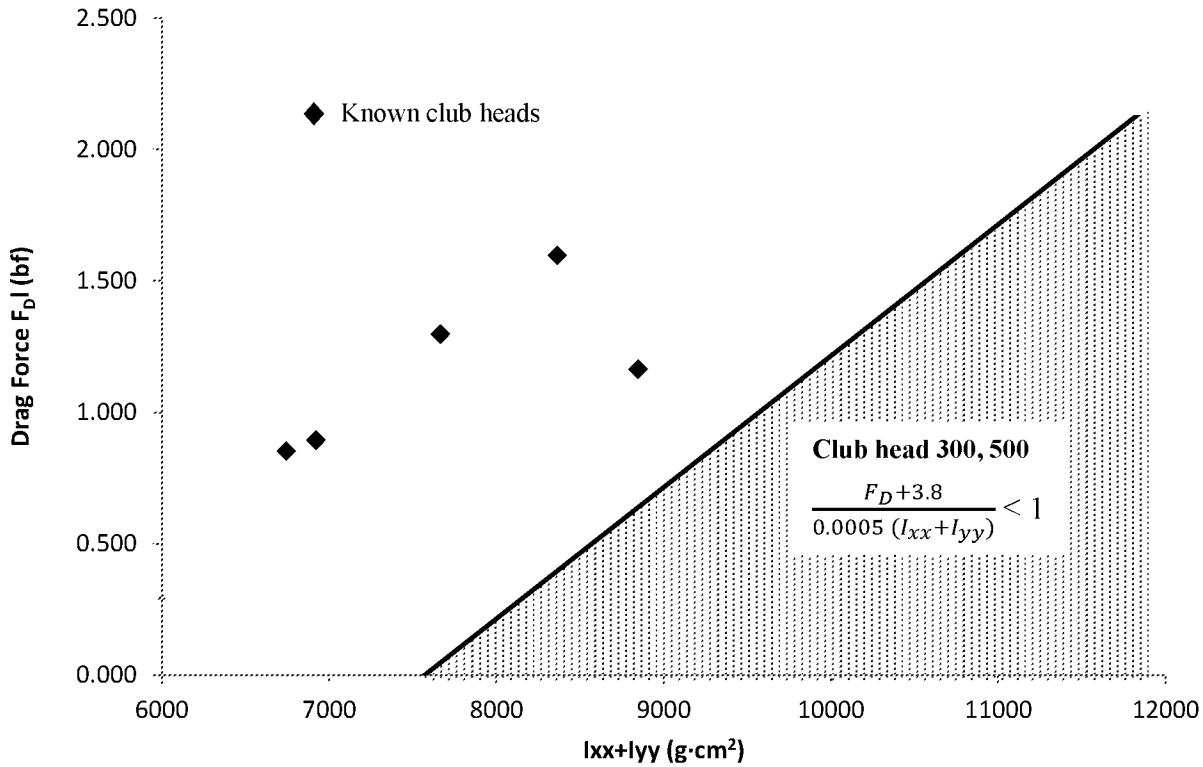
FIG. 11C illustrates a relationship between drag force and combined moment of inertia of golf club heads described herein compared to known golf club heads.

In many embodiments, referring to FIG. 11, the club head 300, 500 satisfies one or more of the following relations, such that the combined moment of inertia ($I_{xx}+I_{yy}$) of the club head is increased, while maintaining or reducing the drag force ($F_D$) on the club head, compared to known golf club heads having similar volume and/or loft angle. Specifically, FIG. 11A correlates to Relation 3, FIG. 11B correlates to Relation 4, and FIG. 11C correlates to Relation 5.

$$\frac{F_D + 2.7}{0.0005(I_{xx} + I_{yy})} < 1 \qquad \text{Relation 3}$$

$$\frac{F_D + 3.4}{0.0005(I_{xx} + I_{yy})} < 1 \qquad \text{Relation 4}$$

$$\frac{F_D + 3.8}{0.0005(I_{xx} + I_{yy})} < 1 \qquad \text{Relation 5}$$

For example, in many embodiments, the club head 300, 500 satisfies Relation 3, and has a combined moment of inertia greater than 9000 g·$cm^2$. In other embodiments, the club head 300, 500 can satisfy Relation 3, and can have a combined moment of inertia greater than 9010 g·$cm^2$, greater than 9025 g·$cm^2$, greater than 9050 g·$cm^2$, greater than 9075 g·$cm^2$, greater than 10000 g·$cm^2$, greater than 10250 g·$cm^2$, greater than 10500 g·$cm^2$, greater than 10750 g·$cm^2$, or greater than 11000 g·$cm^2$.

For further example, in many embodiments, the club head 300, 500 satisfies Relation 3, and has a drag force less than 1.16 lbf. In other embodiments, the club head 300, 500 can satisfy Relation 3, and can have a drag force less than 1.15 lbf, less than 1.10 lbf, less than 1.00 lbf, less than 0.900 lbf, less than 0.800 lbf, less than 0.75 lbf, less than 0.700 lbf, less than 0.600 lbf, or less than 0.500 lbf.

For further example, in many embodiments, the club head 300, 500 satisfies Relation 4, and has a combined moment of inertia greater than 9000 g·$cm^2$. In other embodiments, the club head 300, 500 can satisfy Relation 4, and can have a combined moment of inertia greater than 9010 g·$cm^2$, greater than 9025 g·$cm^2$, greater than 9050 g·$cm^2$, greater than 9075 g·$cm^2$, greater than 10000 g·$cm^2$, greater than 10250 g·$cm^2$, greater than 10500 g·$cm^2$, greater than 10750 g·$cm^2$, or greater than 11000 g·$cm^2$.

For further example, in many embodiments, the club head 300, 500 satisfies Relation 4, and has a drag force less than 1.16 lbf. In other embodiments, the club head 300, 500 can satisfy Relation 4, and can have a drag force less than 1.15 lbf, less than 1.10 lbf, less than 1.00 lbf, less than 0.900 lbf, less than 0.800 lbf, less than 0.75 lbf, less than 0.700 lbf, less than 0.600 lbf, or less than 0.500 lbf.

For further example, in many embodiments, the club head 300, 500 satisfies Relation 5, and has a combined moment of inertia greater than 9000 g·$cm^2$. In other embodiments, the club head 300, 500 can satisfy Relation 5, and can have a combined moment of inertia greater than 9010 g·$cm^2$, greater than 9025 g·$cm^2$, greater than 9050 g·$cm^2$, greater than 9075 g·$cm^2$, greater than 10000 g·$cm^2$, greater than 10250 g·$cm^2$, greater than 10500 g·$cm^2$, greater than 10750 g·$cm^2$, or greater than 11000 g·$cm^2$.

For further example, in many embodiments, the club head 300, 500 satisfies Relation 5, and has a drag force less than 1.16 lbf. In other embodiments, the club head 300, 500 can satisfy Relation 5, and can have a drag force less than 1.15 lbf, less than 1.10 lbf, less than 1.00 lbf, less than 0.900 lbf, less than 0.800 lbf, less than 0.75 lbf, less than 0.700 lbf, less than 0.600 lbf, or less than 0.500 lbf.

i. CG Position and Aerodynamic Drag

Figure 12:
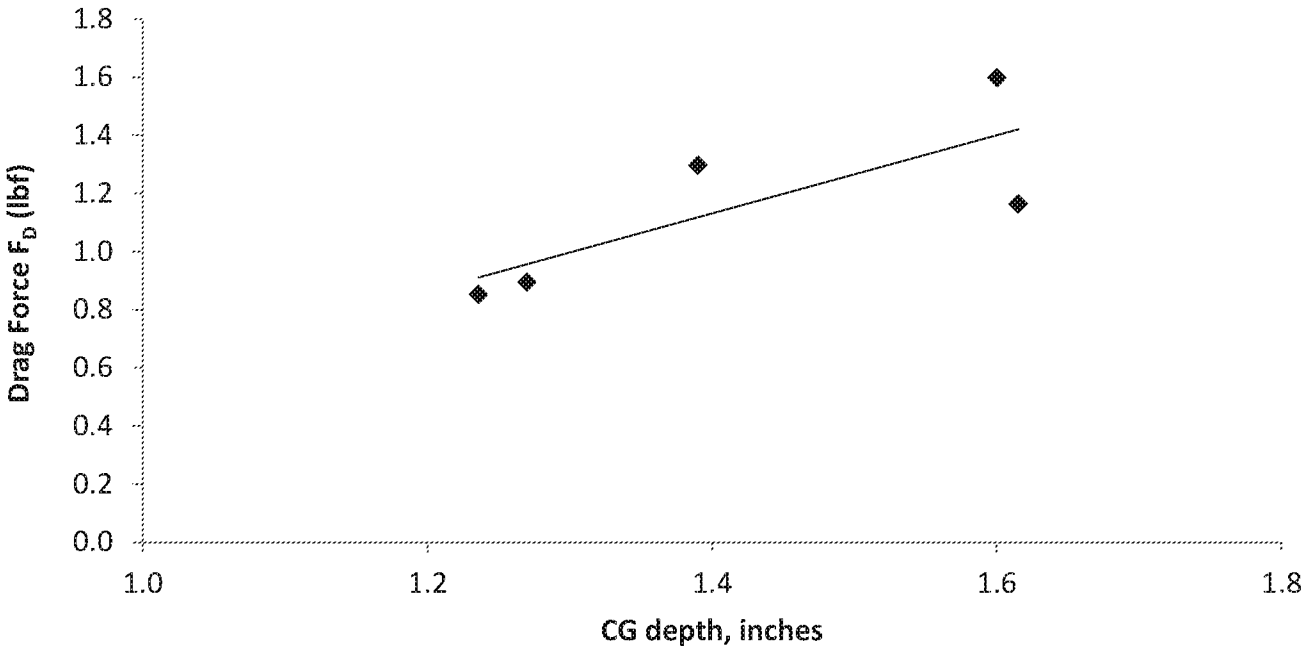
FIG. 12 illustrates a relationship between drag force and club head center of gravity depth for various known golf club heads.

In many known golf club heads, shifting the CG position farther back to increase launch angle of a golf ball and/or to increase club head inertia, can adversely affect other performance characteristics of the club head, such as aerodynamic drag. FIG. 12 illustrates that for many known club heads having a volume and/or loft angle similar to club head 300 or club head 500, as the club head CG depth increases (to increase club head forgiveness and or launch angle), the force of drag during a swing increases (thereby reducing swing speed and ball distance). For example, referring to FIG. 12, for many known club heads, as the head CG depth increases, the force of drag on the club head increases.

The club head 300, 500 described herein increases or maximizes the club head CG depth compared to known club heads having similar volume and/or loft angle, while simultaneously maintaining or reducing aerodynamic drag. Accordingly, the club head 300, 500 having improved impact performance characteristics (e.g. spin, launch angle, ball speed, and forgiveness) also balances or improves swing performance characteristics (e.g. aerodynamic drag, ability to square the club head at impact, and swing speed).

Figure 13A:
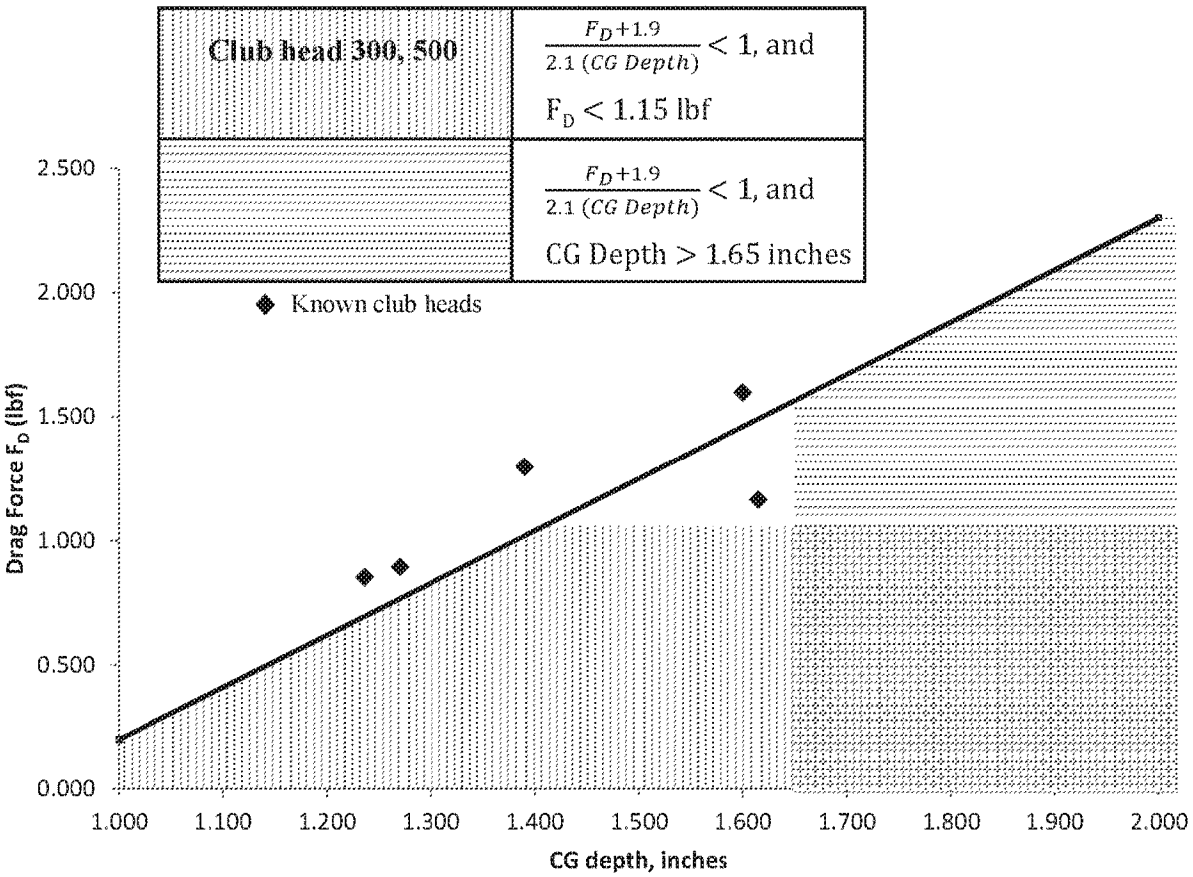
FIG. 13A illustrates a relationship between drag force and club head center of gravity depth of golf club heads described herein compared to known golf club heads.
Figure 13B:
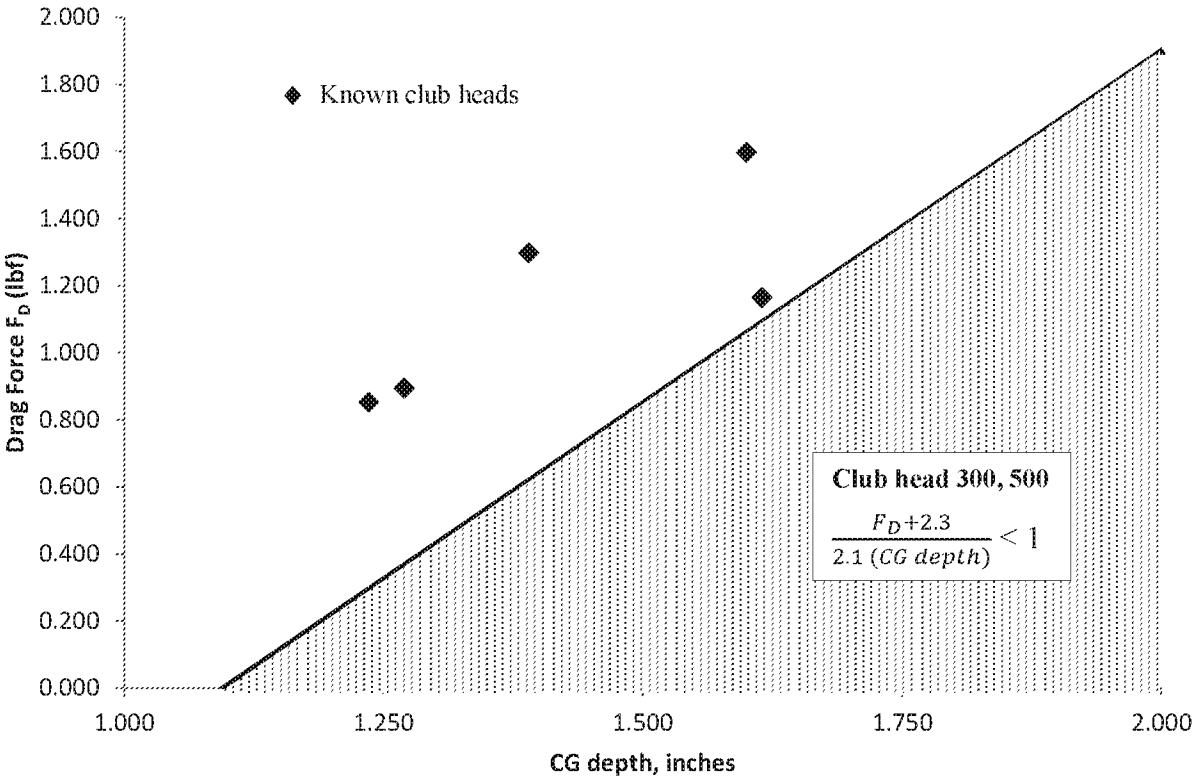
FIG. 13B illustrates a relationship between drag force and club head center of gravity depth of golf club heads described herein compared to known golf club heads.
Figure 13C:
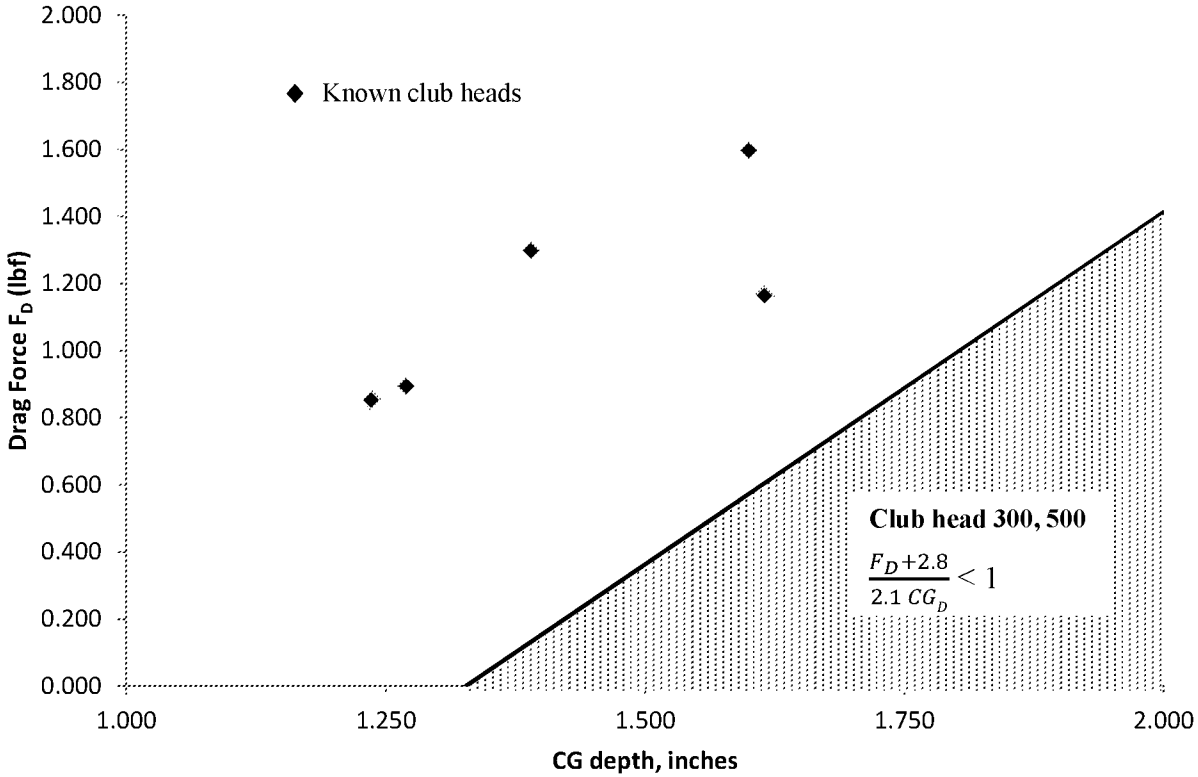
FIG. 13C illustrates a relationship between drag force and club head center of gravity depth of golf club heads described herein compared to known golf club heads.

In many embodiments, referring to FIG. 13, the club head 300, 500 satisfies one or more of the following relations, such that the head CG depth ($CG_D$) is increased, while maintaining or reducing the drag force ($F_D$) on the club head, compared to known golf club heads. Specifically, FIG. 13A correlates to Relation 6, FIG. 13B correlates to Relation 7, and FIG. 13C correlates to Relation 8.

$$\frac{F_D + 1.9}{2.1\ CG_D} < 1 \qquad \text{Relation 6}$$

$$\frac{F_D + 2.3}{2.1\ CG_D} < 1 \qquad \text{Relation 7}$$

$$\frac{F_D + 2.8}{2.1\ CG_D} < 1 \qquad \text{Relation 8}$$

For example, in many embodiments, the club head 300, 500 satisfies Relation 6, and has a head CG depth greater than 1.65 inches. In other embodiments, the club head 300, 500 can satisfy Relation 6, and can have a head CG depth greater than 1.60 inches, greater than 1.62 inches, greater than 1.64 inches, greater than 1.68 inches, greater than 1.70 inches, greater than 1.72 inches, greater than 1.74 inches, greater than 1.76 inches, greater than 1.78 inches, greater than 1.80 inches, greater than 1.85 inches, or greater than 1.90 inches.

For further example, in many embodiments, the club head 300, 500 satisfies Relation 6, and has a drag force less than 1.16 lbf. In other embodiments, the club head 300, 500 can satisfy Relation 6, and can have a drag force less than 1.15 lbf, less than 1.10 lbf, less than 1.00 lbf, less than 0.900 lbf, less than 0.800 lbf, less than 0.75 lbf, less than 0.700 lbf, less than 0.600 lbf, or less than 0.500 lbf.

For further example, in many embodiments, the club head 300, 500 satisfies Relation 7, and has a combined moment of inertia greater than 9000 g·cm$^2$. In other embodiments, the club head 300, 500 can satisfy Relation 7, and can have a head CG depth greater than 1.60 inches, greater than 1.62 inches, greater than 1.64 inches, greater than 1.68 inches, greater than 1.70 inches, greater than 1.72 inches, greater than 1.74 inches, greater than 1.76 inches, greater than 1.78 inches, greater than 1.80 inches, greater than 1.85 inches, or greater than 1.90 inches.

For further example, in many embodiments, the club head 300, 500 satisfies Relation 7, and has a drag force less than 1.16 lbf. In other embodiments, the club head 300, 500 can satisfy Relation 7, and can have a drag force less than 1.15 lbf, less than 1.10 lbf, less than 1.00 lbf, less than 0.900 lbf, less than 0.800 lbf, less than 0.75 lbf, less than 0.700 lbf, less than 0.600 lbf, or less than 0.500 lbf.

For further example, in many embodiments, the club head 300, 500 satisfies Relation 8, and has a combined moment of inertia greater than 9000 g·cm$^2$. In other embodiments, the club head 300, 500 can satisfy Relation 8, and can have a head CG depth greater than 1.60 inches, greater than 1.62 inches, greater than 1.64 inches, greater than 1.68 inches, greater than 1.70 inches, greater than 1.72 inches, greater than 1.74 inches, greater than 1.76 inches, greater than 1.78 inches, greater than 1.80 inches, greater than 1.85 inches, or greater than 1.90 inches.

For further example, in many embodiments, the club head 300, 500 satisfies Relation 8, and has a drag force less than 1.16 lbf. In other embodiments, the club head 300, 500 can satisfy Relation 8, and can have a drag force less than 1.15 lbf, less than 1.10 lbf, less than 1.00 lbf, less than 0.900 lbf, less than 0.800 lbf, less than 0.75 lbf, less than 0.700 lbf, less than 0.600 lbf, or less than 0.500 lbf.

ii. Moment of Inertia and CG Depth

Figure 14:
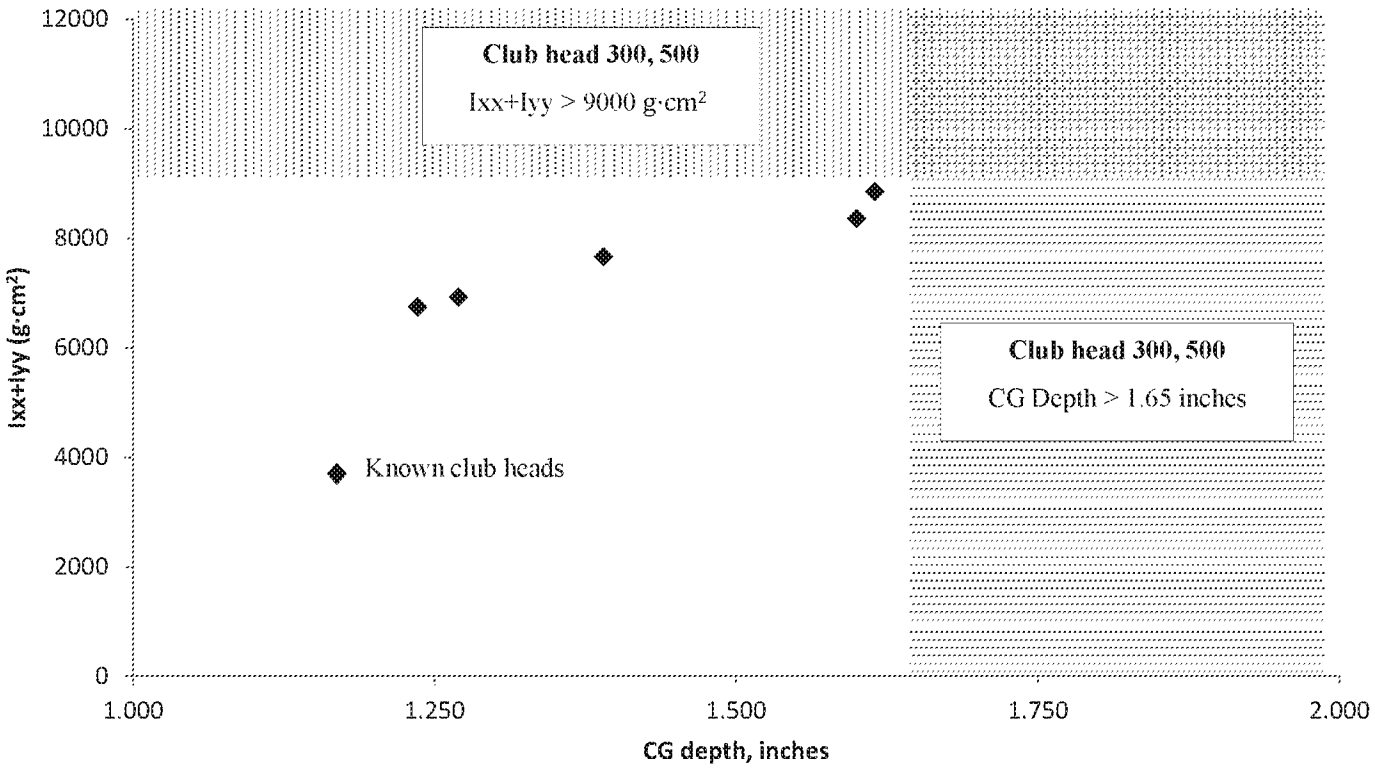
FIG. 14 illustrates a relationship between combined moment of inertia and club head center of gravity depth of golf club heads described herein compared to known golf club heads.

Referring to FIG. 14, the combined moment of inertia and/or head CG depth many known golf club heads are limited. For example, many known golf club heads having a volume and/or loft angle similar to club head 300 or club head 500 have a head CG depth less than 1.6 inches and a combined moment of inertia less than 8900 g·cm$^2$. The club head 300, 500 described herein has a greater head CG depth and a greater combined moment of inertia than known club heads having similar volume and/or loft angle, while simultaneously maintaining or reducing aerodynamic drag. Accordingly, the club head 300, 500 having improved impact performance characteristics (e.g. spin, launch angle, ball speed, and forgiveness) also balances or improves swing performance characteristics (e.g. aerodynamic drag, ability to square the club head at impact, and swing speed).

For example, in many embodiments the club head 300, 500 has a head CG depth greater than 1.65 inches and a combined moment of inertia greater than 9000 g·cm$^2$. In other embodiments, the club head 300, 500 can have a head CG depth greater than 1.60 inches, greater than 1.62 inches, greater than 1.64 inches, greater than 1.68 inches, greater than 1.70 inches, greater than 1.72 inches, greater than 1.74 inches, greater than 1.76 inches, greater than 1.78 inches, greater than 1.80 inches, greater than 1.85 inches, or greater than 1.90 inches. Further, in other embodiments, the club head 300, 500 can have a combined moment of inertia greater than 9010 g·cm$^2$, greater than 9025 g·cm$^2$, greater than 9050 g·cm$^2$, greater than 9075 g·cm$^2$, greater than 10000 g·cm$^2$, greater than 10250 g·cm$^2$, greater than 10500 g·cm$^2$, greater than 10750 g·cm$^2$, or greater than 11000 g·cm$^2$.

III. Fairway Wood-Type Club Head

According to another embodiment as illustrated in FIGS. 15-22, a golf club head 700 can comprise a fairway wood-type club head. In many embodiments, club head 700 comprises the same or similar parameters as club head 100, wherein the parameters are described with the club head 100 reference numbers plus 600.

In many embodiments, the loft angle of the club head 700 is less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the club head 700 is greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of the club head 700 can be between 12 degrees and 35 degrees, between 15 degrees and 35 degrees, between 20 degrees and 35 degrees, or between 12 degrees and 30 degrees.

In many embodiments, the volume of the club head 700 is less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In some embodiments, the volume of the club head can be approximately 150 cc-200 cc, approximately 150 cc-250 cc, approximately 150 cc-300 cc, approximately 150 cc-350 cc, approximately 150 cc-400 cc, approximately 200 cc-300 cc, approximately 200 cc-350 cc, approximately 300 cc-400 cc, approximately 325 cc-400 cc, approximately 350 cc-400 cc, approximately 250 cc-400 cc, approximately 250-350 cc, or approximately 275-375 cc. In other embodiments, the golf club head 700 can comprise any type of golf club head having a loft angle and volume as described herein.

Figure 15:
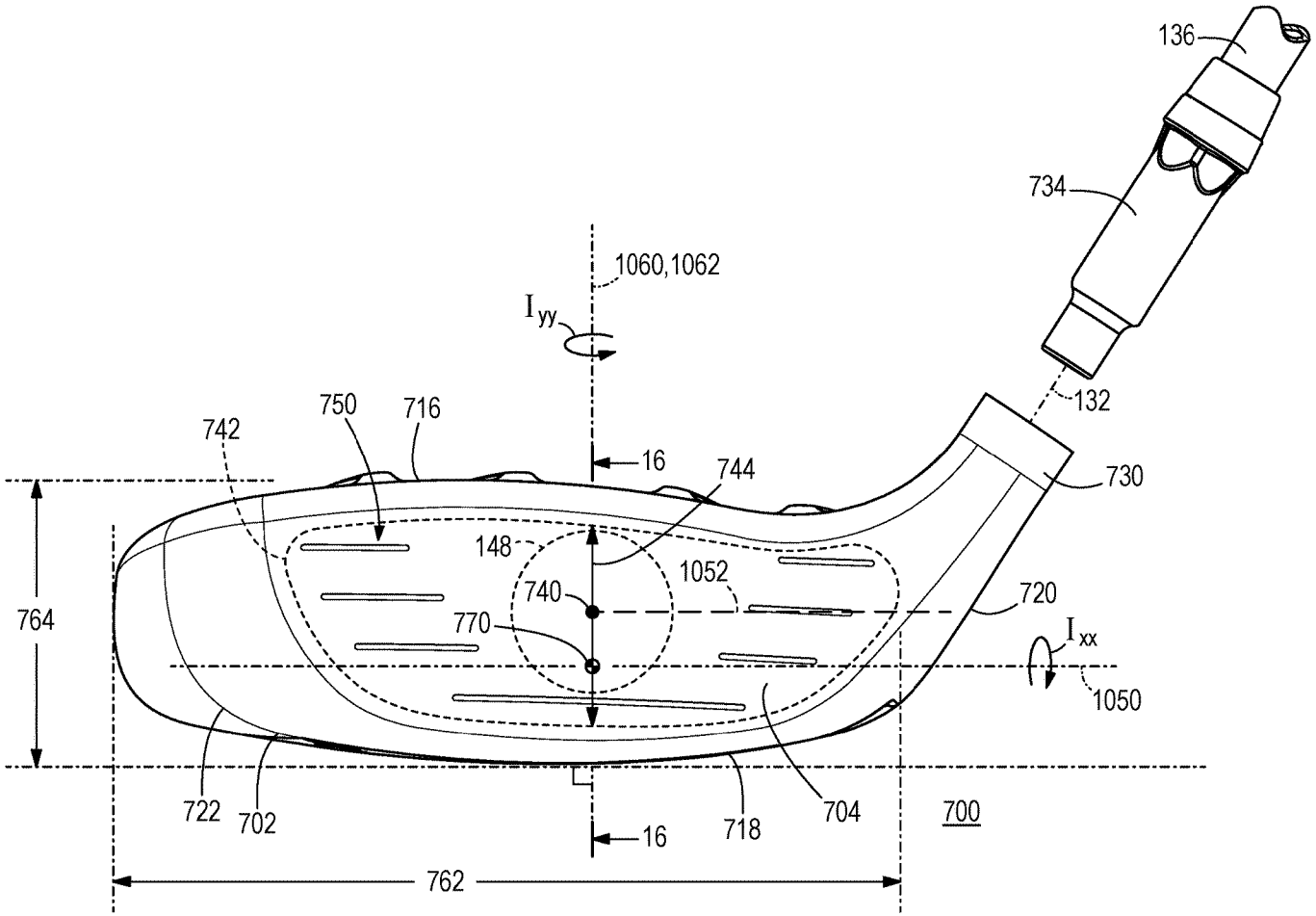
FIG. 15 is a front view of a golf club head according to another embodiment.
Figure 16:
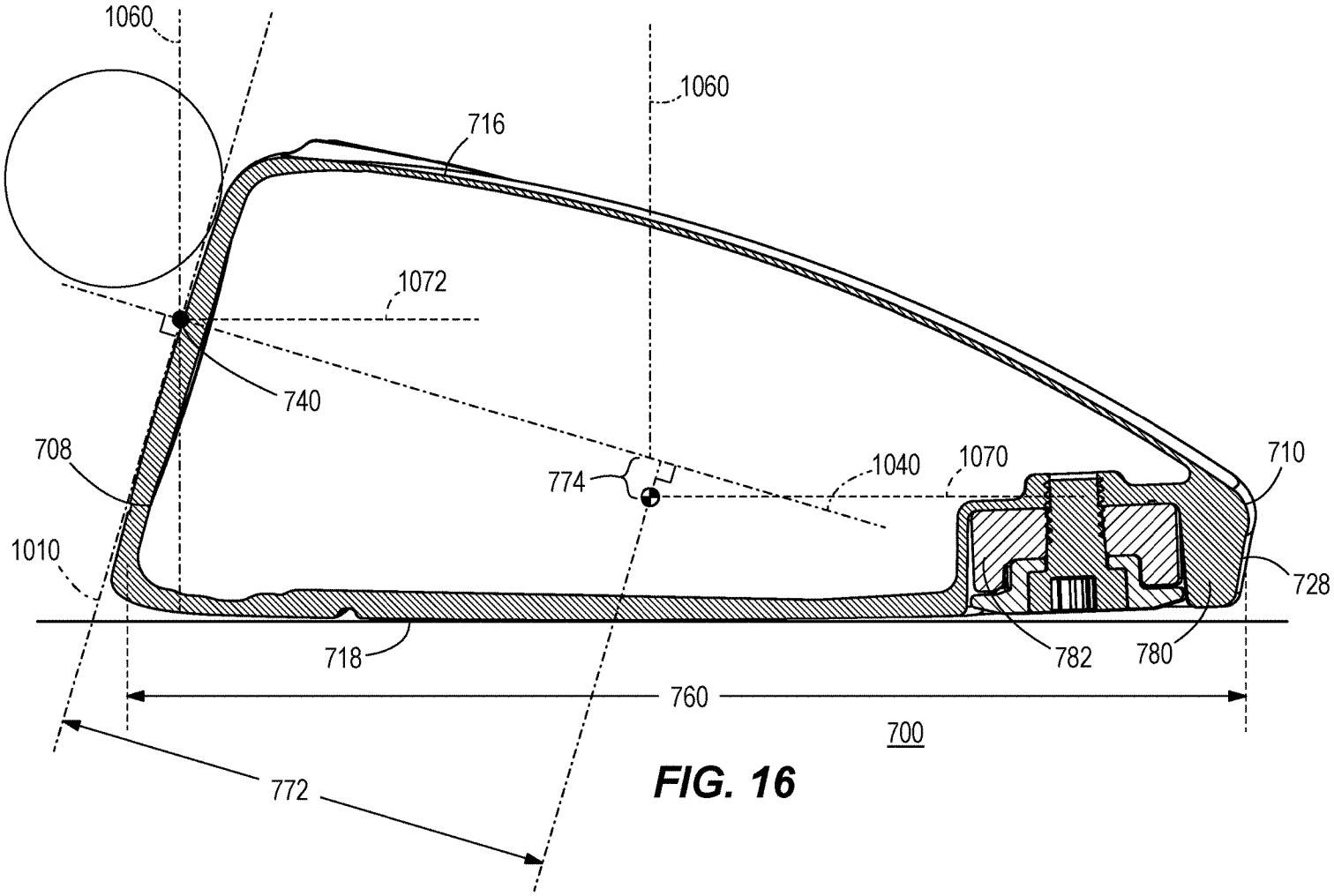
FIG. 16 is a side cross sectional view along line II-II of the golf club head in FIG. 15.

The length 762 of the club head 700 can be measured from the farthest extent of the club head 700 from the heel 720 to the toe 722, in a direction parallel to the X' axis 1052, when viewed from the front view (FIG. 15). In many embodiments, the length 762 of the club head 700 is can be between 3.5 inches and 4.75 inches, between 4.0 inches and 4.85 inches, between 3.5 inches and 5.0 inches, or between 4.0 inches and 4.5 inches. In many embodiments as illustrated in FIG. 16, the depth 760 of the club head 700 is at least 0.70 inches less than the length 362 of the club head 300. For example, in many embodiments, the depth 760 of the club head 700 can be between 2.75 inches and 4.5 inches, between 3.0 inches and 4.0 inches, between 3.0 inches and 3.75 inches, or between 3.0 inches and 4.85 inches.

The height 764 of the club head 700 can be measured as the furthest extend of the club head 700 from the crown 716 to the sole 718, in a direction parallel to the Y' axis 1062, when viewed from the front view (FIG. 15). In many embodiments, the height 764 of the club head 700 is less than approximately 2.0 inches. In other embodiments, the height 764 of the club head 700 is less than 2.5 inches, less than 2.4 inches, less than 2.3 inches, less than 2.2 inches, less than 2.1 inches, less than 1.9 inches, or less than 1.8 inches. For example, in some embodiments, the height 764 of the club head 700 can be between 1.3-1.7 inches, between 1.5-2.0 inches, between 1.75-2.5 inches, between 1.75-2.0 inches, or between 2.0-2.5 inches. Further, in many embodiments, the face height 744 of the club head can be approximately 0.5 inches (12.7 mm) to approximately 2.0 inches (50.8 mm). Further still, in many embodiments, the club head 700 can comprise a mass between 185 grams and 250 grams.

The club head 700 further comprises a balance of various additional parameters, such as head CG position, club head moment of inertia, and aerodynamic drag, to provide both improved impact performance characteristics (e.g. spin, launch angle, speed, forgiveness) and swing performance characteristics (e.g. aerodynamic drag, ability to square the club head at impact). In many embodiments, the balance of parameters described below provides improved impact performance while maintaining or improving swing performance characteristics. Further, in many embodiments, the balance of parameters described below provides improved swing performance characteristics while maintaining or improving impact performance characteristics.

A. Center of Gravity Position and Moment of Inertia

In many embodiments, a low and back club head CG and increased moment of inertia can be achieved by increasing discretionary weight and repositioning discretionary weight in regions of the club head having maximized distances from the head CG. Increasing discretionary weight can be achieved by thinning the crown and/or using optimized materials, as described above relative to the head CG position. Repositioning discretionary weight to maximize the distance from the head CG can be achieved using removable weights, embedded weights, or a steep crown angle, as described above relative to the head CG position.

In many embodiments, the club head 700 comprises a crown-to-sole moment of inertia $I_{xx}$ greater than approximately 1500 g·cm$^2$, greater than approximately 1600 g·cm$^2$, greater than approximately 1600 g·cm$^2$, greater than approximately 1650 g·cm$^2$, greater than approximately 1700 g·cm$^2$, greater than approximately 1750 g·cm$^2$, greater than approximately 1800 g·cm$^2$, greater than approximately 1850 g·cm$^2$, greater than approximately 1900 g·cm$^2$, greater than approximately 1950 g·cm$^2$, greater than approximately 2000 g·cm$^2$, greater than approximately 2100 g·cm$^2$, greater than approximately 2200 g·cm$^2$, greater than approximately 2300 g·cm$^2$, greater than approximately 2400 g·cm$^2$, greater than approximately 2500 g·cm$^2$, greater than approximately 2600 g·cm$^2$, greater than approximately 2700 g·cm$^2$, or greater than approximately 2800 g·cm$^2$.

In many embodiments, the club head 700 comprises a heel-to-toe moment of inertia $I_{yy}$ greater than approximately 3000 g·cm$^2$, greater than approximately 3100 g·cm$^2$, greater than approximately 3200 g·cm$^2$, greater than approximately 3250 g·cm$^2$, greater than approximately 3300 g·cm$^2$, greater than approximately 3400 g·cm$^2$, greater than approximately 3500 g·cm$^2$, greater than approximately 3600 g·cm$^2$, greater than approximately 3750 g·cm$^2$, greater than approximately 4000 g·cm$^2$, greater than approximately 4250 g·cm$^2$, greater than approximately 4500 g·cm$^2$, greater than approximately 4750 g·cm$^2$, greater than approximately 5000 g·cm$^2$, greater than approximately 5250 g·cm$^2$, greater than approximately 5500 g·cm$^2$, greater than approximately 5750 g·cm$^2$, greater than approximately 6000 g·cm$^2$, greater than approximately 6250 g·cm$^2$, greater than approximately 6500 g·cm$^2$, greater than approximately 6750 g·cm$^2$, or greater than approximately 7000 g·cm$^2$.

In many embodiments, the club head 700 comprises a combined moment of inertia (i.e. the sum of the crown-to-sole moment of inertia $I_{xx}$ and the heel-to-toe moment of inertia $I_{yy}$) greater than 4900 g·cm$^2$, greater than 4950 g·cm$^2$, greater than 5000 g·cm$^2$, greater than 5100 g·cm$^2$, greater than 5200 g·cm$^2$, greater than 5300 g·cm$^2$, greater than 5400 g·cm$^2$, greater than 5500 g·cm$^2$, greater than 5600 g·cm$^2$, greater than 5700 g·cm$^2$, greater than 5800 g·cm$^2$, greater than 5900 g·cm$^2$, or greater than 6000 g·cm$^2$.

In many embodiments, the club head 700 comprises a head CG height 774 less than approximately 0.50 inches, less than approximately 0.475 inches, less than approximately 0.45 inches, less than approximately 0.425 inches, less than approximately 0.40 inches, less than approximately 0.35 inches, less than approximately 0.30 inches, less than approximately 0.25 inches, less than approximately 0.20 inches, less than 0.15 inches, or less than 0.10 inches.

Further, in many embodiments, the club head 700 comprises a head CG height 774 having an absolute value less than approximately 0.50 inches, less than approximately 0.475 inches, less than approximately 0.45 inches, less than approximately 0.425 inches, less than approximately 0.40 inches, less than approximately 0.35 inches, less than approximately 0.30 inches, or less than approximately 0.25 inches.

In many embodiments, the club head 700 comprises a head CG depth 772 greater than approximately 1.0 inches, greater than approximately 1.1 inches, greater than approximately 1.22 inches, greater than approximately 1.2 inches, greater than approximately 1.3 inches, greater than approximately 1.4 inches, greater than approximately 1.5 inches, greater than approximately 1.6 inches, greater than approximately 1.7 inches, or greater than approximately 1.8 inches.

The club head 700 having the reduced head CG height 774 can reduce the backspin of a golf ball on impact compared to a similar club head having a higher head CG height. In many embodiments, reduced backspin can increase both ball speed and travel distance for improve club head performance. Further, the club head 700 having the increased head CG depth 772 can increase the heel-to-toe moment of inertia compared to a similar club head having a head CG depth closer to the strikeface. Increasing the heel-to-toe moment of inertia can increase club head forgiveness on impact to improve club head performance. Further still, the club head 700 having the increased head CG depth 772 can increase launch angle of a golf ball on impact by increasing the dynamic loft of the club head at delivery, compared to a similar club head having a head CG depth closer to the strikeface.

The head CG height 774 and/or head CG depth 772 can be achieved by reducing weight of the club head in various regions, thereby increasing discretionary weight, and repositioning discretionary weight in strategic regions of the club head to shift the head CG lower and farther back. Various means to reduce and reposition club head weight are described below.

i. Thin Regions

In some embodiments, the head CG height 772 and/or head CG depth 774 can be achieved by thinning various regions of the club head to remove excess weight. Removing excess weight results in increased discretionary weight that can be strategically repositioned to regions of the club head 700 to achieve the desired low and back club head CG position.

In many embodiments, the club head 700 can have one or more thin regions. The one or more thin regions can be similar or identical to the one or more thin regions 376 of club head 300, or the one or more thin regions of club head 500. The one or more thin regions can be positioned on the strikeface 704, the body 702, or a combination of the strikeface 704 and the body 702. Further, the one or more thin regions can be positioned on any region of the body 702, including the crown 716, the sole 718, the heel 720, the toe 722, the front end 708, the back end 710, the skirt 728, or any combination of the described positions. For example, in some embodiments, the one or more thin regions can be positioned on the crown 716. For further example, the one or more thin regions can be positioned on a combination of the strikeface 704 and the crown 716. For further example, the one or more thin regions can be positioned on a combination of the strikeface 704, the crown 716, and the sole 718. For further example, the entire body 702 and/or the entire strikeface 704 can comprise a thin region.

In embodiments where one or more thin regions are positioned on the strikeface 716, the thickness of the strikeface 704 can vary defining a maximum strikeface thickness and a minimum strikeface thickness. In these embodiments, the minimum strikeface thickness can be less than 0.10 inches, less than 0.09 inches, less than 0.08 inches, less than 0.07 inches, less than 0.06 inches, less than 0.05 inches, less than 0.04 inches, less than 0.03 inches, or less than 0.02 inches. In these or other embodiments, the maximum strikeface thickness can be less than 0.20 inches, less than 0.19 inches, less than 0.18 inches, less than 0.17 inches, less than 0.16 inches, less than 0.15 inches, less than 0.14 inches, less than 0.13 inches, less than 0.12 inches, less than 0.11 inches, or less than 0.10 inches.

In embodiments where one or more thin regions are positioned on the body 302, the thin regions can comprise a thickness less than approximately 0.022 inches. In other embodiments, the thin regions comprise a thickness less than 0.025 inches, less than 0.020 inches, less than 0.019 inches, less than 0.018 inches, less than 0.017 inches, less than 0.016 inches, less than 0.015 inches, less than 0.014 inches, less than 0.013 inches, less than 0.012 inches, or less than 0.010 inches. For example, the thin regions can comprise a thickness between approximately 0.010-0.025 inches, between approximately 0.013-0.022 inches, between approximately 0.014-0.020 inches, between approximately 0.015-0.020 inches, between approximately 0.016-0.020 inches, between approximately 0.017-0.020 inches, or between approximately 0.018-0.020 inches.

In the illustrated embodiment, the thin regions vary in shape and position and cover approximately 25% of the surface area of club head 700. In other embodiments, the thin regions can cover approximately 20-30%, approximately 15-35%, approximately 15-25%, approximately 10-25%, approximately 15-30%, or approximately 20-50% of the surface area of club head 700. Further, in other embodiments, the thin regions can cover up to 5%, up to 10%, up to 15%, up to 20%, up to 25%, up to 30%, up to 35%, up to 40%, up to 45%, or up to 50% of the surface area of club head 700.

In many embodiments, the crown 716 comprises one or more thin regions, such that approximately 51% of the surface area of the crown 716 comprises thin regions. In other embodiments, the crown 716 comprises one or more thin regions, such that up to 20%, up to 25%, up to 30%, up to 35%, up to 40%, up to 45%, up to 50%, up to 55%, up to 60%, up to 65%, up to 70%, up to 75%, up to 80%, up to 85%, or up to 90% of the crown 716 comprises thin regions. For example, in some embodiments, approximately 40-60% of the crown 716 can comprise thin regions. For further example, in other embodiments, approximately 50-100%, approximately 40-90%, approximately 35-65%, approximately 30-70%, or approximately 25-75% of the crown can comprise thin regions. In some embodiments, the crown 716 can comprise one or more thin regions, wherein each of the one or more thin regions become thinner in a gradient fashion. In this exemplary embodiment, the one or more thin regions of the crown 716 extend in a heel-to-toe direction, and each of the one or more thin regions decrease in thickness in a direction from the strikeface 704 toward the back end 710.

In many embodiments, the sole 718 comprises one or more thin regions, such that approximately 64% of the surface area of the sole 718 comprises thin regions. In other embodiments, the sole 718 comprises one or more thin regions, such that up to 20%, up to 25%, up to 30%, up to 35%, up to 40%, up to 45%, up to 50%, up to 55%, up to 60%, up to 65%, up to 70%, up to 75%, up to 80%, up to 85%, or up to 90% of the sole 718 comprises thin regions. For example, in some embodiments, approximately 40-60% of the sole 718 can comprise thin regions. For further example, in other embodiments, approximately 50-100%, approximately 40-90%, approximately 35-65%, approximately 30-70%, or approximately 25-75% of the sole 718 can comprise thin regions.

The thinned regions can comprise any shape, such as circular, triangular, square, rectangular, ovular, or any other polygon or shape with at least one curved surface. Further, one or more thinned regions can comprise the same shape as or a different shape than the remaining thinned regions.

In many embodiments, club head 700 having thin regions can be manufacturing using centrifugal casting. In these embodiments, centrifugal casting allows the club head 700 to have thinner walls than a club head manufactured using conventional casting. In other embodiments, portions of the club head 700 having thin regions can be manufactured using other suitable methods, such as stamping, forging, or machining. In embodiments where portions of the club head 700 having thin regions are manufactured using stamping, forging, or machining, the portions of the club head 700 can be coupled using epoxy, tape, welding, mechanical fasteners, or other suitable methods.

ii. Optimized Materials

In some embodiments, the strikeface 704 and/or the body 702 can comprise an optimized material having increased specific strength and/or increased specific flexibility. The specific flexibility is measured as a ratio of the yield strength to the elastic modulus of the optimized material. Increasing specific strength and/or specific flexibility can allow portions of the club head to be thinned, while maintaining durability.

In some embodiments, the first material of the strikeface 704 can be an optimized material, as described in U.S. Provisional Patent Appl. No. 62/399,929, entitled "Golf Club Heads with Optimized Material Properties." In these or other embodiments, the first material comprising an optimized titanium alloy can have a specific strength greater than or equal to approximately 900,000 PSI/lb/in$^3$ (224 MPa/g/cm$^3$), greater than or equal to approximately 910,000 PSI/lb/in$^3$ (227 MPa/g/cm$^3$), greater than or equal to approximately 920,000 PSI/lb/in$^3$ (229 MPa/g/cm$^3$), greater than or equal to approximately 930,000 PSI/lb/in$^3$ (232 MPa/g/cm$^3$), greater than or equal to approximately 940,000 PSI/lb/in$^3$ (234 MPa/g/cm$^3$), greater than or equal to approximately 950,000 PSI/lb/in$^3$ (237 MPa/g/cm$^3$), greater than or equal to approximately 960,000 PSI/lb/in$^3$ (239 MPa/g/cm$^3$), greater than or equal to approximately 970,000 PSI/lb/in$^3$ (242 MPa/g/cm$^3$), greater than or equal to approximately 980,000 PSI/lb/in$^3$ (244 MPa/g/cm$^3$), greater than or equal to approximately 990,000 PSI/lb/in$^3$ (247 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), greater than or equal to approximately 1,100,000 PSI/lb/in$^3$ (274 MPa/g/cm$^3$), or greater than or equal to approximately 1,150,000 PSI/lb/in$^3$ (286 MPa/g/cm$^3$).

Further, in these or other embodiments, the first material comprising an optimized titanium alloy can have a specific flexibility greater than or equal to approximately 0.0075, greater than or equal to approximately 0.0080, greater than or equal to approximately 0.0085, greater than or equal to approximately 0.0090, greater than or equal to approximately 0.0091, greater than or equal to approximately 0.0092, greater than or equal to approximately 0.0093, greater than or equal to approximately 0.0094, greater than or equal to approximately 0.0095, greater than or equal to approximately 0.0096, greater than or equal to approximately 0.0097, greater than or equal to approximately 0.0098, greater than or equal to approximately 0.0099, greater than or equal to approximately 0.0100, greater than or equal to approximately 0.0105, greater than or equal to approximately 0.0110, greater than or equal to approximately 0.0115, or greater than or equal to approximately 0.0120.

In these or other embodiments, the first material comprising an optimized steel alloy can have a specific strength greater than or equal to approximately 650,000 PSI/lb/in$^3$ (162 MPa/g/cm$^3$), greater than or equal to approximately 700,000 PSI/lb/in$^3$ (174 MPa/g/cm$^3$), greater than or equal to approximately 750,000 PSI/lb/in$^3$ (187 MPa/g/cm$^3$), greater than or equal to approximately 800,000 PSI/lb/in$^3$ (199 MPa/g/cm$^3$), greater than or equal to approximately 810,000 PSI/lb/in$^3$ (202 MPa/g/cm$^3$), greater than or equal to approximately 820,000 PSI/lb/in$^3$ (204 MPa/g/cm$^3$), greater than or equal to approximately 830,000 PSI/lb/in$^3$ (207 MPa/g/cm$^3$), greater than or equal to approximately 840,000 PSI/lb/in$^3$ (209 MPa/g/cm$^3$), greater than or equal to approximately 850,000 PSI/lb/in$^3$ (212 MPa/g/cm$^3$), greater than or equal to approximately 900,000 PSI/lb/in$^3$ (224 MPa/g/cm$^3$), greater than or equal to approximately 950,000 PSI/lb/in$^3$ (237 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), greater than or equal to approximately 1,100,000 PSI/lb/in$^3$ (274 MPa/g/cm$^3$), greater than or equal to approximately 1,115,000 PSI/lb/in$^3$ (278 MPa/g/cm$^3$), or greater than or equal to approximately 1,120,000 PSI/lb/in$^3$ (279 MPa/g/cm$^3$).

Further, in these or other embodiments, the first material comprising an optimized steel alloy can have a specific flexibility greater than or equal to approximately 0.0060, greater than or equal to approximately 0.0065, greater than or equal to approximately 0.0070, greater than or equal to approximately 0.0075, greater than or equal to approximately 0.0080, greater than or equal to approximately 0.0085, greater than or equal to approximately 0.0090, greater than or equal to approximately 0.0095, greater than or equal to approximately 0.0100, greater than or equal to approximately 0.0105, greater than or equal to approximately 0.0110, greater than or equal to approximately 0.0115, greater than or equal to approximately 0.0120, greater than or equal to approximately 0.0125, greater than or equal to approximately 0.0130, greater than or equal to approximately 0.0135, greater than or equal to approximately 0.0140, greater than or equal to approximately 0.0145, or greater than or equal to approximately 0.0150.

In these embodiments, the increased specific strength and/or increased specific flexibility of the optimized first material allow the strikeface 704, or portions thereof, to be thinned, as described above, while maintaining durability. Thinning of the strikeface 704 can reduce the weight of the strikeface 704, thereby increasing discretionary weight to be strategically positioned in other areas of the club head 700 to position the head CG low and back and/or increase the club head moment of inertia.

In some embodiments, the second material of the body 702 can be an optimized material, as described in U.S. Provisional Patent Appl. No. 62/399,929, entitled "Golf Club Heads with Optimized Material Properties." In these or other embodiments, the second material comprising an optimized titanium alloy can have a specific strength greater than or equal to approximately 730,500 PSI/lb/in$^3$ (182 MPa/g/cm$^3$). For example, the specific strength of the optimized titanium alloy can be greater than or equal to approximately 650,000 PSI/lb/in$^3$ (162 MPa/g/cm$^3$), greater than or equal to approximately 700,000 PSI/lb/in$^3$ (174 MPa/g/cm$^3$), greater than or equal to approximately 750,000 PSI/lb/in$^3$ (187 MPa/g/cm$^3$), greater than or equal to approximately 800,000 PSI/lb/in$^3$ (199 MPa/g/cm$^3$), greater than or equal to approximately 850,000 PSI/lb/in$^3$ (212 MPa/g/cm$^3$), greater than or equal to approximately 900,000 PSI/lb/in$^3$ (224 MPa/g/cm$^3$), greater than or equal to approximately 950,000 PSI/lb/in$^3$ (237 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), or greater than or equal to approximately 1,100,000 PSI/lb/in$^3$ (272 MPa/g/cm$^3$).

Further, in these or other embodiments, the second material comprising an optimized titanium alloy can have a specific flexibility greater than or equal to approximately 0.0060, greater than or equal to approximately 0.0065, greater than or equal to approximately 0.0070, greater than or equal to approximately 0.0075, greater than or equal to approximately 0.0080, greater than or equal to approximately 0.0085, greater than or equal to approximately 0.0090, greater than or equal to approximately 0.0095, greater than or equal to approximately 0.0100, greater than or equal to approximately 0.0105, greater than or equal to approximately 0.0110, greater than or equal to approximately 0.0115, or greater than or equal to approximately 0.0120.

In these or other embodiments, the second material comprising an optimized steel can have a specific strength greater than or equal to approximately 500,000 PSI/lb/in$^3$ (125 MPa/g/cm$^3$), greater than or equal to approximately 510,000 PSI/lb/in$^3$ (127 MPa/g/cm$^3$), greater than or equal to approximately 520,000 PSI/lb/in$^3$ (130 MPa/g/cm$^3$), greater than or equal to approximately 530,000 PSI/lb/in$^3$ (132 MPa/g/cm$^3$), greater than or equal to approximately 540,000 PSI/lb/in$^3$ (135 MPa/g/cm$^3$), greater than or equal to approximately 550,000 PSI/lb/in$^3$ (137 MPa/g/cm$^3$), greater than or equal to approximately 560,000 PSI/lb/in$^3$ (139 MPa/g/cm$^3$), greater than or equal to approximately 570,000 PSI/lb/in$^3$ (142 MPa/g/cm$^3$), greater than or equal to approximately 580,000 PSI/lb/in$^3$ (144 MPa/g/cm$^3$), greater than or equal to approximately 590,000 PSI/lb/in$^3$ (147 MPa/g/cm$^3$), greater than or equal to approximately 600,000 PSI/lb/in$^3$ (149 MPa/g/cm$^3$), greater than or equal to approximately 625,000 PSI/lb/in$^3$ (156 MPa/g/cm$^3$), greater than or equal to approximately 675,000 PSI/lb/in$^3$ (168 MPa/g/cm$^3$), greater than or equal to approximately 725,000 PSI/lb/in$^3$ (181 MPa/g/cm$^3$), greater than or equal to approximately 775,000 PSI/lb/in$^3$ (193 MPa/g/cm$^3$), greater than or equal to approximately 825,000 PSI/lb/in$^3$ (205 MPa/g/cm$^3$), greater than or equal to approximately 875,000 PSI/lb/in$^3$ (218 MPa/g/cm$^3$), greater than or equal to approximately 925,000 PSI/lb/in$^3$ (230 MPa/g/cm$^3$), greater than or equal to approximately 975,000 PSI/lb/in$^3$ (243 MPa/g/cm$^3$), greater than or equal to approximately 1,025,000 PSI/lb/in$^3$ (255 MPa/g/cm$^3$), greater than or equal to approximately 1,075,000 PSI/lb/in$^3$ (268 MPa/g/cm$^3$), or greater than or equal to approximately 1,125,000 PSI/lb/in$^3$ (280 MPa/g/cm$^3$).

Further, in these or other embodiments, the second material comprising an optimized steel can have a specific flexibility greater than or equal to approximately 0.0060, greater than or equal to approximately 0.0062, greater than or equal to approximately 0.0064, greater than or equal to approximately 0.0066, greater than or equal to approximately 0.0068, greater than or equal to approximately 0.0070, greater than or equal to approximately 0.0072, greater than or equal to approximately 0.0076, greater than or equal to approximately 0.0080, greater than or equal to approximately 0.0084, greater than or equal to approximately 0.0088, greater than or equal to approximately 0.0092, greater than or equal to approximately 0.0096, greater than or equal to approximately 0.0100, greater than or equal to approximately 0.0105, greater than or equal to approximately 0.0110, greater than or equal to approximately 0.0115, greater than or equal to approximately 0.0120, greater than or equal to approximately 0.0125, greater than or equal to approximately 0.0130, greater than or equal to approximately 0.0135, greater than or equal to approximately 0.0140, greater than or equal to approximately 0.0145, or greater than or equal to approximately 0.0150.

In these embodiments, the increased specific strength and/or increased specific flexibility of the optimized second material allow the body 702, or portions thereof, to be thinned, while maintaining durability. Thinning of the body 702 can reduce club head weight, thereby increasing discretionary weight to be strategically positioned in other areas of the club head 700 to position the head CG low and back and/or increase the club head moment of inertia.

iii. Removable Weights

In some embodiments, the club head 700 can include one or more weight structures 780 comprising one or more removable weights 782. The one or more weight structures 780 and/or the one or more removable weights 782 can be located towards the sole 718 and towards the back end 710, thereby positioning the discretionary weight on the sole 718 and near the back end 710 of the club head 700 to achieve a low and back head CG position. In many embodiments, the one or more weight structures 780 removably receive the one or more removable weights 782. In these embodiments, the one or more removable weights 782 can be coupled to the one or more weight structures 780 using any suitable method, such as a threaded fastener, an adhesive, a magnet, a snap fit, or any other mechanism capable of securing the one or more removable weights 782 to the one or more weight structures 780.

Figure 17:
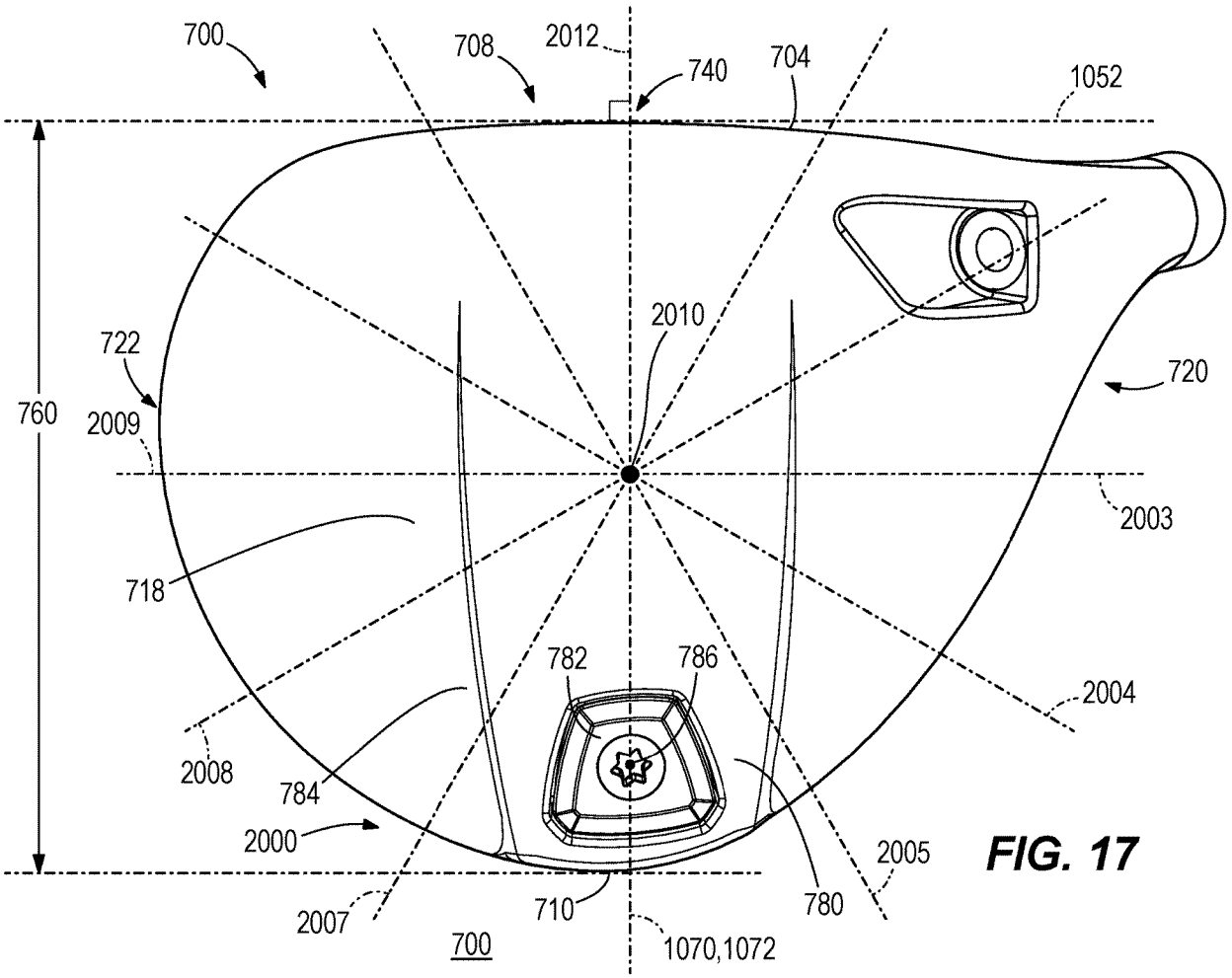
FIG. 17 is a bottom view of the golf club head in FIG. 15.

The weight structure 780 and/or removable weight 782 can be located relative to a clock grid 2000 (illustrated in FIG. 17), which can be aligned with respect to the strikeface 704 when viewed from a top view. The clock grid comprises at least a 12 o'clock ray, a 3 o'clock ray, a 4 o'clock ray, a 5 o'clock ray, a 6 o'clock ray, a 7 o'clock ray, a 8 o'clock ray, and a 9 o'clock ray. For example, the clock grid 2000 comprises a 12 o'clock ray 2012, which is aligned with the geometric center 740 of the strikeface 704. The 12 o'clock ray 2012 is orthogonal to the X'Y' plane. Clock grid 2000 can be centered along 12 o'clock ray 2012, at a midpoint between the front end 708 and back end 710 of the club head 700. In the same or other examples, clock grid centerpoint 2010 can be centered proximate to a geometric centerpoint of golf club head 700 when viewed from a bottom view (FIG. 17). The clock grid 2000 also comprises a 3 o'clock ray 2003 extending towards the heel 720, and a 9 o'clock ray 2009 extending towards the toe 722 of the club head 700.

A weight perimeter 784 of the weight structure 780 is located in the present embodiment towards the back end 710, at least partially bounded between a 4 o'clock ray 2004 and 8 o'clock ray 2008 of clock grid 2000, while a weight center 786 of a removable weight 782 positioned within weight structure 780 is located between a 5 o'clock ray 2005 and a 7 o'clock ray 2007. In examples such as the present one, the weight perimeter 784 is fully bounded between the 4 o'clock ray 2004 and the 8 o'clock ray 2008. Although the weight perimeter 784 is defined external to the club head 700 in the present example, there can be other examples where the weight perimeter 784 may extend into an interior of, or be defined within, the club head 700. In some examples, the location of the weight structure 780 can be established with respect to a broader area. For instance, in such examples, the weight perimeter 784 of the weight structure 780 can be located towards the back end, at least partially bounded between the 4 o'clock ray 2004 and 9 o'clock ray 2009 of the clock grid 2000, while the weight center 786 can be located between the 5 o'clock ray 2005 and 8 o'clock ray 2008.

In the present example, the weight structure 780 protrudes from the external contour of the sole 718, and is thus at least partially external to allow for greater adjustment of the head CG 770. In some examples, the weight structure 780 can comprise a mass of approximately 2 grams to approximately 50 grams, and/or a volume of approximately 1 cc to approximately 30 cc. In other examples, the weight structure 780 can remain flush with the external contour of the body 702.

In many embodiments, the removable weight 782 can comprise a mass of approximately 0.5 grams to approximately 30 grams, and can be replaced with one or more other similar removable weights to adjust the location of the head CG 770. In the same or other examples, the weight center 786 can comprise at least one of a center of gravity of the removable weight 782, and/or a geometric center of removable weight 782.

iv. Embedded Weights

In some embodiments, the club head 700 can include one or more embedded weights to position the discretionary weight on the sole 718, in the skirt 728, and/or near the back end 710 of the club head 700 to achieve a low and back head CG position. The one or more embedded weights of club head 700 can be similar or identical to the one or more embedded weights 383 of club head 300, or the one or more embedded weights of club head 500. In many embodiments, the one or more embedded weights are permanently fixed to or within the club head 700. In these embodiments, the embedded weight can be similar to the high density metal piece (HDMP) described in U.S. Provisional Patent Appl. No. 62/372,870, entitled "Embedded High Density Casting."

In many embodiments, the one or more embedded weights are positioned near the back end 710 of the club head. For example, a weight center of the embedded weight can be 2005 and 8 o'clock ray 2008 of the clock grid. In many embodiments, the one or more embedded weights can be positioned on the skirt 728 and near the back end 710 of the club head 700, on the sole 718 and near the back end 710 of the club head 700, or on the skirt 728 and the sole 718 near the back end 710 of the club head 700.

In many embodiments, the weight center of the one or more embedded weights is positioned within 0.10 inches, within 0.20 inches, within 0.30 inches, within 0.40 inches, within 0.50 inches, within 0.60 inches, within 0.70 inches, within 0.80 inches, within 0.90 inches, within 1.0 inches, within 1.1 inches, within 1.2 inches, within 1.3 inches, within 1.4 inches, or within 1.5 inches of a perimeter of the club head 700 when viewed from a top view or bottom view (FIG. 17). In these embodiments, the proximity of the embedded weight to the perimeter of the club head 700 can maximize the low and back head CG position, the crown-to-sole moment of inertia $I_{xx}$, and/or the heel-to-toe moment of inertia $I_{yy}$.

In many embodiments, the weight center of the one or more embedded weights is positioned at a distance from the head CG 770 greater than 1.6 inches, greater than 1.7 inches, greater than 1.8 inches, greater than 1.9 inches, greater than 2.0 inches, greater than 2.1 inches, greater than 2.2 inches, greater than 2.3 inches, greater than 2.4 inches, greater than 2.5 inches, greater than 2.6 inches, greater than 2.7 inches, greater than 2.8 inches, greater than 2.9 inches, or greater than 3.0 inches.

In many embodiments, the weight center of the one or more embedded weights is positioned at a distance from the geometric center 740 of the strikeface 704 greater than 4.0 inches, greater than 4.1 inches, greater than 4.2 inches, greater than 4.3 inches, greater than 4.4 inches, greater than 4.5 inches, greater than 4.6 inches, greater than 4.7 inches, greater than 4.8 inches, greater than 4.9 inches, or greater than 5.0 inches.

In many embodiments, the one or more embedded weights can comprise a mass between 3.0-90 grams. For example, in some embodiments, the one or more embedded weights can comprise a mass between 3.0-25 grams, between 10-40 grams, between 20-50 grams, between 30-60 grams, between 40-70 grams, between 50-80 grams, or between 60-90 grams. In embodiments where the one or more embedded weights include more than one weight, each of the embedded weights can comprise the same or a different mass.

In many embodiments, the one or more embedded weights can comprise a material having a specific gravity between 10.0-22.0. For example, in many embodiments, the one or more embedded weights can comprise a material having a specific gravity greater than 10.0, greater than 11.0, greater than 12.0, greater than 13.0, greater than 14.0, greater than 15.0, greater than 16.0, greater than 17.0, greater than 18.0, or greater than 19.0. In embodiments where the one or more embedded weights include more than one weight, each of the embedded weights can comprise the same or a different material.

v. Steep Crown Angle

Figure 18:
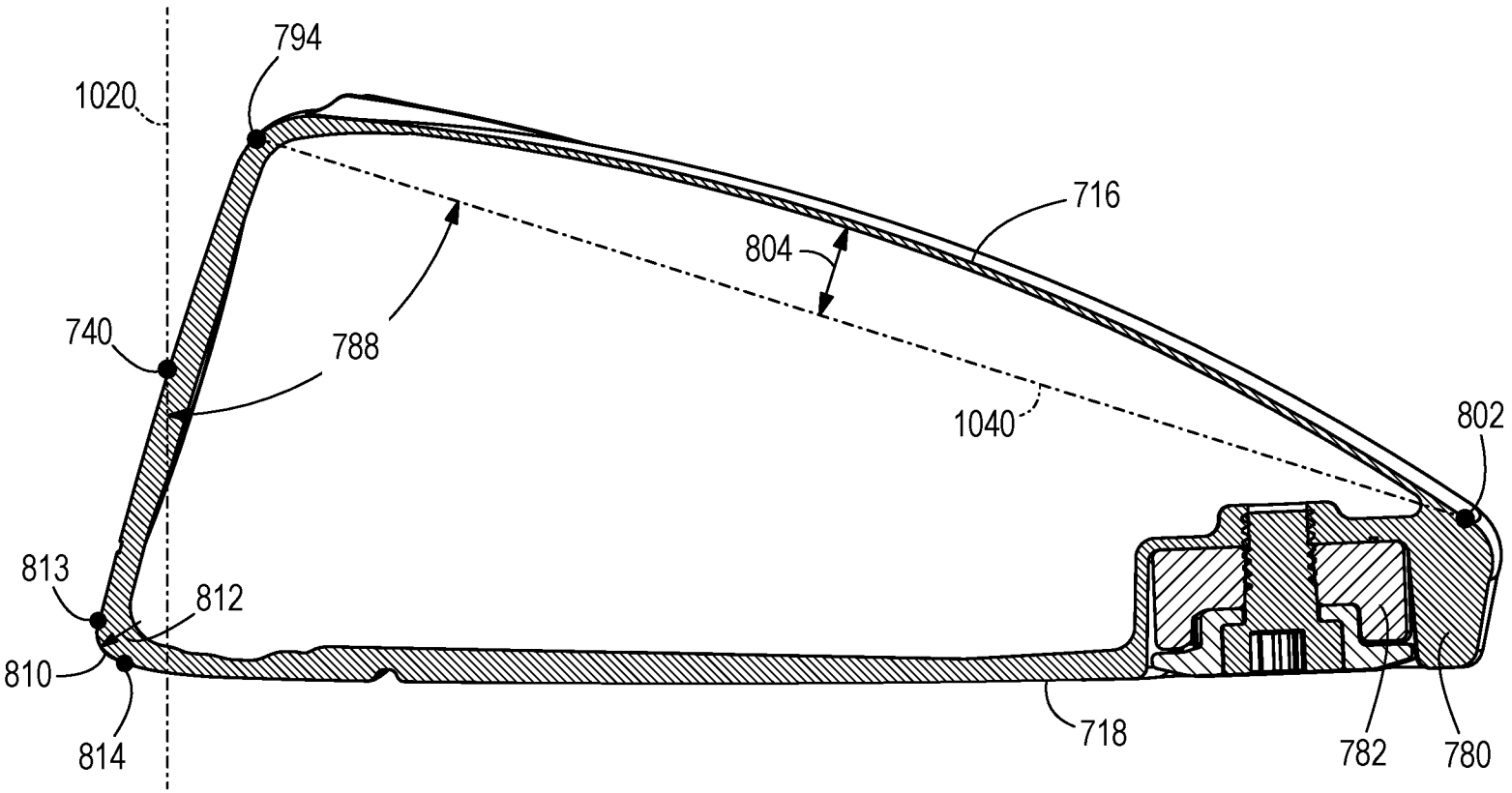
FIG. 18 is a side cross sectional view of the golf club head in FIG. 15.
Figure 19:
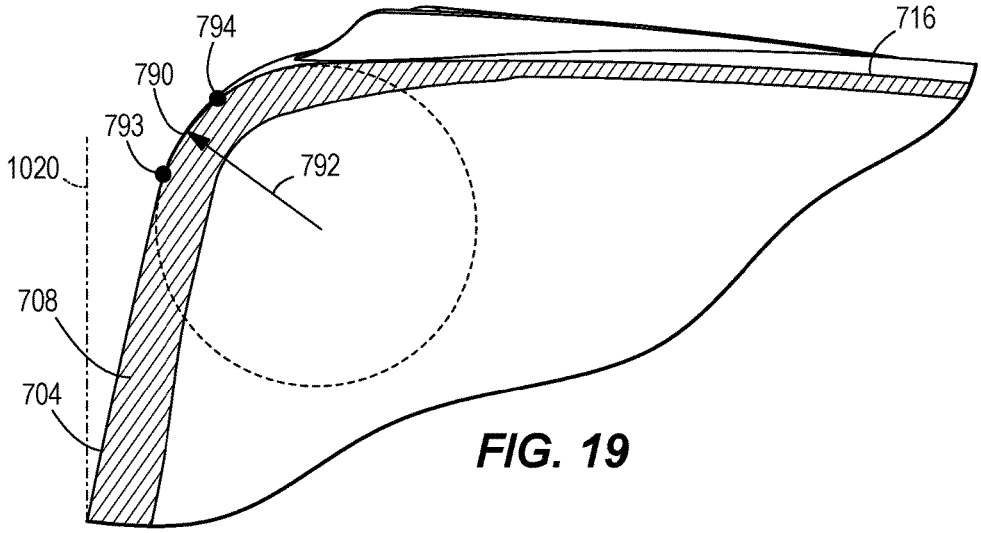
FIG. 19 is an enlarged side cross sectional view of the golf club head in FIG. 15.
Figure 20:
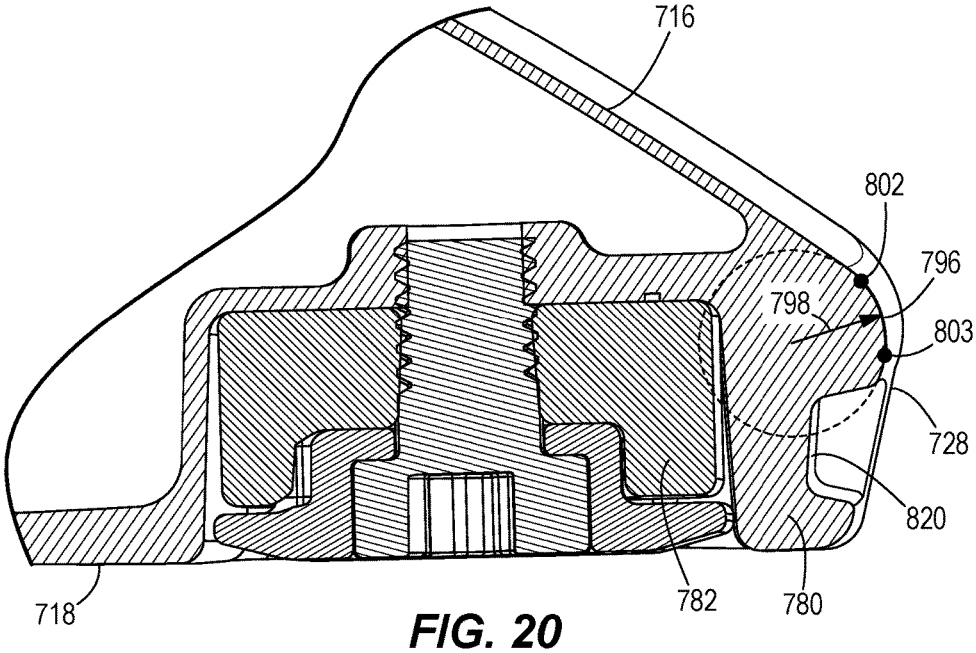
FIG. 20 is an enlarged side cross sectional view of the golf club head in FIG. 15.

In some embodiments as illustrated in FIGS. 18-20, the golf club head 700 can further include a steep crown angle 788 to achieve the low and back head CG position. The steep crown angle 788 positions the back end of the crown 716 toward the sole 718 or ground, thereby lowering the club head CG position.

The crown angle 788 is measured as the acute angle between a crown axis 1090 and the front plane 1020. In these embodiments, the crown axis 1090 is located in a cross-section of the club head 700 taken along a plane positioned perpendicular to the ground plane 1030 and the front plane 1020. The crown axis 1090 can be further described with reference to a top transition boundary and a rear transition boundary.

The club head 700 includes a top transition boundary extending between the front end 708 and the crown 716 from near the heel 720 to near the toe 722. The top transition boundary includes a crown transition profile 790 when viewed from a side cross sectional view taken along a plane perpendicular to the front plane 1020 and perpendicular to the ground plane 1030 when the club head 700 is at an address position. The side cross sectional view can be taken along any point of the club head 700 from near the heel 720 to near the toe 722. The crown transition profile 790 defines a front radius of curvature 792 extending from the front end 708 of the club head 700 where the contour departs from the roll radius and/or the bulge radius of the strikeface 704 to a crown transition point 794 indicating a change in curvature from the front radius of curvature 792 to the curvature of the crown 716. In some embodiments, the front radius of curvature 792 comprises a single radius of curvature extending from the top end 793 of the strikeface perimeter 742 near the crown 716 where the contour departs from the roll radius and/or the bulge radius of the strikeface 704 to a crown transition point 794 indicating a change in curvature from the front radius of curvature 792 to one or more curvatures of the crown 716.

The club head 700 further includes a rear transition boundary extending between the crown 716 and the skirt 728 from near the heel 720 to near the toe 722. The rear transition boundary includes a rear transition profile 796 when viewed from a side cross sectional view taken along a plane perpendicular to the front plane 1020 and perpendicular to the ground plane 1030 when the club head 700 is at an address position. The cross sectional view can be taken along any point of the club head 700 from near the heel 720 to near the toe 722. The rear transition profile 796 defines a rear radius of curvature 798 extending from the crown 716 to the skirt 728 of the club head 700 along the rear transition boundary. In many embodiments, the rear radius of curvature 798 comprises a single radius of curvature that transitions the crown 716 to the skirt 728 of the club head 700. A first rear transition point 802 is located at the junction between the crown 716 and the rear transition boundary. A second rear transition point 803 is located at the junction between the rear transition boundary and the skirt 728 of the club head 700.

The front radius of curvature 792 of the top transition boundary can remain constant, or can vary from near the heel 520 to near the toe 522 of the club head 700. Similarly, the rear radius of curvature 798 of the rear transition boundary can remain constant, or can vary from near the heel 720 to near the toe 722 of the club head 700.

The crown axis 1090 extends between the crown transition point 794 near the front end 708 of the club head 700 and the rear transition point 802 near the back end 710 of the club head 700. The crown angle 788 can remain constant, or can vary from near the heel 720 to near the toe 522 of the club head 700. For example, the crown angle 788 can vary when the side cross sectional view is taken at different locations relative to the heel 720 and the toe 722.

In many embodiments, the maximum crown angle 788 taken at any location from near the toe 722 to near the heel 720 is less than 79 degrees, less than approximately 95 degrees, less than approximately 93 degrees, less than approximately 91 degrees, less than approximately 89 degrees, less than approximately 87 degrees, less than approximately 85 degrees, less than approximately 83 degrees, less than approximately 81 degrees, less than approximately 79 degrees, less than approximately 77 degrees, or less than approximately 75 degrees. For example, in some embodiments, the maximum crown angle is between 65 degrees and 95 degrees, between 65 degrees and 90 degrees, or between 65 degrees and 85 degrees.

In many embodiments, reducing the crown angle 788 compared to current club heads generates a steeper crown or a crown positioned closer to the ground plane 1030 when the club head 700 is at an address position. Accordingly, the reduced crown angle 788 can result in a lower head CG position compared to a club head with a higher crown angle.

vi. Hosel Sleeve Weight

In some embodiments, the head CG height 774 and/or head CG depth 772 can be achieved by reducing the mass of the hosel sleeve 734. Removing excess weight from the hosel sleeve 734 results in increased discretionary weight that can be strategically repositioned to regions of the club head 700 to achieve the desired low and back club head CG position.

Reducing the mass of the hosel sleeve 734 can be achieved by thinning the sleeve walls, reducing the height of the hosel sleeve 734, reducing the diameter of the hosel sleeve 734, and/or by introducing voids in the walls of the hosel sleeve 734. In many embodiments, the mass of the hosel sleeve 734 can be less than 6 grams, less than 5.5 grams, less than 5.0 grams, less than 4.5 grams, or less than 4.0 grams. In many embodiments, the club head 700 having the reduced mass hosel sleeve can result in a lower (close to the sole) and farther back (closer to the back end) club head CG position than a similar club head with a heavier hosel sleeve.

B. Aerodynamic Drag

In many embodiments, the club head 700 comprises a low and back club head CG position and an increased club head moment of inertia, in combination with reduced aerodynamic drag.

In many embodiments, the club head 700 experiences an aerodynamic drag force less than approximately 1.25 lbf, less than 1.0 lbf, less than 0.95 lbf, less than 0.90 lbf, less than 0.85 lbf, less than 0.83 lbf, or less than 0.80 lbf when tested in a wind tunnel with a squared face and an air speed of 98 miles per hour (mph). In these or other embodiments, the club head 700 experiences an aerodynamic drag force less than approximately 1.25 lbf, less than 1.0 lbf, less than 0.95 lbf, less than 0.90 lbf, less than 0.85 lbf, less than 0.83 lbf, or less than 0.80 lbf when simulated using computational fluid dynamics with a squared face and an air speed of 98 miles per hour (mph). In these embodiments, the airflow experienced by the club head 700 having the squared face is directed at the strikeface 704 in a direction perpendicular to the X'Y' plane. The club head 700 having reduced aerodynamic drag can be achieved using various means, as described below.

i. Crown Angle Height

In some embodiments, reducing the crown angle 788 to form a steeper crown and lower head CG position may result in an undesired increase in aerodynamic drag due to increased air flow separation over the crown during a swing. To prevent increased drag associated with a reduced crown angle 788, a maximum crown height 804 can be increased. Referring to FIG. 18, the maximum crown height 804 is the greatest distance between the surface of the crown 716 and the crown axis 1090 taken at any side cross sectional view of the club head 700 along a plane positioned parallel to the Y'Z' plane. In many embodiments, a greater maximum crown height 804 results in the crown 716 having a greater curvature. A greater curvature in the crown 716 moves the location of the air flow separation during a swing further back on the club head 700. In other words, a greater curvature allows the airflow to stay attached to club head 700 for a longer distance along the crown 716 during a swing. Moving the airflow separation point back on the crown 716 can result in reduced aerodynamic drag and increased club head swing speeds, thereby resulting in increased ball speed and distance.

In many embodiments, the maximum crown height 804 can be greater than approximately 0.10 inch (2.5 mm), greater than approximately 0.20 inch (5 mm), greater than approximately 0.30 inch (7.5 mm), or greater than approximately 0.40 inch (10 mm). Further, in other embodiments, the maximum crown height 804 can be within the range of 0.10 inch (2.5 mm) to 0.40 inch (10 mm), or 0.10 inch (2.5 mm) to 0.60 inch (15 mm), or 0.20 inch (5 mm) to 0.60 inch (15 mm). For example, in some embodiments, the maximum crown height 804 can be approximately 0.20 inch (5 mm), approximately 0.24 inch (6 mm), approximately 0.28 inch (7 mm), approximately 0.31 inch (8 mm), or approximately 0.35 inch (9 mm).

ii. Transition Profiles

In many embodiments, the transition profiles of the club head 700 from the strikeface 704 to the crown 716, the strikeface 704 to the sole 718, and/or the crown 716 to the sole 718 along the back end 710 of the club head 700 can affect the aerodynamic drag on the club head 700 during a swing.

In some embodiments, the club head 700 having the top transition boundary defining the crown transition profile 790, and the rear transition boundary defining the rear transition profile 796 further includes a sole transition boundary defining a sole transition profile 810. The sole transition boundary extends between the front end 708 and the sole 718 from near the heel 720 to near the toe 720. The sole transition boundary includes a sole transition profile 810 when viewed from a side cross sectional view taken along a plane parallel to the Y'Z' plane. The side cross sectional view can be taken along any point of the club head 700 from near the heel 720 to near the toe 710. The sole transition profile 810 defines a sole radius of curvature 812 extending from the front end 708 of the club head 700 where the contour departs from the roll radius and/or the bulge radius of the strikeface 704 to a sole transition point 814 indicating a change in curvature from sole radius of curvature 812 to the curvature of the sole 718. In some embodiments, the sole radius of curvature 812 comprises a single radius of curvature extending from the bottom end 813 of the strikeface perimeter 742 near the sole 818 where the contour departs from the roll radius and/or the bulge radius of the strikeface 704 to a sole transition point 814 indicating a change in curvature from the sole radius of curvature 812 to a curvature of the sole 814.

In many embodiments, the crown transition profile 790, the sole transition profile 810, and the rear transition profile 796 can be similar to the crown transition, sole transition, and rear transition profiles described in U.S. patent Ser. No. 15/233,486, entitled "Golf Club Head with Transition Profiles to Reduce Aerodynamic Drag." Further, the front radius of curvature 792 can be similar to the first crown radius of curvature, the sole radius of curvature 812 can be similar to the first sole radius of curvature, and the rear radius of curvature 798 can be similar to the rear radius of curvature described U.S. patent Ser. No. 15/233,486, entitled "Golf Club Head with Transition Profiles to Reduce Aerodynamic Drag."

In some embodiments, the front radius of curvature 792 can range from approximately 0.10 to 0.50 inches (0.25 to 1.27 cm). Further, in other embodiments, the front radius of curvature 792 can be less than 0.40 inches (1.02 cm), less than 0.375 inches (0.95 cm), less than 0.35 inches (0.89 cm), less than 0.325 inches (0.83 cm), or less than 0.30 inches 0.76 cm). For example, the front radius of curvature 792 can be approximately 0.18 inches (0.46 cm), 0.20 inches (0.51 cm), 0.22 inches (0.66 cm), 0.24 inches (0.61 cm), 0.26 inches (0.66 cm), 0.28 inches (0.71 cm), or 0.30 inches (0.76 cm).

In some embodiments, the sole radius of curvature 812 can range from approximately 0.05 to 0.25 inches (0.13 to 0.64 cm). For example, the sole radius of curvature 812 can be less than approximately 0.3 inches (0.76 cm), less than approximately 0.275 inches (0.70 cm), less than approximately 0.25 inches (0.64 cm), less than approximately 0.2 inches (0.51 cm), less than approximately 0.15 inches (0.38 cm), or less than approximately 0.1 inches (0.25 cm). For further example, the sole radius of curvature 812 can be approximately 0.10 inches (0.25 cm), 0.15 inches (0.38 cm), 0.20 inches (0.51 cm), or 0.25 inches (0.64 cm).

In some embodiments, the rear radius of curvature 798 can range from approximately 0.10 to 0.25 inches (0.25 to 0.64 cm). For example, the rear radius of curvature 798 can be less than approximately 0.3 inches (0.76 cm), less than approximately 0.275 inches (0.70 cm), less than approximately 0.25 inches (0.64 cm), less than approximately 0.225 inches (0.57 cm), or less than approximately 0.20 inches (0.51 cm). For further example, the rear radius of curvature 798 can be approximately 0.10 inches (0.25 cm), 0.15 inches (0.38 cm), 0.20 inches (0.51 cm), or 0.25 inches (0.64 cm).

iii. Turbulators

Figure 21:
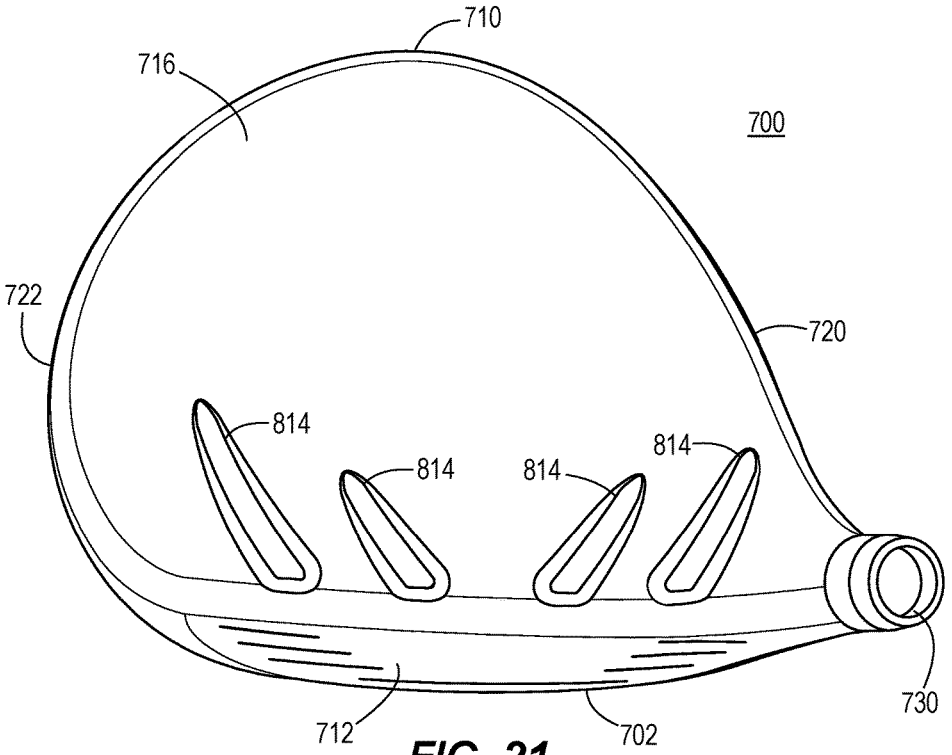
FIG. 21 is a top view of the golf club head in FIG. 15.

In some embodiments as illustrated in FIG. 21, the club head 700 can further include a plurality of turbulators 818, as described in U.S. patent application Ser. No. 13/536,753, now U.S. Pat. No. 8,608,587, granted on Dec. 17, 2013, entitled "Golf Club Heads with Turbulators and Methods to Manufacture Golf Club Heads with Turbulators," which is incorporated fully herein by reference. In many embodiments, the plurality of turbulators 814 disrupt the airflow thereby creating small vortices or turbulence inside the boundary layer to energize the boundary layer and delay separation of the airflow on the crown during a swing.

In some embodiments, the plurality of turbulators 614 can be adjacent to the crown transition point 994 of the club head 700. The plurality of turbulators 814 project from an outer surface of the crown 716 and include a length extending between the front end 708 and the back end 710 of the club head 700, and a width extending from the heel 720 to the toe 722 of the club head 722. In many embodiments, the length of the plurality of turbulators 814 is greater than the width. In some embodiments, the plurality of turbulators 814 can comprise the same width. In some embodiments, the plurality of turbulators 814 can vary in height profile. In some embodiments, the plurality of turbulators 814 can be higher toward the apex of the crown 716 than in comparison to the front of the crown 716. In other embodiments, the plurality of turbulators 814 can be higher toward the front of the crown 716, and lower in height toward the apex of the crown 716. In other embodiments, the plurality of turbulators 814 can comprise a constant height profile. Further, in many embodiments, at least a portion of at least one turbulator is located between the strikeface and an apex of the crown, and the spacing between adjacent turbulators is greater than the width of each of the adjacent turbulators.

iv. Back Cavity

Figure 22:
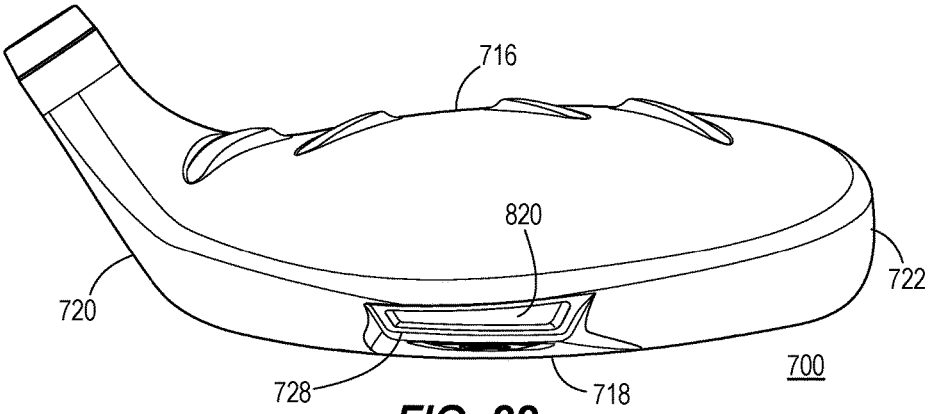
FIG. 22 is a rear view of the golf club head in FIG. 15.

In some embodiments as illustrated in FIGS. 20 and 22, the club head 700 can further include a cavity 820 located at the back end 710 and in the trailing edge 728 of the club head 700. In many embodiments, the cavity 820 can be similar to cavity 420 on club head 300 or cavity 620 on club head 500. Further, the cavity 820 can be similar to the cavity described in U.S. patent application Ser. No. 14/882,092, entitled "Golf Club Heads with Aerodynamic Features and Related Methods." In many embodiments, the cavity 820 can break the vortices generated behind golf club head 700 into smaller vortices to reduce the size of the wake and/or reduce drag. In some embodiments, breaking the vortices into smaller vortices can generate a region of high pressure behind golf club head 700. In some embodiments, this region of high pressure can push golf club head 700 forward, reduce drag, and/or enhance the aerodynamic design of golf club head 700. In many embodiments, the net effect of smaller vortices and reduced drag is an increase in the speed of golf club head 700. This effect can lead to higher speeds at which a golf ball leaves strikeface 704 after impact to increase ball travel distance.

In many embodiments, the cavity 820 can include a back wall 822 that is oriented in a direction perpendicular to the X'Z' plane and can include a width measured in a direction from the heel 720 to the toe 722, a depth 824, and a height 826. The width of the cavity 820 can be approximately 1.0 inches (approximately 2.54 centimeters (cm)) to approximately 8 inch (approximately 20.32 cm), approximately 1.0 inches (approximately 2.54 cm) to approximately 2.25 inches (approximately 5.72 cm), or approximately 1.75 inches (approximately 4.5 cm) to approximately 2.25 inches (approximately 5.72 cm). For example, the width of the cavity 820 can be approximately 2.0 inches (5.08 cm), 3.0 inches (7.62 cm), 4.0 inches (10.16 cm), 5.0 inches (12.7 cm), 6.0 inches (15.24 cm), or 7.0 inches (17.78 cm). In some embodiments, the width of the cavity 820 can remain constant from near the top of the cavity 820 (toward the crown 716 of the club head 700) to near the bottom of the cavity 820 (toward the sole 718 of the club head 700). In other embodiments, the width of the cavity 820 can vary from near the top to near the bottom. In the illustrated embodiment of FIG. 22, the width of the cavity 820 is largest near the top and smallest near the bottom. In other embodiments, the width of the cavity 820 can vary according to any profile. For example, in other embodiments, the width of the cavity 820 can be longest at the top, at the bottom, at the center, or at any other location extending from the top to the bottom of the cavity 820.

The depth 824 of the cavity 820 can be approximately 0.025 inch (approximately 0.127 cm) to approximately 0.250 inch (approximately 0.635 cm), or approximately 0.025 inch (approximately 0.127 cm) to approximately 0.150 inch (approximately 0.381 cm). For example, the depth 824 of the cavity 820 can be approximately 0.1 inch (approximately 0.254 cm), or approximately 0.05 inch (approximately 0.127 cm). In some embodiments, the depth 824 of the cavity 820 can remain constant between the heel and the toe and/or between the top and the bottom of the cavity 820. In other embodiments, the depth 824 of the cavity 820 can vary between the heel and the toe and/or between the top and the bottom of the cavity 820. For example, the depth 824 of the cavity 820 can be the largest near the heel, near the toe, near the crown, near the sole, near the center, or at any combination of the described locations.

The height 826 of the cavity 820 can be measured in a direction from the crown 716 to the sole 718. The height 826 of the cavity 820 can be approximately 0.19 inch (approximately 0.48 cm) to approximately 0.21 inch (approximately 0.53 cm). In some embodiments, the height 826 of the cavity 820 can be approximately 0.10 inch (approximately 0.25 cm) to approximately 0.50 inch (approximately 1.27 cm). In some embodiments, the height 826 of the cavity 820 can be approximately 0.10 inch (approximately 0.25 cm) to approximately 0.40 inch (approximately 1.02 cm). In some embodiments, the height 826 of the cavity 820 can be approximately 0.10 inch (approximately 0.25 cm) to approximately 0.30 inch (approximately 0.76 cm). In some embodiments, the height 826 of the cavity 820 can be approximately 0.10 inch (approximately 0.25 cm) to approximately 0.20 inch (approximately 0.51 cm). In some embodiments, the height 826 of the cavity 820 can remain constant between the heel and the toe of the cavity 820. In other embodiments, the height 826 of the cavity 820 can vary between the heel and the toe of the cavity 820. For example, the height 826 of the cavity 820 can be the largest near the heel, near the toe, near the center, or at any combination of the described locations.

v. Hosel Structure

In some embodiments, the hosel structure 730 can have a smaller outer diameter to reduce the aerodynamic drag on the club head 700 during a swing, compared to a similar club head having a larger diameter hosel structure. In many embodiments, the hosel structure 730 has an outer diameter less than 0.545 inches. For example, the hosel structure 730 can have an outer diameter less than 0.60 inches, less than 0.59 inches, less than 0.58 inches, less than 0.57 inches, less than 0.56 inches, less than 0.55 inches, less than 0.54 inches, less than 0.53 inches, less than 0.52, less than 0.51 inches, or less than 0.50 inches. In many embodiments, the outer diameter of the hosel structure 730 is reduced while maintaining adjustability of the loft angle and/or lie angle of the club head 700.

C. Balance of CG Position, Moment of Inertia, and Aerodynamic Drag

In current golf club head design, increasing or maximizing the moment of inertia of the club head can adversely affect other performance characteristics of the club head, such as aerodynamic drag. The club head 700 described herein increases or maximizes the club head moment of inertia, while simultaneously maintaining or reducing aerodynamic drag. Accordingly, the club head 700 having improved impact performance characteristics (e.g. spin, launch angle, ball speed, and forgiveness) also balances or improves swing performance characteristics (e.g. aerodynamic drag, ability to square the club head at impact, and swing speed).

In the examples of club head 700 described below, the aerodynamic drag of the club head is measured using computational fluid dynamic simulations with the front end of the club head oriented square into the airstream at an air speed of 102 miles per hour (mph). In other embodiments, the aerodynamic drag can be measured using other methods, such as using wind tunnel testing.

Figure 23A:
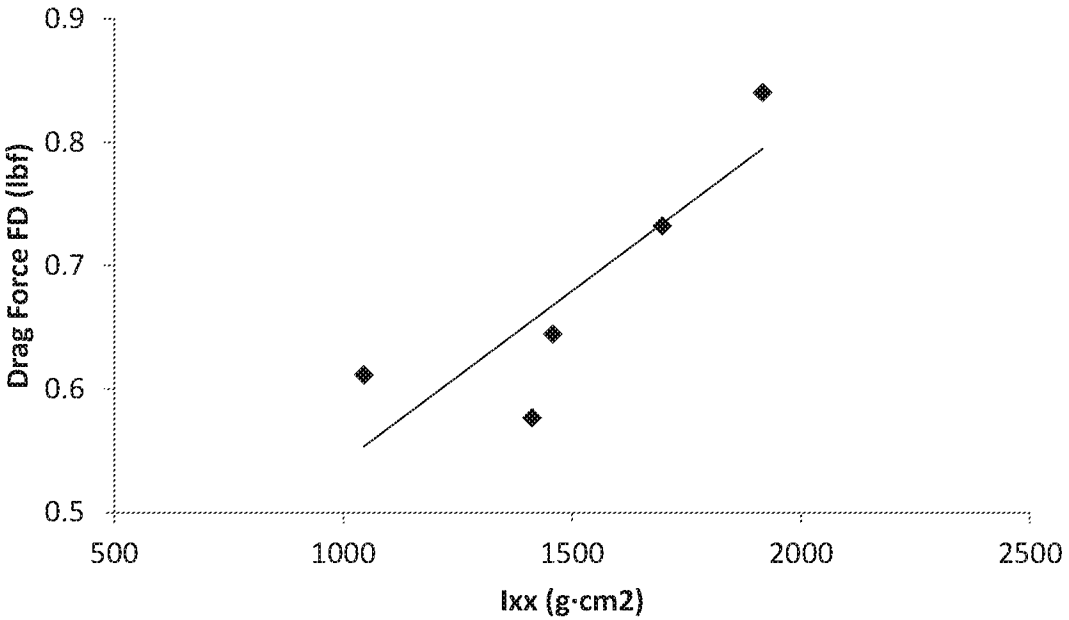
FIG. 23A illustrates a relationship between drag force and moment of inertia about the x-axis for various known golf club heads.
Figure 23B:
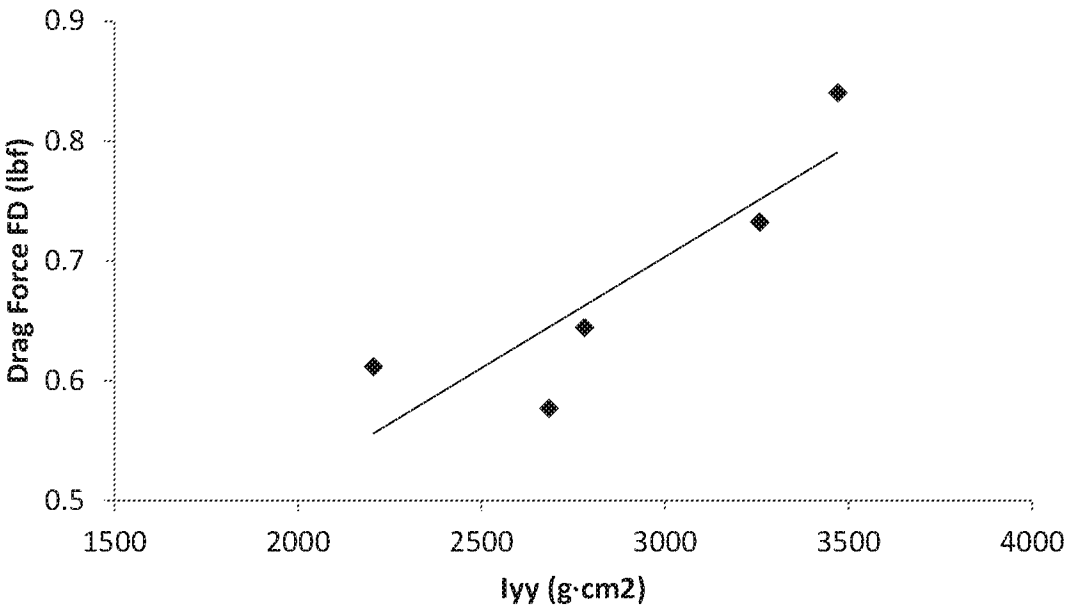
FIG. 23B illustrates a relationship between drag force and moment of inertia about the y-axis for various known golf club heads.
Figure 23C:
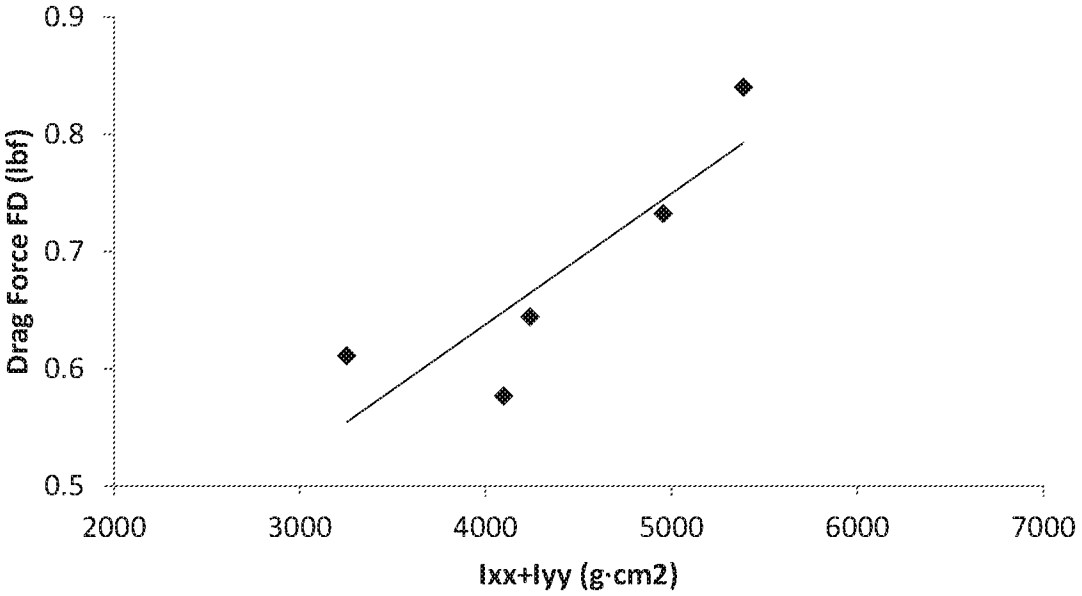
FIG. 23C illustrates a relationship between drag force and combined moment of inertia for various known golf club heads.

In many known golf club heads, increasing or maximizing the moment of inertia of the club head adversely affects aerodynamic drag. FIGS. 23A-C illustrate that for many known club heads having a volume and/or loft angle similar to club head 700, as the club head moment of inertia increases (to increase club head forgiveness), the force of drag during a swing increases (thereby reducing swing speed and ball distance).

For example, referring to FIG. 23A, for many known club heads, as the moment of inertia about the x-axis increases, the force of drag increases. For further example, referring to FIG. 23B, for many known club heads, as the moment of inertia about the y-axis increases, the force of drag increases. For further example referring to FIG. 23C, for many known club heads, as the combined moment of inertia (i.e. the sum of the moment of inertia about the x-axis and the moment of inertia about the y-axis) increases, the force of drag increases.

The club head 700 described herein increases or maximizes the club head moment of inertia compared to known club heads having similar volume and/or loft angle, while simultaneously maintaining or reducing aerodynamic drag.

Accordingly, the club head 700 having improved impact performance characteristics (e.g. spin, launch angle, ball speed, and forgiveness) also balances or improves swing performance characteristics (e.g. aerodynamic drag, ability to square the club head at impact, and swing speed).

Figure 24A:
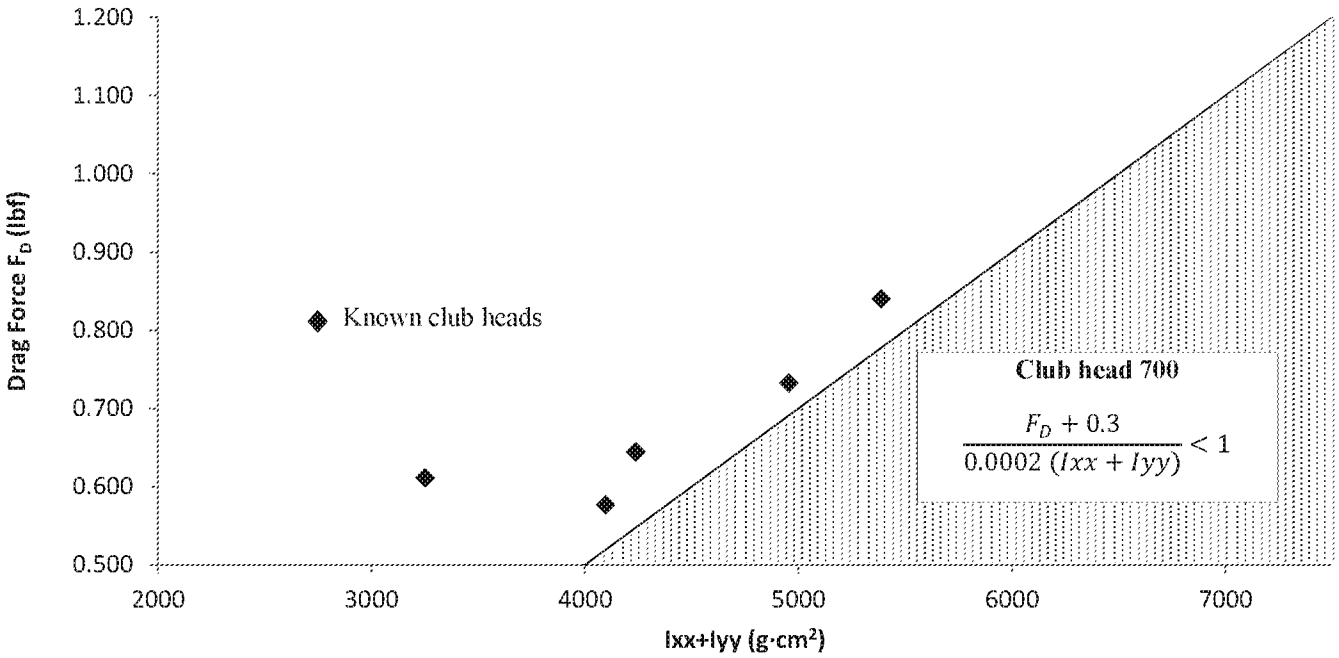
FIG. 24A illustrates a relationship between drag force and combined moment of inertia of golf club heads described herein compared to known golf club heads.
Figure 24B:
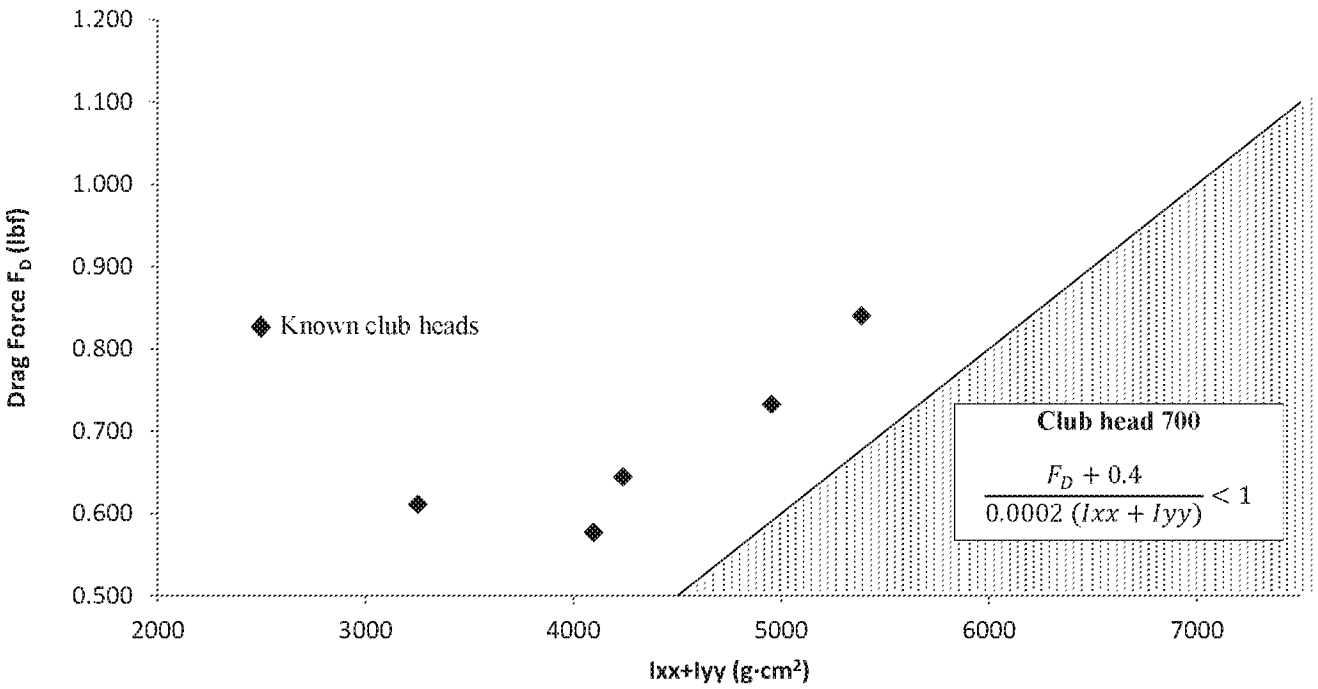
FIG. 24B illustrates a relationship between drag force and combined moment of inertia of golf club heads described herein compared to known golf club heads.

In many embodiments, referring to FIG. 24, the club head 700 satisfies one or more of the following relations, such that the combined moment of inertia (Ixx+Iyy) of the club head is increased, while maintaining or reducing the drag force ($F_D$) on the club head, compared to known golf club heads having similar volume and/or loft angle.

$$\frac{F_D + 0.3}{0.0002(I_{xx} + I_{yy})} < 1 \qquad \text{Relation 9}$$

$$\frac{F_D + 0.4}{0.0002(I_{xx} + I_{yy})} < 1 \qquad \text{Relation 10}$$

For example, in many embodiments, the club head 700 satisfies Relation 9. In other embodiments, the club head 700 can satisfy Relation 9, and can have a combined moment of inertia greater than 4900 g·cm$^2$, greater than 5000 g·cm$^2$, greater than 5100 g·cm$^2$, greater than 5200 g·cm$^2$, greater than 5300 g·cm$^2$, greater than 5400·cm$^2$, greater than 5500 g·cm$^2$, greater than 5600 g·cm$^2$, greater than 5700 g·cm$^2$, greater than 5800 g·cm$^2$, greater than 5900 g·cm$^2$, or greater than 6000 g·cm$^2$. In other embodiments still, the club head 700 can satisfy Relation 9, and can have a drag force less than 1.25 lbf, less than 1.0 lbf, less than 0.95 lbf, less than 0.90 lbf, less than 0.850 lbf, less than 0.83 lbf, or less than 0.80 lbf.

For further example, in many embodiments, the club head 700 satisfies Relation 10. In other embodiments, the club head 700 can satisfy Relation 10, and can have a combined moment of inertia greater than 4900 g·cm$^2$, greater than 5000 g·cm$^2$, greater than 5100 g·cm$^2$, greater than 5200 g·cm$^2$, greater than 5300 g·cm$^2$, greater than 5400·cm$^2$, greater than 5500 g·cm$^2$, greater than 5600 g·cm$^2$, greater than 5700 g·cm$^2$, greater than 5800 g·cm$^2$, greater than 5900 g·cm$^2$, or greater than 6000 g·cm$^2$. In other embodiments still, the club head 700 can satisfy Relation 10, and can have a drag force less than 1.25 lbf, less than 1.0 lbf, less than 0.95 lbf, less than 0.90 lbf, less than 0.850 lbf, less than 0.83 lbf, or less than 0.80 lbf.

i. CG Position and Aerodynamic Drag

Figure 25:
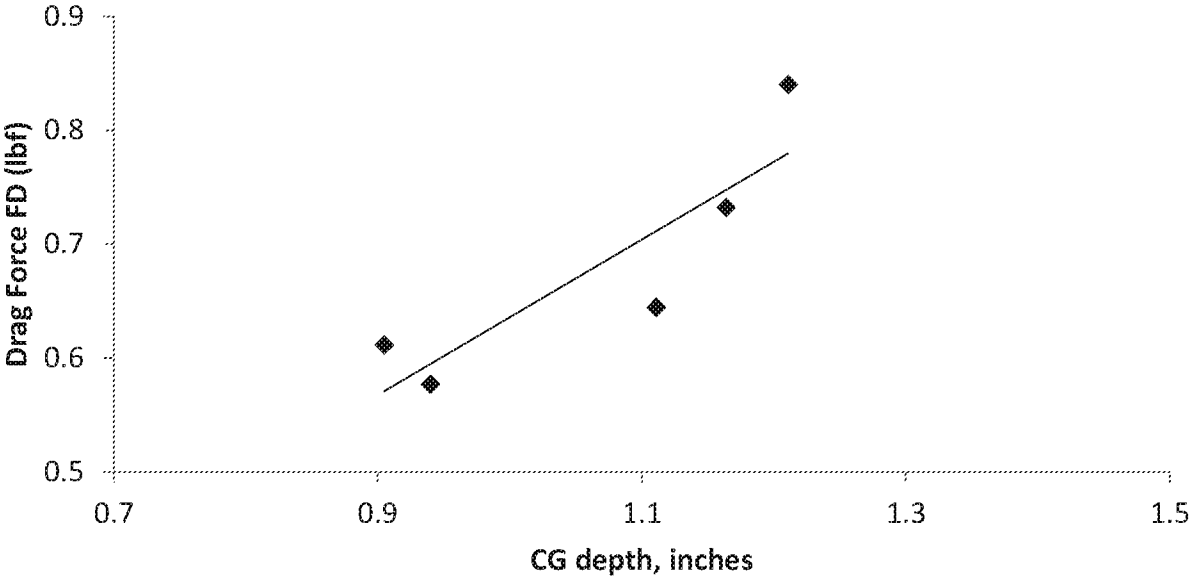
FIG. 25 illustrates a relationship between drag force and club head center of gravity depth for various known golf club heads.

In many known golf club heads, shifting the CG position farther back to increase launch angle of a golf ball and/or to increase club head inertia, can adversely affect other performance characteristics of the club head, such as aerodynamic drag. FIG. 25 illustrates that for many known club heads having volume and/or loft angle similar to club head 700, as the club head CG depth increases (to increase club head forgiveness and or launch angle), the force of drag during a swing increases (thereby reducing swing speed and ball distance). For example, referring to FIG. 25, for many known club heads, as the head CG depth increases, the force of drag on the club head increases.

The club head 700 described herein increases or maximizes the club head CG depth compared to known club heads having similar volume and/or loft angle, while simultaneously maintaining or reducing aerodynamic drag. Accordingly, the club head 700 having improved impact performance characteristics (e.g. spin, launch angle, ball speed, and forgiveness) also balances or improves swing performance characteristics (e.g. aerodynamic drag, ability to square the club head at impact, and swing speed).

Figure 26A:
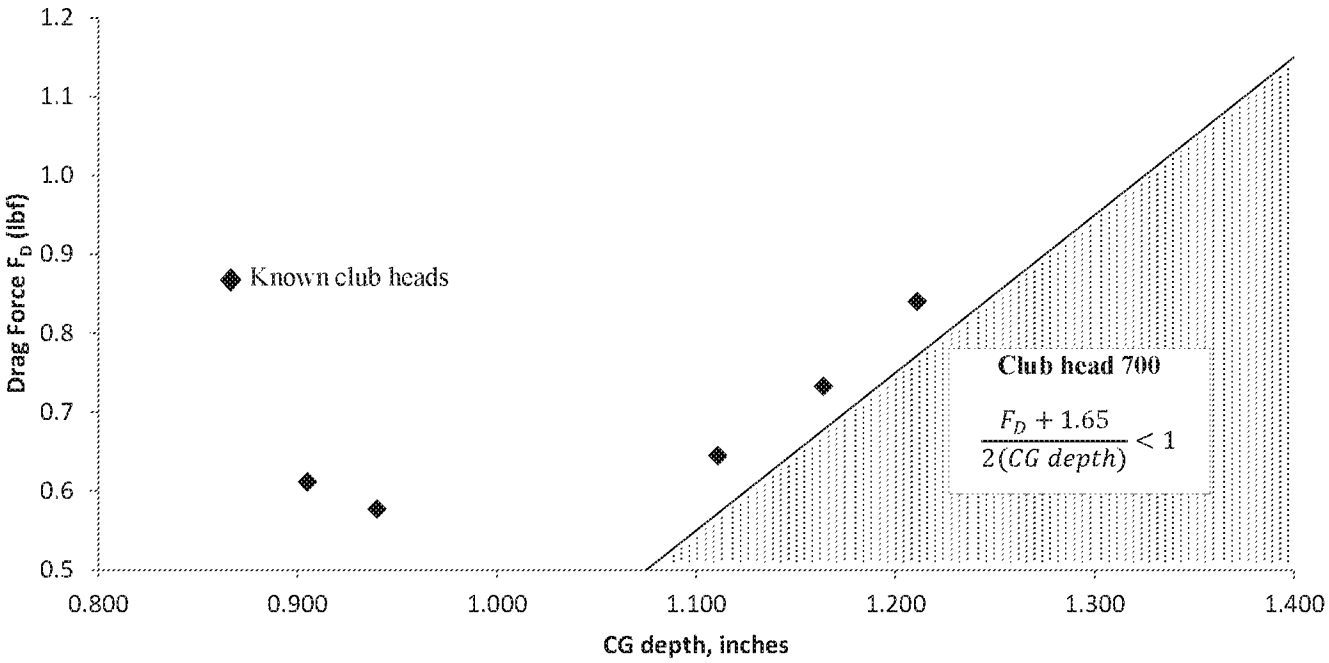
FIG. 26A illustrates a relationship between drag force and club head center of gravity depth of golf club heads described herein compared to known golf club heads.
Figure 26B:
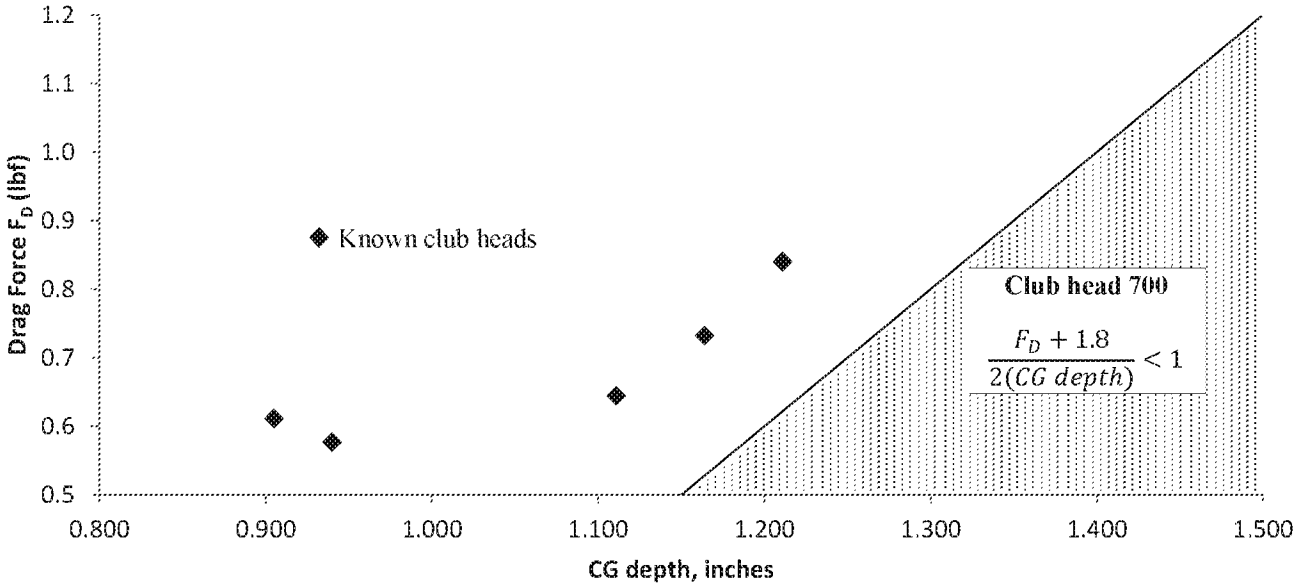
FIG. 26B illustrates a relationship between drag force and club head center of gravity depth of golf club heads described herein compared to known golf club heads.

In many embodiments, referring to FIG. 26, the club head 700 satisfies one or more of the following relations, such that the head CG depth ($CG_D$) is increased, while maintaining or reducing the drag force ($F_D$) on the club head, compared to known golf club heads having a similar volume and/or loft angle.

$$\frac{F_D + 1.65}{2\ CG_D} < 1 \qquad \text{Relation 11}$$

$$\frac{F_D + 1.8}{2\ CG_D} < 1 \qquad \text{Relation 12}$$

For example, in many embodiments, the club head 700 satisfies Relation 11. In other embodiments, the club head 700 can satisfy Relation 11, and can have a head CG depth greater than 1.1 inches, greater than 1.2 inches, greater than 1.3 inches, greater than 1.4 inches, greater than 1.5 inches, greater than 1.6 inches, greater than 1.7 inches, or greater than 1.8 inches. Further, in other embodiments, the club head 700 can satisfy Relation 11, and can have a drag force less than 1.25 lbf, less than 1.0 lbf, less than 0.95 lbf, less than 0.90 lbf, less than 0.85 lbf, less than 0.83 lbf, or less than 0.80 lbf.

For further example, in many embodiments, the club head 700 satisfies Relation 12. In other embodiments, the club head 700 can satisfy Relation 7, and can have a head CG depth greater than 1.1 inches, greater than 1.2 inches, greater than 1.3 inches, greater than 1.4 inches, greater than 1.5 inches, greater than 1.6 inches, greater than 1.7 inches, or greater than 1.8 inches. Further, in other embodiments, the club head 700 can satisfy Relation 12, and can have a drag force less than 1.25 lbf, less than 1.0 lbf, less than 0.95 lbf, less than 0.90 lbf, less than 0.85 lbf, less than 0.83 lbf, or less than 0.80 lbf. For further example, in many embodiments, the club head 300, 500 satisfies Relation 7, and has a drag force less than 1.16 lbf.

ii. Moment of Inertia and CG Depth

Figure 27:
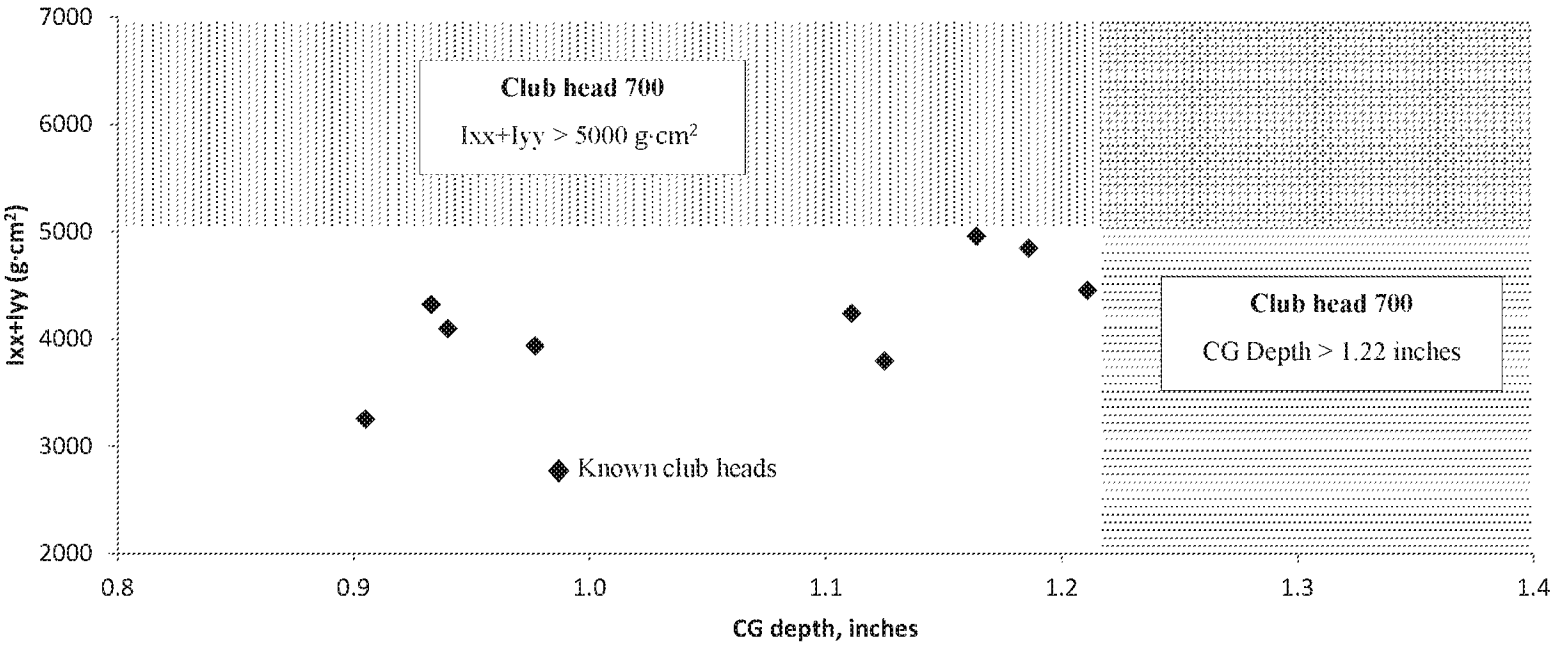
FIG. 27 illustrates a relationship between combined moment of inertia and club head center of gravity depth of golf club heads described herein compared to known golf club heads.

Referring to FIG. 27, the combined moment of inertia and/or head CG depth of many known golf club heads are limited. For example, many known golf club heads having a volume and/or loft angle similar to club head 700 have a head CG depth less than 1.2 inches and a combined moment of inertia less than 5000 g·cm$^2$. The club head 700 described herein has a greater head CG depth and a greater combined moment of inertia than known club heads having similar volume and/or loft angle, while simultaneously maintaining or reducing aerodynamic drag. Accordingly, the club head 300, 500 having improved impact performance characteristics (e.g. spin, launch angle, ball speed, and forgiveness) also balances or improves swing performance characteristics (e.g. aerodynamic drag, ability to square the club head at impact, and swing speed).

For example, in many embodiments the club head 700 has a head CG depth greater than 1.22 inches and a combined moment of inertia greater than 5000 g·cm$^2$. In other embodiments, the club head 300, 500 can have a head CG depth greater than 1.1 inches, greater than 1.2 inches, greater than 1.3 inches, greater than 1.4 inches, greater than 1.5 inches, greater than 1.6 inches, greater than 1.7 inches, or greater than 1.8 inches. Further, in other embodiments, the club head 700 can have a combined moment of inertia greater than 5000 g·cm$^2$, greater than 5100 g·cm$^2$, greater than 5200 g·cm$^2$, greater than 5300 g·cm$^2$, greater than 5400·cm$^2$, greater than 5500 g·cm$^2$, greater than 5600 g·cm$^2$, greater than 5700 g·cm$^2$, greater than 5800 g·cm$^2$, greater than 5900 g·cm$^2$, or greater than 6000 g·cm$^2$.

IV. Hybrid-Type Club Head

According to another embodiment, a golf club head 900 can comprise a hybrid-type club head. In many embodiments, club head 900 comprises the same or similar parameters as club head 100, wherein the parameters are described with the club head 100 reference numbers plus 800.

In many embodiments, the loft angle of the club head 900 is less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the club head 900 is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

In many embodiments, the volume of the club head 900 is less than approximately 200 cc, less than approximately 175 cc, less than approximately 150 cc, less than approximately 125 cc, less than approximately 100 cc, or less than approximately 75 cc. In some embodiments, the volume of the club head can be approximately 100 cc-150 cc, approximately 75 cc-150 cc, approximately 100 cc-125 cc, approximately 75 cc-100 cc, or approximately 75 cc-125 cc. In other embodiments, the golf club head 900 can comprise any type of golf club head having a loft angle and volume as described herein.

In many embodiments, the length 962 of the club head 900 is between 3.5 inches and 4.5 inches, between 3.75 inches and 4.75 inches, or between 3.5 inches and 4.75 inches. In other embodiments, the length 962 of the club head 900 is less than 4.5 inches, less than 4.4 inches, greater than 4.3 inches, less than 4.2 inches, less than 4.1 inches, or less than 4.0 inches.

In many embodiments, the depth 960 of the club head 900 is at least 0.70 inches less than the length 962 of the club head 900. In many embodiments, the depth 960 of the club head 900 is between 2.0 inches and 3.0 inches, between 2.0 inches and 2.75 inches, or between 2.0 inches and 2.5 inches. In other embodiments, the depth 960 of the club head 900 is less than 3.0 inches, less than 2.9 inches, less than 2.8 inches, less than 2.7 inches, less than 2.6 inches, less than 2.5 inches, less than 2.4 inches, less than 2.3 inches, less than 2.2 inches, less than 2.1 inches, or less than 2.0 inches.

In many embodiments, the height 964 of the club head 900 is less than approximately 1.75 inches. In other embodiments, the height 964 of the club head 900 is less than 2.0 inches, less than 1.9 inches, less than 1.8 inches, less than 1.7 inches, less than 1.6 inches, or less than 1.5 inches. For example, in some embodiments, the height of the club head 900 can be between 1.5-1.75 inches, between 1.0-1.75 inches, between 1.5-2.0 inches, or between 1.25-1.75 inches.

The club head 900 further comprises a balance of various additional parameters, such as head CG position, club head moment of inertia, and aerodynamic drag, to provide both improved impact performance characteristics (e.g. spin, launch angle, speed, forgiveness) and swing performance characteristics (e.g. aerodynamic drag, ability to square the club head at impact). In many embodiments, the balance of parameters described below provides improved impact performance while maintaining or improving swing performance characteristics. Further, in many embodiments, the balance of parameters described below provides improved swing performance characteristics while maintaining or improving impact performance characteristics.

A. Center of Gravity Position and Moment of Inertia

In many embodiments, a low and back club head CG and increased moment of inertia can be achieved by increasing discretionary weight and repositioning discretionary weight in regions of the club head having maximized distances from the head CG. Increasing discretionary weight can be achieved by thinning the crown and/or using optimized materials, as described above relative to the head CG position. Repositioning discretionary weight to maximize the distance from the head CG can be achieved using removable weights, embedded weights, or a steep crown angle, as described above relative to the head CG position.

In many embodiments, the club head 900 comprises a crown-to-sole moment of inertia $I_{xx}$ greater than approximately 3000 g·cm$^2$, greater than approximately 3250 g·cm$^2$, greater than approximately 3500 g·cm$^2$, greater than approximately 3750 g·cm$^2$, greater than approximately 4000 g·cm$^2$, greater than approximately 4250 g·cm$^2$, greater than approximately 4500 g·cm$^2$, greater than approximately 4750 g·cm$^2$, greater than approximately 5000 g·cm$^2$, greater than approximately 5250 g·cm$^2$, greater than approximately 5500 g·cm$^2$, greater than approximately 5750 g·cm$^2$, greater than approximately 6000 g·cm$^2$, greater than approximately 6250 g·cm$^2$, greater than approximately 6500 g·cm$^2$, greater than approximately 6750 g·cm$^2$, or greater than approximately 7000 g·cm$^2$.

In many embodiments, the club head 900 comprises a heel-to-toe moment of inertia $I_{yy}$ greater than approximately 5000 g·cm$^2$, greater than approximately 5250 g·cm$^2$, greater than approximately 5500 g·cm$^2$, greater than approximately 5750 g·cm$^2$, greater than approximately 6000 g·cm$^2$, greater than approximately 6250 g·cm$^2$, greater than approximately 6500 g·cm$^2$, greater than approximately 6750 g·cm$^2$, or greater than approximately 7000 g·cm$^2$.

In many embodiments, the club head 900 comprises a combined moment of inertia (i.e. the sum of the crown-to-sole moment of inertia $I_{xx}$ and the heel-to-toe moment of inertia $I_{yy}$) greater than 8000 g·cm$^2$, greater than 8500 g·cm$^2$, greater than 8750 g·cm$^2$, greater than 9000 g·cm$^2$, greater than 9250 g·cm$^2$, greater than 9500 g·cm$^2$, greater than 9750 g·cm$^2$, greater than 10000 g·cm$^2$, greater than 10250 g·cm$^2$, greater than 10500 g·cm$^2$, greater than 10750 g·cm$^2$, greater than 11000 g·cm$^2$, greater than 11250 g·cm$^2$, greater than 11500 g·cm$^2$, greater than 11750 g·cm$^2$, or greater than 12000 g·cm$^2$.

In many embodiments, the club head 900 comprises a head CG height 974 less than approximately 0.20 inches, less than approximately 0.15 inches, less than approximately 0.10 inches, less than approximately 0.09 inches, less than approximately 0.08 inches, less than approximately 0.07 inches, less than approximately 0.06 inches, or less than approximately 0.05 inches. Further, in many embodiments, the club head 900 comprises a head CG height 974 having an absolute value less than approximately 0.20 inches, less than approximately 0.15 inches, less than approximately 0.10 inches, less than approximately 0.09 inches, less than approximately 0.08 inches, less than approximately 0.07 inches, less than approximately 0.06 inches, or less than approximately 0.05 inches.

Further, in many embodiments, the club head 900 comprises a head CG depth 972 greater than approximately 0.75 inches, greater than approximately 0.80 inches, greater than approximately 0.85 inches, greater than approximately 0.90 inches, greater than approximately 0.95 inches, or greater than approximately 1.0 inches.

The club head 900 having the reduced head CG height 974 can reduce the backspin of a golf ball on impact compared to a similar club head having a higher head CG height. In many embodiments, reduced backspin can increase both ball speed and travel distance for improve club head performance. Further, the club head 900 having the increased head CG depth 972 can increase the heel-to-toe moment of inertia compared to a similar club head having a head CG depth closer to the strikeface. Increasing the heel-to-toe moment of inertia can increase club head forgiveness on impact to improve club head performance. Further still, the club head 900 having the increased head CG depth 973 can increase launch angle of a golf ball on impact by increasing the dynamic loft of the club head at delivery, compared to a similar club head having a head CG depth closer to the strikeface.

The head CG height 974 and/or head CG depth 972 can be achieved by reducing weight of the club head in various regions, thereby increasing discretionary weight, and repositioning discretionary weight in strategic regions of the club head 900 to shift the head CG lower and farther back. Various means to reduce and reposition club head weight are described below.

i. Thin Regions

In some embodiments, the head CG height 974 and/or head CG depth 972 can be achieved by thinning various regions of the club head to remove excess weight. Removing excess weight results in increased discretionary weight that can be strategically repositioned to regions of the club head 900 to achieve the desired low and back club head CG position.

In many embodiments, the club head 900 can have one or more thin regions. The one or more thin regions can be similar or identical to the one or more thin regions 376 of club head 300, or the one or more thin regions of club heads 500, 700. The one or more thin regions can be positioned on the strikeface 904, the body 902, or a combination of the strikeface 904 and the body 902. Further, the one or more thin regions can be positioned on any region of the body 902, including the crown 916, the sole 918, the heel 920, the toe 922, the front end 908, the back end 910, the skirt 928, or any combination of the described positions. For example, in some embodiments, the one or more thin regions can be positioned on the crown 916. For further example, the one or more thin regions can be positioned on a combination of the strikeface 904 and the crown 916. For further example, the one or more thin regions can be positioned on a combination of the strikeface 904, the crown 916, and the sole 918. For further example, the entire body 902 and/or the entire strikeface 904 can comprise a thin region.

In embodiments where one or more thin regions are positioned on the strikeface 904, the thickness of the strikeface 904 can vary defining a maximum strikeface thickness and a minimum strikeface thickness. In these embodiments, the minimum strikeface thickness can be less than 0.10 inches, less than 0.09 inches, less than 0.08 inches, less than 0.07 inches, less than 0.06 inches, less than 0.05 inches, less than 0.04 inches, less than 0.03 inches, or less than 0.02 inches. In these or other embodiments, the maximum strikeface thickness can be less than 0.20 inches, less than 0.19 inches, less than 0.18 inches, less than 0.17 inches, less than 0.16 inches, less than 0.15 inches, less than 0.14 inches, less than 0.13 inches, less than 0.12 inches, less than 0.11 inches, or less than 0.10 inches.

In embodiments where one or more thin regions are positioned on the body 902, the thin regions can comprise a thickness less than approximately 0.022 inches. In other embodiments, the thin regions comprise a thickness less than 0.025 inches, less than 0.020 inches, less than 0.019 inches, less than 0.018 inches, less than 0.017 inches, less than 0.016 inches, less than 0.015 inches, less than 0.014 inches, less than 0.013 inches, less than 0.012 inches, or less than 0.010 inches. For example, the thin regions can comprise a thickness between approximately 0.010-0.025 inches, between approximately 0.013-0.022 inches, between approximately 0.014-0.020 inches, between approximately 0.015-0.020 inches, between approximately 0.016-0.020 inches, between approximately 0.017-0.020 inches, or between approximately 0.018-0.020 inches.

In the illustrated embodiment, the thin regions vary in shape and position and cover approximately 25% of the surface area of club head 900. In other embodiments, the thin regions can cover approximately 20-30%, approximately 15-35%, approximately 15-25%, approximately 10-25%, approximately 15-30%, or approximately 20-50% of the surface area of club head 900. Further, in other embodiments, the thin regions can cover up to 5%, up to 10%, up to 15%, up to 20%, up to 25%, up to 30%, up to 35%, up to 40%, up to 45%, or up to 50% of the surface area of club head 900.

In many embodiments, the crown 916 comprises one or more thin regions, such that approximately 51% of the surface area of the crown 916 comprises thin regions. In other embodiments, the crown 916 comprises one or more thin regions, such that up to 20%, up to 25%, up to 30%, up to 35%, up to 40%, up to 45%, up to 50%, up to 55%, up to 60%, up to 65%, up to 70%, or up to 75% of the crown 916 comprises thin regions. For example, in some embodiments, approximately 40-60% of the crown 916 can comprise thin regions. For further example, in other embodiments, approximately 35-65%, approximately 30-70%, or approximately 25-75% of the crown 916 can comprise thin regions. In some embodiments, the crown 916 can comprise one or more thin regions, wherein each of the one or more thin regions become thinner in a gradient fashion. In this exemplary embodiment, the one or more thin regions of the crown 916 extend in a heel-to-toe direction, and each of the one or more thin regions decrease in thickness in a direction from the strikeface 904 toward the back end 910.

In many embodiments, the sole 918 comprises one or more thin regions, such that approximately 64% of the surface area of the sole 918 comprises thin regions. In other embodiments, the sole 918 comprises one or more thin regions, such that up to 20%, up to 25%, up to 30%, up to 35%, up to 40%, up to 45%, up to 50%, up to 55%, up to 60%, up to 65%, up to 70%, or up to 75% of the sole 918 comprises thin regions. For example, in some embodiments, approximately 40-60% of the sole 918 can comprise thin regions. For further example, in other embodiments, approximately 35-65%, approximately 30-70%, or approximately 25-75% of the sole 918 can comprise thin regions.

The thinned regions can comprise any shape, such as circular, triangular, square, rectangular, ovular, or any other polygon or shape with at least one curved surface. Further, on or more thinned regions can comprise the same shape as or a different shape than the remaining thinned regions.

In many embodiments, club head 900 having thin regions can be manufacturing using centrifugal casting. In these embodiments, centrifugal casting allows the club head 900 to have thinner walls than a club head manufactured using conventional casting. In other embodiments, portions of the club head 900 having thin regions can be manufactured using other suitable methods, such as stamping, forging, or machining. In embodiments where portions of the club head 900 having thin regions are manufactured using stamping, forging, or machining, the portions of the club head 900 can be coupled using epoxy, tape, welding, mechanical fasteners, or other suitable methods.

ii. Optimized Materials

In some embodiments, the strikeface 904 and/or the body 902 can comprise an optimized material having increased specific strength and/or increased specific flexibility. The specific flexibility is measured as a ratio of the yield strength to the elastic modulus of the optimized material. Increasing specific strength and/or specific flexibility can allow portions of the club head to be thinned, while maintaining durability.

In some embodiments, the first material of the strikeface 904 can be an optimized material, as described in U.S. Provisional Patent Appl. No. 62/399,929, entitled "Golf Club Heads with Optimized Material Properties." In these or other embodiments, the first material comprising an optimized titanium alloy can have a specific strength greater than or equal to approximately 900,000 PSI/lb/in$^3$ (224 MPa/g/cm$^3$), greater than or equal to approximately 910,000 PSI/lb/in$^3$ (227 MPa/g/cm$^3$), greater than or equal to approximately 920,000 PSI/lb/in$^3$ (229 MPa/g/cm$^3$), greater than or equal to approximately 930,000 PSI/lb/in$^3$ (232 MPa/g/cm$^3$), greater than or equal to approximately 940,000 PSI/lb/in$^3$ (234 MPa/g/cm$^3$), greater than or equal to approximately 950,000 PSI/lb/in$^3$ (237 MPa/g/cm$^3$), greater than or equal to approximately 960,000 PSI/lb/in$^3$ (239 MPa/g/cm$^3$), greater than or equal to approximately 970,000 PSI/lb/in$^3$ (242 MPa/g/cm$^3$), greater than or equal to approximately 980,000 PSI/lb/in$^3$ (244 MPa/g/cm$^3$), greater than or equal to approximately 990,000 PSI/lb/in$^3$ (247 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), greater than or equal to approximately 1,100,000 PSI/lb/in$^3$ (274 MPa/g/cm$^3$), or greater than or equal to approximately 1,150,000 PSI/lb/in$^3$ (286 MPa/g/cm$^3$).

Further, in these or other embodiments, the first material comprising an optimized titanium alloy can have a specific flexibility greater than or equal to approximately 0.0075, greater than or equal to approximately 0.0080, greater than or equal to approximately 0.0085, greater than or equal to approximately 0.0090, greater than or equal to approximately 0.0091, greater than or equal to approximately 0.0092, greater than or equal to approximately 0.0093, greater than or equal to approximately 0.0094, greater than or equal to approximately 0.0095, greater than or equal to approximately 0.0096, greater than or equal to approximately 0.0097, greater than or equal to approximately 0.0098, greater than or equal to approximately 0.0099, greater than or equal to approximately 0.0100, greater than or equal to approximately 0.0105, greater than or equal to approximately 0.0110, greater than or equal to approximately 0.0115, or greater than or equal to approximately 0.0120.

In these or other embodiments, the first material comprising an optimized steel alloy can have a specific strength greater than or equal to approximately 650,000 PSI/lb/in$^3$ (162 MPa/g/cm$^3$), greater than or equal to approximately 700,000 PSI/lb/in$^3$ (174 MPa/g/cm$^3$), greater than or equal to approximately 750,000 PSI/lb/in$^3$ (187 MPa/g/cm$^3$), greater than or equal to approximately 800,000 PSI/lb/in$^3$ (199 MPa/g/cm$^3$), greater than or equal to approximately 810,000 PSI/lb/in$^3$ (202 MPa/g/cm$^3$), greater than or equal to approximately 820,000 PSI/lb/in$^3$ (204 MPa/g/cm$^3$), greater than or equal to approximately 830,000 PSI/lb/in$^3$ (207 MPa/g/cm$^3$), greater than or equal to approximately 840,000 PSI/lb/in$^3$ (209 MPa/g/cm$^3$), greater than or equal to approximately 850,000 PSI/lb/in$^3$ (212 MPa/g/cm$^3$), greater than or equal to approximately 900,000 PSI/lb/in$^3$ (224 MPa/g/cm$^3$), greater than or equal to approximately 950,000 PSI/lb/in$^3$ (237 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), greater than or equal to approximately 1,100,000 PSI/lb/in$^3$ (274 MPa/g/cm$^3$), greater than or equal to approximately 1,115,000 PSI/lb/in$^3$ (278 MPa/g/cm$^3$), or greater than or equal to approximately 1,120,000 PSI/lb/in$^3$ (279 MPa/g/cm$^3$).

Further, in these or other embodiments, the first material comprising an optimized steel alloy can have a specific flexibility greater than or equal to approximately 0.0060, greater than or equal to approximately 0.0065, greater than or equal to approximately 0.0070, greater than or equal to approximately 0.0075, greater than or equal to approximately 0.0080, greater than or equal to approximately 0.0085, greater than or equal to approximately 0.0090, greater than or equal to approximately 0.0095, greater than or equal to approximately 0.0100, greater than or equal to approximately 0.0105, greater than or equal to approximately 0.0110, greater than or equal to approximately 0.0115, greater than or equal to approximately 0.0120, greater than or equal to approximately 0.0125, greater than or equal to approximately 0.0130, greater than or equal to approximately 0.0135, greater than or equal to approximately 0.0140, greater than or equal to approximately 0.0145, or greater than or equal to approximately 0.0150.

In these embodiments, the increased specific strength and/or increased specific flexibility of the optimized first material allow the strikeface 904, or portions thereof, to be thinned, as described above, while maintaining durability. Thinning of the strikeface 904 can reduce the weight of the strikeface 904, thereby increasing discretionary weight to be strategically positioned in other areas of the club head 900 to position the head CG low and back and/or increase the club head moment of inertia.

In some embodiments, the second material of the body 902 can be an optimized material, as described in U.S. Provisional Patent Appl. No. 62/399,929, entitled "Golf Club Heads with Optimized Material Properties." In these or other embodiments, the second material comprising an optimized titanium alloy can have a specific strength greater than or equal to approximately 730,500 PSI/lb/in$^3$ (182 MPa/g/cm$^3$). For example, the specific strength of the optimized titanium alloy can be greater than or equal to approximately 650,000 PSI/lb/in$^3$ (162 MPa/g/cm$^3$), greater than or equal to approximately 700,000 PSI/lb/in$^3$ (174 MPa/g/cm$^3$), greater than or equal to approximately 750,000 PSI/lb/in$^3$ (187 MPa/g/cm$^3$), greater than or equal to approximately 800,000 PSI/lb/in$^3$ (199 MPa/g/cm$^3$), greater than or equal to approximately 850,000 PSI/lb/in$^3$ (212 MPa/g/cm$^3$), greater than or equal to approximately 900,000 PSI/ lb/in$^3$ (224 MPa/g/cm$^3$), greater than or equal to approximately 950,000 PSI/lb/in$^3$ (237 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), or greater than or equal to approximately 1,100,000 PSI/lb/in$^3$ (272 MPa/g/cm$^3$).

Further, in these or other embodiments, the second material comprising an optimized titanium alloy can have a specific flexibility greater than or equal to approximately 0.0060, greater than or equal to approximately 0.0065, greater than or equal to approximately 0.0070, greater than or equal to approximately 0.0075, greater than or equal to approximately 0.0080, greater than or equal to approximately 0.0085, greater than or equal to approximately 0.0090, greater than or equal to approximately 0.0095, greater than or equal to approximately 0.0100, greater than or equal to approximately 0.0105, greater than or equal to approximately 0.0110, greater than or equal to approximately 0.0115, or greater than or equal to approximately 0.0120.

In these or other embodiments, the second material comprising an optimized steel can have a specific strength greater than or equal to approximately 500,000 PSI/lb/in$^3$ (125 MPa/g/cm$^3$), greater than or equal to approximately 510,000 PSI/lb/in$^3$ (127 MPa/g/cm$^3$), greater than or equal to approximately 520,000 PSI/lb/in$^3$ (130 MPa/g/cm$^3$), greater than or equal to approximately 530,000 PSI/lb/in$^3$ (132 MPa/g/cm$^3$), greater than or equal to approximately 540,000 PSI/lb/in$^3$ (135 MPa/g/cm$^3$), greater than or equal to approximately 550,000 PSI/lb/in$^3$ (137 MPa/g/cm$^3$), greater than or equal to approximately 560,000 PSI/lb/in$^3$ (139 MPa/g/cm$^3$), greater than or equal to approximately 570,000 PSI/lb/in$^3$ (142 MPa/g/cm$^3$), greater than or equal to approximately 580,000 PSI/lb/in$^3$ (144 MPa/g/cm$^3$), greater than or equal to approximately 590,000 PSI/lb/in$^3$ (147 MPa/g/cm$^3$), greater than or equal to approximately 600,000 PSI/lb/in$^3$ (149 MPa/g/cm$^3$), greater than or equal to approximately 625,000 PSI/lb/in$^3$ (156 MPa/g/cm$^3$), greater than or equal to approximately 675,000 PSI/lb/in$^3$ (168 MPa/g/cm$^3$), greater than or equal to approximately 725,000 PSI/lb/in$^3$ (181 MPa/g/cm$^3$), greater than or equal to approximately 775,000 PSI/lb/in$^3$ (193 MPa/g/cm$^3$), greater than or equal to approximately 825,000 PSI/lb/in$^3$ (205 MPa/g/cm$^3$), greater than or equal to approximately 875,000 PSI/lb/in$^3$ (218 MPa/g/cm$^3$), greater than or equal to approximately 925,000 PSI/lb/in$^3$ (230 MPa/g/cm$^3$), greater than or equal to approximately 975,000 PSI/lb/in$^3$ (243 MPa/g/cm$^3$), greater than or equal to approximately 1,025,000 PSI/lb/in$^3$ (255 MPa/g/cm$^3$), greater than or equal to approximately 1,075,000 PSI/lb/in$^3$ (268 MPa/g/cm$^3$), or greater than or equal to approximately 1,125,000 PSI/lb/in$^3$ (280 MPa/g/cm$^3$).

Further, in these or other embodiments, the second material comprising an optimized steel can have a specific flexibility greater than or equal to approximately 0.0060, greater than or equal to approximately 0.0062, greater than or equal to approximately 0.0064, greater than or equal to approximately 0.0066, greater than or equal to approximately 0.0068, greater than or equal to approximately 0.0070, greater than or equal to approximately 0.0072, greater than or equal to approximately 0.0076, greater than or equal to approximately 0.0080, greater than or equal to approximately 0.0084, greater than or equal to approximately 0.0088, greater than or equal to approximately 0.0092, greater than or equal to approximately 0.0096, greater than or equal to approximately 0.0100, greater than or equal to approximately 0.0105, greater than or equal to approximately 0.0110, greater than or equal to approximately 0.0115, greater than or equal to approximately 0.0120, greater than or equal to approximately 0.0125, greater than or equal to approximately 0.0130, greater than or equal to approximately 0.0135, greater than or equal to approximately 0.0140, greater than or equal to approximately 0.0145, or greater than or equal to approximately 0.0150.

In these embodiments, the increased specific strength and/or increased specific flexibility of the optimized second material allow the body 902, or portions thereof, to be thinned, while maintaining durability. Thinning of the body 902 can reduce club head weight, thereby increasing discretionary weight to be strategically positioned in other areas of the club head 900 to position the head CG low and back and/or increase the club head moment of inertia.

iii. Removable Weights

In some embodiments, the club head 900 can include one or more weight structures 980 comprising one or more removable weights 982. The one or more weight structures 980 and/or the one or more removable weights 982 can be located towards the sole 918 and towards the back end 910, thereby positioning the discretionary weight on the sole 918 and near the back end 910 of the club head 900 to achieve a low and back head CG position. In many embodiments, the one or more weight structures 980 removably receive the one or more removable weights 982. In these embodiments, the one or more removable weights 982 can be coupled to the one or more weight structures 980 using any suitable method, such as a threaded fastener, an adhesive, a magnet, a snap fit, or any other mechanism capable of securing the one or more removable weights to the one or more weight structures.

The weight structure 980 and/or removable weight 982 can be located relative to a clock grid 2000 (illustrated in FIG. 3), which can be aligned with respect to the strikeface 904 when viewed from a top view. The clock grid comprises at least a 12 o'clock ray, a 3 o'clock ray, a 4 o'clock ray, a 5 o'clock ray, a 6 o'clock ray, a 7 o'clock ray, a 8 o'clock ray, and a 9 o'clock ray. For example, the clock grid 2000 comprises a 12 o'clock ray 2012, which is aligned with the geometric center 940 of the strikeface 904. The 12 o'clock ray 2012 is orthogonal to the X'Y'plane. Clock grid 2000 can be centered along 12 o'clock ray 2012, at a midpoint between the front end 908 and back end 910 of the club head 900. In the same or other examples, clock grid centerpoint 2010 can be centered proximate to a geometric centerpoint of golf club head 900 when viewed from a bottom view. The clock grid 2000 also comprises a 3 o'clock ray 2003 extending towards the heel 920, and a 9 o'clock ray 2009 extending towards the toe 922 of the club head 900.

A weight perimeter 984 of the weight structure 980 is located in the present embodiment towards the back end 910, at least partially bounded between a 4 o'clock ray 2004 and 8 o'clock ray 2008 of clock grid 2000, while a weight center 986 of a removable weight 982 positioned within weight structure 980 is located between a 5 o'clock ray 2005 and a 7 o'clock ray 2007. In examples such as the present one, the weight perimeter 984 is fully bounded between the 4 o'clock ray 2004 and the 8 o'clock ray 2008. Although the weight perimeter 984 is defined external to the club head 900 in the present example, there can be other examples where the weight perimeter 984 may extend into an interior of, or be defined within, the club head 900. In some examples, the location of the weight structure 980 can be established with respect to a broader area. For instance, in such examples, the weight perimeter 984 of the weight structure 980 can be located towards the back end 910, at least partially bounded between the 4 o'clock ray 2004 and 9 o'clock ray 2009 of the clock grid 2000, while the weight center 986 can be located between the 5 o'clock ray 2005 and 8 o'clock ray 2008.

In the present example, the weight structure 9800 protrudes from the external contour of the sole 918, and is thus at least partially external to allow for greater adjustment of the head CG 970. In some examples, the weight structure 980 can comprise a mass of approximately 2 grams to approximately 50 grams, and/or a volume of approximately 1 cc to approximately 30 cc. In other examples, the weight structure 980 can remain flush with the external contour of the body 902.

In many embodiments, the removable weight 982 can comprise a mass of approximately 0.5 grams to approximately 30 grams, and can be replaced with one or more other similar removable weights to adjust the location of the head CG 970. In the same or other examples, the weight center 986 can comprise at least one of a center of gravity of the removable weight 982, and/or a geometric center of removable weight 982.

iv. Embedded Weights

In some embodiments, the club head 900 can include one or more embedded weights to position the discretionary weight on the sole 918, in the skirt 928, and/or near the back end 910 of the club head 900 to achieve a low and back head CG position. The one or more embedded weights of club head 900 can be similar or identical to the one or more embedded weights 383 of club head 300, the one or more embedded weights of club head 500, or the one or more embedded weights of club head 700. In many embodiments, the one or more embedded weights are permanently fixed to or within the club head 900. In these embodiments, the embedded weight can be similar to the high density metal piece (HDMP) described in U.S. Provisional Patent Appl. No. 62/372,870, entitled "Embedded High Density Casting."

In many embodiments, the one or more embedded weights are positioned near the back end 910 of the club head 900. For example, a weight center of the embedded weight can be located between the 5 o'clock ray 2005 and 7 o'clock ray 2007, or between the 5 o'clock ray 2005 and 8 o'clock ray 2008 of the clock grid 2000. In many embodiments, the one or more embedded weights can be positioned on the skirt 928 and near the back end 910 of the club head 900, on the sole 918 and near the back end 910 of the club head 900, or on the skirt 928 and the sole 918 near the back end 910 of the club head 900.

In many embodiments, the weight center of the one or more embedded weights is positioned within 0.10 inches, within 0.20 inches, within 0.30 inches, within 0.40 inches, within 0.50 inches, within 0.60 inches, within 0.70 inches, within 0.80 inches, within 0.90 inches, within 1.0 inches, within 1.1 inches, within 1.2 inches, within 1.3 inches, within 1.4 inches, or within 1.5 inches of a perimeter of the club head 900 when viewed from a top view. In these embodiments, the proximity of the embedded weight to the perimeter of the club head 900 can maximize the low and back head CG position, the crown-to-sole moment of inertia $I_{xx}$, and/or the heel-to-toe moment of inertia $I_{yy}$.

In many embodiments, the weight center of the one or more embedded weights is positioned at a distance from the head CG 970 greater than 1.6 inches, greater than 1.7 inches, greater than 1.8 inches, greater than 1.9 inches, greater than 2.0 inches, greater than 2.1 inches, greater than 2.2 inches, greater than 2.3 inches, greater than 2.4 inches, greater than 2.5 inches, greater than 2.6 inches, greater than 2.7 inches, greater than 2.8 inches, greater than 2.9 inches, or greater than 3.0 inches.

In many embodiments, the weight center of the one or more embedded weights is positioned at a distance from the geometric center 940 of the strikeface 904 greater than 4.0 inches, greater than 4.1 inches, greater than 4.2 inches, greater than 4.3 inches, greater than 4.4 inches, greater than 4.5 inches, greater than 4.6 inches, greater than 4.7 inches, greater than 4.8 inches, greater than 4.9 inches, or greater than 5.0 inches.

In many embodiments, the one or more embedded weights can comprise a mass between 3.0-120 grams. For example, in some embodiments, the one or more embedded weights can comprise a mass between 3.0-25 grams, between 10-40 grams, between 20-50 grams, between 30-60 grams, between 40-70 grams, between 50-80 grams, between 60-90 grams, between 70-100 grams, between 80-120 grams, or between 90-120 grams. In embodiments where the one or more embedded weights include more than one weight, each of the embedded weights can comprise the same or a different mass.

In many embodiments, the one or more embedded weights can comprise a material having a specific gravity between 10.0-22.0. For example, in many embodiments, the one or more embedded weights can comprise a material having a specific gravity greater than 10.0, greater than 11.0, greater than 12.0, greater than 13.0, greater than 14.0, greater than 15.0, greater than 16.0, greater than 17.0, greater than 18.0, or greater than 19.0. In embodiments where the one or more embedded weights include more than one weight, each of the embedded weights can comprise the same or a different material.

v. Steep Crown Angle

In some embodiments, the golf club head 900 can further include a steep crown angle 988 to achieve the low and back head CG position. The steep crown angle 988 positions the back end of the crown 916 toward the sole 918 or ground, thereby lowering the club head CG position.

The crown angle 988 is measured as the acute angle between a crown axis 1090 and the front plane 1020. In these embodiments, the crown axis is located in a cross-section of the club head taken along a plane positioned perpendicular to the ground plane 1030 and the front plane 1020. The crown axis 1090 can be further described with reference to a top transition boundary and a rear transition boundary.

The club head 900 includes a top transition boundary extending between the front end 908 and the crown 916 from near the heel 920 to near the toe 922. The top transition boundary includes a crown transition profile 990 when viewed from a side cross sectional view taken along a plane perpendicular to the front plane 1020 and perpendicular to the ground plane 1030 when the club head 900 is at an address position. The side cross sectional view can be taken along any point of the club head 900 from near the heel 920 to near the toe 930. The crown transition profile defines a front radius of curvature 992 extending from the front end 908 of the club head 900 where the contour departs from the roll radius and/or the bulge radius of the strikeface 904 to a crown transition point 994 indicating a change in curvature from the front radius of curvature 992 to the curvature of the crown 916. In some embodiments, the front radius of curvature 992 comprises a single radius of curvature extending from the top end 993 of the strikeface perimeter 942 near the crown 916 where the contour departs from the roll radius and/or the bulge radius of the strikeface 904 to a crown transition point 994 indicating a change in curvature from the front radius of curvature 992 to one or more curvatures of the crown 916.

The club head 900 further includes a rear transition boundary extending between the crown 916 and the skirt 928 from near the heel 920 to near the toe 922. The rear transition boundary includes a rear transition profile 996 when viewed from a side cross sectional view taken along a plane perpendicular to the front plane 1020 and perpendicular to the ground plane 1030 when the club head 900 is at an address position. The cross sectional view can be taken along any point of the club head from near the heel 920 to near the toe 922. The rear transition profile defines a rear radius of curvature 998 extending from the crown 916 to the skirt 928 of the club head 900. In many embodiments, the rear radius of curvature 998 comprises a single radius of curvature that transitions the crown 916 to the skirt 928 of the club head 300 along the rear transition boundary. A first rear transition point 1002 is located at the junction between the crown 916 and the rear transition boundary. A second rear transition point 1003 is located at the junction between the rear transition boundary and the skirt 928 of the club head 900.

The front radius of curvature 992 of the top transition boundary can remain constant, or can vary from near the heel 920 to near the toe 922 of the club head 900. Similarly, the rear radius of curvature 998 of the rear transition boundary can remain constant, or can vary from near the heel 920 to near the toe 922 of the club head 900.

The crown axis 1090 extends between the crown transition point 994 near the front end 908 of the club head 900 and the rear transition point 1002 near the back end 910 of the club head 900. The crown angle 988 can remain constant, or can vary from near the heel 920 to near the toe 922 of the club head 900. For example, the crown angle 988 can vary when the side cross sectional view is taken at different locations relative to the heel 920 and the toe 922.

In many embodiments, reducing the crown angle 988 compared to current club heads generates a steeper crown or a crown positioned closer to the ground plane when the club head is at an address position. Accordingly, the reduced crown angle 988 can result in a lower head CG position compared to a club head with a higher crown angle.

vi. Hosel Sleeve Weight

In some embodiments, the head CG height 974 and/or head CG depth 972 can be achieved by reducing the mass of the hosel sleeve 934. Removing excess weight from the hosel sleeve 934 results in increased discretionary weight that can be strategically repositioned to regions of the club head 900 to achieve the desired low and back club head CG position.

Reducing the mass of the hosel sleeve 934 can be achieve by thinning the sleeve walls, reducing the height of the hosel sleeve 934, reducing the diameter of the hosel sleeve 934, and/or by introducing voids in the walls of the hosel sleeve 934. In many embodiments, the mass of the hosel sleeve 934 can be less than 6 grams, less than 5.5 grams, less than 5.0 grams, less than 4.5 grams, or less than 4.0 grams. In many embodiments, the club head 900 having the reduced mass hosel sleeve can result in a lower (close to the sole) and farther back (closer to the back end) club head CG position than a similar club head with a heavier hosel sleeve.

B. Aerodynamic Drag

In many embodiments, the club head 900 comprises a low and back club head CG position and an increased club head moment of inertia, in combination with reduced aerodynamic drag.

In many embodiments, the club head 900 experiences an aerodynamic drag force less than approximately 1.0 lbf, less than 0.90 lbf, less than 0.80 lbf, less than 0.75 lbf, less than 0.70 lbf, less than 0.65 lbf, or less than 0.60 lbf when tested in a wind tunnel with a squared face and an air speed of 95 miles per hour (mph). In these or other embodiments, the club head 900 experiences an aerodynamic drag force less than approximately 1.0 lbf, less than 0.90 lbf, less than 0.80 lbf, less than 0.75 lbf, less than 0.70 lbf, less than 0.65 lbf, or less than 0.60 lbf when simulated using computational fluid dynamics with a squared face and an air speed of 95 miles per hour (mph). In these embodiments, the airflow experienced by the club head 900 having the squared face is directed at the strikeface 904 in a direction perpendicular to the X'Y' plane. The club head 900 having reduced aerodynamic drag can be achieved using various means, as described below.

i. Crown Angle Height

In some embodiments, reducing the crown angle 988 to form a steeper crown and lower head CG position may result in an undesired increase in aerodynamic drag due to increased air flow separation over the crown during a swing. To prevent increased drag associated with a reduced crown angle 988, a maximum crown height 1004 can be increased. The maximum crown height 1004 is the greatest distance between the crown 916 and the crown axis 1090 taken at any side cross sectional view of the club head along a plane positioned parallel to the Y'Z' plane. In many embodiments, a greater maximum crown height 1004 results in the crown 916 having a greater curvature. A greater curvature in the crown 916 moves the location of the air flow separation during a swing further back on the club head 900. In other words, a greater curvature allows the airflow to stay attached to club head 900 for a longer distance along the crown 916 during a swing. Moving the airflow separation point back on the crown 916 can result in reduced aerodynamic drag and increased club head swing speeds, thereby resulting in increased ball speed and distance.

ii. Transition Profiles

In many embodiments, the transition profiles of the club head 900 from the strikeface 904 to the crown 916, the strikeface 904 to the sole 918, and/or the crown 916 to the sole 918 along the back end 910 of the club head 900 can affect the aerodynamic drag on the club head 900 during a swing.

In some embodiments, the club head 900 having the top transition boundary defining the crown transition profile 990, and the rear transition boundary defining the rear transition profile 996 further includes a sole transition boundary defining a sole transition profile 1001. The sole transition boundary extends between the front end 908 and the sole 918 from near the heel 920 to near the toe 922. The sole transition boundary includes a sole transition profile 1001 when viewed from a side cross sectional view taken along a plane parallel to the Y'Z' plane. The side cross sectional view can be taken along any point of the club head from near the heel 920 to near the toe 922. The sole transition profile 1001 defines a sole radius of curvature 1012 extending from the front end 908 of the club head 900 where the contour departs from the roll radius and/or the bulge radius of the strikeface 904 to a sole transition point 1014 indicating a change in curvature from sole radius of curvature 1012 to the curvature of the sole 918. In some embodiments, the sole radius of curvature 1012 comprises a single radius of curvature extending from the bottom end 1013 of the strikeface perimeter 942 near the sole 1018 where the contour departs from the roll radius and/or the bulge radius of the strikeface 904 to a sole transition point 1014 indicating a change in curvature from the sole radius of curvature 1012 to a curvature of the sole 1014.

In many embodiments, the crown transition profile 990, the sole transition profile 1001, and the rear transition profile 996 can be similar to the crown transition, sole transition, and rear transition profiles described in U.S. patent Ser. No. 15/233,486, entitled "Golf Club Head with Transition Profiles to Reduce Aerodynamic Drag." Further, the front radius of curvature 992 can be similar to the first crown radius of curvature, the sole radius of curvature 1012 can be similar to the first sole radius of curvature, and the rear radius of curvature 998 can be similar to the rear radius of curvature described U.S. patent Ser. No. 15/233,486, entitled "Golf Club Head with Transition Profiles to Reduce Aerodynamic Drag."

iii. Turbulators

In some embodiments, the club head 900 can further include a plurality of turbulators 914, as described in U.S. patent application Ser. No. 13/536,753, now U.S. Pat. No. 8,608,587, granted on Dec. 17, 2013, entitled "Golf Club Heads with Turbulators and Methods to Manufacture Golf Club Heads with Turbulators," which is incorporated fully herein by reference. In many embodiments, the plurality of turbulators 914 disrupt the airflow thereby creating small vortices or turbulence inside the boundary layer to energize the boundary layer and delay separation of the airflow on the crown during a swing.

In some embodiments, the plurality of turbulators 614 can be adjacent to the crown transition point 394 of the club head 900. The plurality of turbulators 914 project from an outer surface of the crown 916 and include a length extending between the front end 908 and the back end 910 of the club head 900, and a width extending from the heel 920 to the toe 922 of the club head 900. In many embodiments, the length of the plurality of turbulators 914 is greater than the width. In some embodiments, the plurality of turbulators 914 can comprise the same width. In some embodiments, the plurality of turbulators 914 can vary in height profile. In some embodiments, the plurality of turbulators 914 can be higher toward the apex of the crown 916 than in comparison to the front of the crown 916. In other embodiments, the plurality of turbulators 914 can be higher toward the front of the crown 916, and lower in height toward the apex of the crown 916. In other embodiments, the plurality of turbulators 914 can comprise a constant height profile. Further, in many embodiments, at least a portion of at least one turbulator is located between the strikeface and an apex of the crown 916, and the spacing between adjacent turbulators is greater than the width of each of the adjacent turbulators.

iv. Back Cavity

In some embodiments, the club head 900 can further include a cavity 1020 located at the back end 910 and in the trailing edge 928 of the club head 900, similar to the cavity described in U.S. patent application Ser. No. 14/882,092, entitled "Golf Club Heads with Aerodynamic Features and Related Methods." In many embodiments, the cavity 1024 can break the vortices generated behind golf club head 900 into smaller vortices to reduce the size of the wake and/or reduce drag. In some embodiments, breaking the vortices into smaller vortices can generate a region of high pressure behind golf club head 900. In some embodiments, this region of high pressure can push golf club head 900 forward, reduce drag, and/or enhance the aerodynamic design of golf club head 900. In many embodiments, the net effect of smaller vortices and reduced drag is an increase in the speed of golf club head 900. This effect can lead to higher speeds at which a golf ball leaves strikeface after impact to increase ball travel distance.

In many embodiments, the cavity 1020 includes a back wall 1022 that is oriented in a direction perpendicular to the X'Z' plane and includes a width measured in a direction from the heel 920 to the toe 922, a depth 1024, and a height 1026.

v. Hosel Structure

In some embodiments, the hosel structure 930 can have a smaller outer diameter to reduce the aerodynamic drag on the club head 900 during a swing, compared to a similar club head having a larger diameter hosel structure. In many embodiments, the hosel structure 930 has an outer diameter less than 0.53 inches. For example, the hosel structure 930 can have an outer diameter less than 0.60 inches, less than 0.59 inches, less than 0.58 inches, less than 0.57 inches, less than 0.56 inches, less than 0.55 inches, less than 0.54 inches, less than 0.53 inches, less than 0.52, less than 0.51 inches, or less than 0.50 inches. In many embodiments, the outer diameter of the hosel structure 930 is reduced while maintaining adjustability of the loft angle and/or lie angle of the club head 900.

C. Balance of CG Position, Moment of Inertia, and Aerodynamic Drag

In current golf club head design, increasing or maximizing the moment of inertia of the club head can adversely affect other performance characteristics of the club head, such as aerodynamic drag. The club head 900 described herein increases or maximizes the club head moment of inertia, while simultaneously maintaining or reducing aerodynamic drag. Accordingly, the club head 900 having improved impact performance characteristics (e.g. spin, launch angle, ball speed, and forgiveness) also balances or improves swing performance characteristics (e.g. aerodynamic drag, ability to square the club head at impact, and swing speed).

V. Method of Manufacturing

In many embodiments, a method for forming the club head 100 can comprise forming a body 102, forming a strikeface 104, and coupling the strikeface 104 to the body 102 to form the club head 100. In many embodiments, forming the body 102 can consist of casting, 3D printing, machining, or any other suitable method for forming the body 102. In some embodiments, the body can be formed as a unitary piece. In other embodiments, the body 102 can be formed of a plurality of components that are coupled to form the body 102.

In many embodiments, forming the strikeface 104 can consist of machining, 3D printing, casting, or otherwise forming the strike face 104. In many embodiments, coupling the strikeface 104 and the body 102 can be accomplished by welding, mechanical fastening, or any other suitable method of coupling the strikeface 104 and the body 102.

VI. Examples

Example 1

Described herein is an exemplary golf club head 300 having a volume of 466 cc, a depth 360 of 4.81 inches, a length 362 of 4.88 inches, and a height 364 of 2.65 inches. The exemplary club head 300 includes a plurality of thin regions 376 on the crown 316 comprising 57% of the surface area of the crown 316 and having a minimum thickness of 0.013 inch. The exemplary club head 300 further includes a crown angle 388 of 68.6 degrees and a crown angle height 404 of 0.522 inch.

The exemplary club head 300 includes an embedded weight 383 comprising tungsten having a specific gravity of between 14-15 and a mass of 14.5 grams. In this example, the distance from the weight center 387 of the embedded weight 383 to the perimeter of the club head 300 is 0.183 inch when viewed from a top or bottom view. Further, in this example, the distance from the weight center 387 to the head CG 370 is 2.67 inches, and the distance from the weight center 387 to the geometric center 340 of the strikeface 304 is 4.58 inches. The exemplary club head 300 further includes a weight structure 380 that houses a removable weight 382. In this example, the weight structure 380 protrudes at least partially from an external contour of the sole 318. Further still, the exemplary club head 300 includes a hosel sleeve 334 having a mass of 4.5 grams.

As a result of the above described and/or additional parameters, the exemplary club head 300 comprises a head CG depth 372 of 1.87 inches and a head CG height 374 of 0.083 inches. Further, as a result of the above described and/or additional parameters, the exemplary club head 300 comprises a crown-to-sole moment of inertia $I_{xx}$ of 4258 g·cm$^2$, a heel-to-toe moment of inertia $I_{yy}$ of 5710 g·cm$^2$, and a combined moment of inertia $I_{xx}+I_{yy}$ of 9968 g·cm$^2$.

The exemplary club head 300 further includes a front radius of curvature 392 of 0.24 inch, a sole radius of curvature 412 of 0.30 inch, and a rear radius of curvature 398 of 0.20 inch. Further, the exemplary club head 300 includes a front projected area of 6.73 in$^2$ (0.00434 m$^2$), a side projected area of 8.73 in$^2$ (0.00563 m$^2$), and a hosel structure 330 having an outer diameter of 0.54 inch. As a result of the these and/or additional parameters, the exemplary club head 300 comprises an aerodynamic drag force of 0.95 lbf when simulated using computational fluid dynamics with a squared face at an air speed of 102 miles per hour (mph).

Example 2

Described herein is an exemplary golf club head 500 having a volume of 445 cc, a depth 560 of 4.64 inches, a length 562 of 4.77 inches, and a height 564 of 2.66 inches. The exemplary club head 500 includes a plurality of thin regions 576 on the crown 316 comprising 55% of the surface area of the crown 516 and having a minimum thickness of 0.013 inch. The exemplary club head 500 further includes a crown angle 588 of 70.0 degrees and a crown angle height 604 of 0.543 inch.

The exemplary club head 500 includes an embedded weight 583 comprising tungsten having a specific gravity of between 15-17 and a mass of 7 grams. In this example, the distance from the weight center 587 of the embedded weight 583 to the perimeter of the club head 500 is 0.274 inch when viewed from a top or bottom view. Further, in this example, the distance from the weight center 587 to the head CG 570 is 2.58 inches, and the distance from the weight center 587 to the geometric center 540 of the strikeface 504 is 4.31 inches. The exemplary club head 500 further includes a weight structure 580 that houses a removable weight 582. In this example, the weight structure 580 protrudes at least partially from an external contour of the sole 518. Further still, the exemplary club head 500 includes a hosel sleeve 534 having a mass of 4.5 grams.

As a result of the above described and/or additional parameters, the exemplary club head 500 comprises a head CG depth 572 of 1.70 inches and a head CG height 574 of 0.113 inches. Further, as a result of the above described and/or additional parameters, the exemplary club head 500 comprises a crown-to-sole moment of inertia $I_{xx}$ of 3768 g·cm$^2$, a heel-to-toe moment of inertia $I_{yy}$ of 5379 g·cm$^2$, and a combined moment of inertia $I_{xx}+I_{yy}$ of 9147 g·cm$^2$.

The exemplary club head 500 further includes a front radius of curvature 592 of 0.24 inch, a sole radius of curvature 612 of 0.30 inch, and a rear radius of curvature 598 of 0.20 inch. Further, the exemplary club head 500 includes a front projected area of 6.40 in$^2$ (0.00413 m$^2$), a side projected area of 8.18 in$^2$ (0.00528 m$^2$), and a hosel structure 530 having an outer diameter of 0.54 inch. Further still, the exemplary club head 500 includes a back cavity 620 having a length of 1.7 inches, a height 626 of 0.215 inch, and a depth 624 of 0.75 inch. As a result of the these and/or additional parameters, the exemplary club head 500 comprises an aerodynamic drag force of 0.83 lbf when simulated using computational fluid dynamics with a squared face at an air speed of 102 miles per hour (mph).

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A hollow body golf club head comprising:

a body having a front end, a back end opposite the front end, a crown, a sole opposite the crown, a heel, a toe opposite the heel, a skirt adjoining the crown and the sole, and a hosel structure having a hosel axis extending centrally through a bore in the hosel structure;

a strikeface positioned at the front end and defining a geometric center, a loft plane tangent to the geometric center, and a head depth plane extending through the geometric center from the heel to the toe, perpendicular to the loft plane;

wherein:

a loft angle of the club head is between 12 degrees and 35 degrees;

a head center of gravity of the club head is located at a head CG depth from the loft plane, measured in a direction perpendicular to the loft plane, and at a head CG height from a head depth plane, measured in a direction perpendicular to the head depth plane;

the club head experiences a drag force $F_D$ when subjected to an air speed of 98 mph in a direction perpendicular to a plane extending through the geometric center of the strikeface, parallel to the hosel axis, and positioned at the loft angle from the loft plane;

the club head has a crown-to-sole moment of inertia $I_{xx}$, a heel to toe moment of inertia $I_{yy}$, and a combined moment of inertia measured as the sum of the crown-to-sole moment of inertia and the heel to toe moment of inertia $I_{xx}+I_{yy}$; and the club head satisfies relation A and one or more of relations B and C:

$$\text{A. } \frac{F_D + 0.3}{0.0002(I_{xx} + I_{yy})} < 1$$

$$\text{B. } F_D < 1.0 \text{ lbf}$$

$$\text{C. } I_{xx} + I_{yy} > 5000 \text{ g}\cdot\text{cm}^2.$$

2. The golf club head of claim 1, wherein the club head further satisfies relation D:

$$\text{D. } \frac{F_D + 0.4}{0.0002(I_{xx} + I_{yy})} < 1.$$

3. The golf club head of claim 1, wherein the head CG depth is greater than 1.0 inches and the head CG height is less than 0.20 inches.

4. The golf club head of claim 1, further comprising one or more thin regions on the body having a thickness less than 0.02 inch.

5. The golf club head of claim 1, further comprising:

a clock grid having at least:

a 12 o'clock ray;

a 3 o'clock ray;

a 4 o'clock ray;

a 5 o'clock ray;

a 8 o'clock ray; and a 9 o'clock ray;

wherein:

the 12 o'clock ray is aligned with the geometric center of the strikeface and the clock grid is centered along the 12 o'clock ray at a midpoint between the front end and the back end of the club head;

the 3 o'clock ray extends towards the heel of the club head; and the 9 o'clock ray extends towards the toe of the club head;

a weight structure located towards the sole and back end of the club head, the weight structure comprising a weight perimeter and a removable weight.

6. The golf club head of claim 5, wherein the weight structure protrudes from an external contour of the sole.

7. The golf club head of claim 5, wherein the weight structure comprises a removable weight having a weight center located between the 5 o'clock ray and the 8 o'clock ray of clock grid.

8. A hollow body golf club head comprising:

a body having a front end, a back end opposite the front end, a crown, a sole opposite the crown, a heel, a toe opposite the heel, a skirt adjoining the crown and the sole, and a hosel structure having a hosel axis extending centrally through a bore in the hosel structure;

a strikeface positioned at the front end and defining a geometric center, a loft plane tangent to the geometric center, and a head depth plane extending through the geometric center from the heel to the toe, perpendicular to the loft plane;

wherein:

a loft angle of the club head is between 12 degrees and 35 degrees;

a head center of gravity of the club head is located at a head CG depth from the loft plane, measured in a direction perpendicular to the loft plane, and at a head CG height from a head depth plane, measured in a direction perpendicular to the head depth plane;

the club head experiences a drag force $F_D$ when subjected to an air speed of 98 mph in a direction perpendicular to a plane extending through the geometric center of the strikeface, parallel to the hosel axis, and positioned at the loft angle from the loft plane the club head has a crown-to-sole moment of inertia $I_{xx}$, a heel to toe moment of inertia $I_{yy}$, and a combined moment of inertia measured as the sum of the crown-to-sole moment of inertia and the heel to toe moment of inertia $I_{xx}+I_{yy}$; and the club head satisfies relation A and one or more of relations B and C:

$$\text{A. } \frac{F_D + 1.65}{2(\text{head } CG \text{ depth})} < 1$$

$$\text{B. } F_D < 1.0 \text{ lbf}$$

$$\text{C. head } CG \text{ depth} > 1.0 \text{ inches.}$$

9. The golf club head of claim 8, wherein the club head further satisfies relation D:

$$\text{D. } \frac{F_D + 1.8}{2(\text{head } CG \text{ depth})} < 1.$$

10. The golf club head of claim 8, wherein the combined moment of inertia is greater than 5000 g-cm$^2$.

11. The golf club head of claim 8, further comprising one or more thin regions on the body having a thickness less than 0.02 inch.

12. The golf club head of claim 8, further comprising:

a clock grid having at least:

a 12 o'clock ray;

a 3 o'clock ray;

a 4 o'clock ray;
a 5 o'clock ray;
a 8 o'clock ray; and
a 9 o'clock ray;
wherein:
the 12 o'clock ray is aligned with the geometric center of the strikeface and the clock grid is centered along the 12 o'clock ray at a midpoint between the front end and the back end of the club head;
the 3 o'clock ray extends towards the heel of the club head; and
the 9 o'clock ray extends towards the toe of the club head;

a weight structure located towards the sole and back end of the club head, the weight structure comprising a weight perimeter and a removable weight.

13. The golf club head of claim 12, wherein the weight structure protrudes from an external contour of the sole.

14. The golf club head of claim 12, wherein the weight structure comprises a removable weight having a weight center located between the 5 o'clock ray and the 8 o'clock ray of clock grid.

* * * * *